US010844657B2

(12) United States Patent
Fleischman et al.

(10) Patent No.: US 10,844,657 B2
(45) **Date of Patent: *Nov. 24, 2020**

(54) ROLL-UP WALL AND ACOUSTIC BARRIER SYSTEM

(71) Applicant: TUDELU LLC, Little Ferry, NJ (US)

(72) Inventors: Jacob Fleischman, Brooklyn, NY (US); Joel Klein, Brooklyn, NY (US)

(73) Assignee: TUDELU LLC, Little Ferry, NJ (US)

( * ) Notice: Subject to any disclaimer, the term of this patent is extended or adjusted under 35 U.S.C. 154(b) by 523 days.

This patent is subject to a terminal disclaimer.

(21) Appl. No.: 15/324,665

(22) PCT Filed: May 15, 2015

(86) PCT No.: PCT/US2015/031258
§ 371 (c)(1),
(2) Date: Jan. 6, 2017

(87) PCT Pub. No.: WO2015/176047
PCT Pub. Date: Nov. 19, 2015

(65) Prior Publication Data

US 2017/0211315 A1 Jul. 27, 2017

Related U.S. Application Data

(60) Provisional application No. 61/993,975, filed on May 15, 2014.

(51) Int. Cl.
*E06B 9/58* (2006.01)
*E06B 9/17* (2006.01)
(Continued)

(52) U.S. Cl.
CPC ..... *E06B 9/17* (2013.01); *E04B 1/0046* (2013.01); *E06B 9/13* (2013.01); *E06B 9/174* (2013.01);
(Continued)

(58) Field of Classification Search
CPC ... E06B 9/17; E06B 9/581; E06B 9/72; E06B 9/174; E06B 9/17007; E06B 9/17061;
(Continued)

(56) References Cited

U.S. PATENT DOCUMENTS 726,801 A 4/1903 Maxwell
764,070 A 7/1904 Parker
(Continued)

FOREIGN PATENT DOCUMENTS

AU 2009212839 A1 3/2010
EP 0841442 B2 8/2000
(Continued)

OTHER PUBLICATIONS

International Search Report, PCT/US2014/030073, Jacob Fleischman, pp. 1-2, dated Aug. 11, 2014.
(Continued)

*Primary Examiner* — Daniel P Cahn
(74) *Attorney, Agent, or Firm* — Law Office of Arthur M. Antonelli, PLLC

(57) ABSTRACT

The present invention relates to roll-up wall and acoustic barrier system (608) which may include an elongated member (300, 670). The elongated member may include a front wall (302), a rear wall (303) spaced from the front wall, a bottom wall (304), a first top wall (326*a*) adjacent the front wall, a second top wall (326*b*) adjacent the rear wall, and a channel (86) between the first top wall and the second top wall. The channel may comprise a first side wall (86*a*), a second side wall (86*b*), a first ledge (86*c*), and a second ledge (86*d*). The first and second ledges may define a slot (88) between the first side wall and the second side wall. The elongated member may further comprise a conduit (466) disposed between the front wall (302) and the rear wall (303) that is connected to the channel via the slot.

23 Claims, 72 Drawing Sheets

(51) Int. Cl.

| | |
|---|---|
| ***E04B 1/00*** | (2006.01) |
| ***E06B 9/13*** | (2006.01) |
| ***E06B 9/174*** | (2006.01) |
| ***E06B 9/72*** | (2006.01) |

(52) U.S. Cl.
CPC ..... *E06B 9/17007* (2013.01); *E06B 9/17046* (2013.01); *E06B 9/17061* (2013.01); *E06B 9/581* (2013.01); *E06B 9/582* (2013.01); *E06B 9/72* (2013.01); *E06B 2009/135* (2013.01); *E06B 2009/17069* (2013.01); *E06B 2009/588* (2013.01)

(58) Field of Classification Search
CPC ..... E06B 9/582; E06B 9/17046; E06B 9/13; E06B 2009/17069; E06B 2009/588; E06B 2009/135; E04B 1/0046
See application file for complete search history.

(56) References Cited

U.S. PATENT DOCUMENTS

| | | | | |
|---|---|---|---|---|
| D83,534 | S | 12/1930 | Helsley | |
| 2,055,285 | A | 9/1934 | Ford | |
| 2,280,358 | A | 8/1939 | Tietig | |
| 2,247,634 | A | 7/1941 | Houston | |
| 2,350,758 | A | 6/1944 | Heuer | |
| 2,516,020 | A | 7/1950 | Reed | |
| 2,831,222 | A | 4/1958 | Anderson | |
| 3,292,685 | A | 12/1966 | Clark | |
| D225,965 | S | 1/1973 | Schmit | |
| 3,822,733 | A | 7/1974 | Lindelow | |
| 3,900,063 | A | 8/1975 | Roller | |
| D244,083 | S | 4/1977 | Pfeiffer | |
| D250,391 | S | 11/1978 | France | |
| 4,508,126 | A | 4/1985 | Everard | |
| 4,519,434 | A | 5/1985 | Forquer | |
| 4,720,647 | A | 1/1988 | Plumer | |
| D297,111 | S | 8/1988 | Thompson | |
| 5,220,721 | A | 6/1993 | Thierry | |
| 5,323,831 | A | 6/1994 | Manthei | |
| 5,374,791 | A | 12/1994 | LeMarchand | |
| 5,429,558 | A | 7/1995 | Lagarde | |
| D409,078 | S | 5/1999 | Bolt | |
| 6,006,811 | A | 12/1999 | Brutsaert | |
| D426,453 | S | 6/2000 | Stearns et al. | |
| D431,770 | S | 10/2000 | Willet | |
| D434,304 | S | 11/2000 | Willet | |
| 6,145,571 | A | 11/2000 | Snyder | |
| D439,137 | S | 3/2001 | Ausillio | |
| D530,187 | S | 10/2006 | Esbaugh | |
| D533,547 | S | 12/2006 | Sergi | |
| D534,904 | S | 1/2007 | Crawford | |
| D542,628 | S | 5/2007 | Brassard | |
| D548,051 | S | 8/2007 | Ruppert et al. | |
| D559,083 | S | 1/2008 | Brassard | |
| D566,648 | S | 4/2008 | Lee | |
| D571,188 | S | 6/2008 | Brassard | |
| D575,220 | S | 8/2008 | Pockalny | |
| D576,472 | S | 9/2008 | Gaiardo | |
| D597,086 | S | 7/2009 | Sergi | |
| D690,180 | S | 9/2013 | Del Rossa | |
| D698,465 | S | 1/2014 | Bill | |
| 9,044,090 | B2 | 6/2015 | Drake et al. | |
| D733,531 | S | 7/2015 | Tonthat et al. | |
| 9,428,955 | B2 * | 8/2016 | Fleischman | E06B 9/58 |
| 9,458,974 | B2 | 10/2016 | Townsend, Jr. | |
| 10,273,750 | B2 | 4/2019 | Fleischman et al. | |
| 2002/0020508 | A1 | 2/2002 | Welfonder | |
| 2002/0020580 | A1 | 2/2002 | Mukai et al. | |
| 2004/0016519 | A1 | 1/2004 | Welfonder | |
| 2005/0087309 | A1 | 4/2005 | Nien et al. | |
| 2006/0118356 | A1 | 6/2006 | Beeson et al. | |
| 2007/0193697 | A1 | 8/2007 | Horvath | |
| 2008/0016798 | A1 | 1/2008 | Miller | |
| 2008/0035281 | A1 | 2/2008 | Kirby | |
| 2009/0229767 | A1 | 9/2009 | Mullet et al. | |
| 2011/0088317 | A1 | 4/2011 | Goldberg | |
| 2011/0100570 | A1 | 5/2011 | Licciardi Di Stefano | |
| 2012/0097346 | A1 | 4/2012 | Ng | |
| 2013/0048229 | A1 | 2/2013 | Dwarka | |
| 2013/0048231 | A1 | 2/2013 | Miller | |
| 2014/0041814 | A1 * | 2/2014 | Roberts | A47H 5/03 160/271 |
| 2014/0262084 | A1 * | 9/2014 | Fleischman | E06B 9/58 160/368.1 |
| 2015/0000849 | A1 | 1/2015 | Barnes et al. | |
| 2016/0341443 | A1 | 11/2016 | Ramos et al. | |
| 2017/0037616 | A1 * | 2/2017 | Fleischman | E06B 9/58 |

FOREIGN PATENT DOCUMENTS

| | | | |
|---|---|---|---|
| EP | 2343418 | A1 | 7/2011 |
| EP | 2392747 | A2 | 12/2011 |
| EP | 2489811 | A1 | 8/2012 |
| EP | 3000958 | A1 | 3/2016 |
| WO | WO 2014/145333 | | 9/2014 |
| WO | WO 2015/176047 | | 11/2015 |
| WO | WO 2017/139411 | A1 | 8/2017 |

OTHER PUBLICATIONS

Written Opinion of the International Searching Authority, PCT/US2014/030073, Jacob Fleischman, pp. 5, dated Aug. 11, 2014.
AHT-Field Measure-Roll-Down, Advanced Hurricane Technology, undated.
FlexShadeXDFact Sheet, Draper Inc., Spiceland, IN, 2011.
RS-30 Motorized System Exploded View, BTX Window Automation, Dallas, TX, p. 1, Apr. 11, 2006.
RS-10 Fascia System Exploded View, BTX Window Automation, Dallas TX, p. 1, Mar. 28, 2000.
Section 7, Motors & Accessories, Somfy Motors, Pearland, TX, pp. 11, undated.
Somfy Motor Catalog, Somfy Systems, Inc., pp. 78, Dec. 2003.
Office Action dated Jun. 25, 2015, U.S. Appl. No. 13/844,6411, filed Mar. 15, 2013.
Office Action dated dated Nov. 16, 2015, U.S. Appl. No. 13/844,611, filed Mar. 15, 2013.
International Search Report, PCT/US2015/031258, Jacob Fleischman et al., pp. 1, dated Sep. 16, 2015.
Written Opinion of the International Searching Authority, PCT/US2015/031258, Jacob Fleischman et al., pp. 4, dated Sep. 16, 2015.
"Model Reinforced Barrier B-10R" Sound Seal—Industrial Noise Control Products. [cited in International Search Report, PCT/US2015/031258, dated Sep. 16, 2016].
"Sound Absorption" Accoustical Surfaces, Inc. [cited in International Search Report, PCT/US2015/031258, dated Sep. 16, 2016].
"GBT buckling analysis of thin-walled steel frames: A state-of-the-art report," Camotim, D. et al., Thin-Walled Structures, vol. 48, Issue 10-11,Oct. 2010, pp. 726-743 (Abstract).
Architectural Specifications and Drawings, Titan Screen, 900 Industrial Blvd. Naples Florida, 34104; Jul. 24, 2012, pp. 14, [retrieved from Internet Aug. 5, 2014].
Installation Intructions, Titan Screen, 900 Industrial Blvd. Naples Florida, 34104; Jan. 7, 2014, pp. 14, [retrieved from Internet Aug. 5, 2014].
User Guide & Warranty Statement, Titan Screen, 900 Industrial Blvd. Naples Florida, 34104; Mar. 21, 2013, p. 1, [retrieved from Internet Aug. 5, 2014].
SkyFold—Acoustic leader in vertical retractable walls. 325 Lee Avenue, Montreal, Quebec, Canada H9X 3S3; www.skyfold.com, [retrieved from Internet Aug. 5, 2014].
Office Action dated Sep. 14, 2016, U.S. Appl. No. 14/776,737, filed Sep. 14, 2015.

* cited by examiner

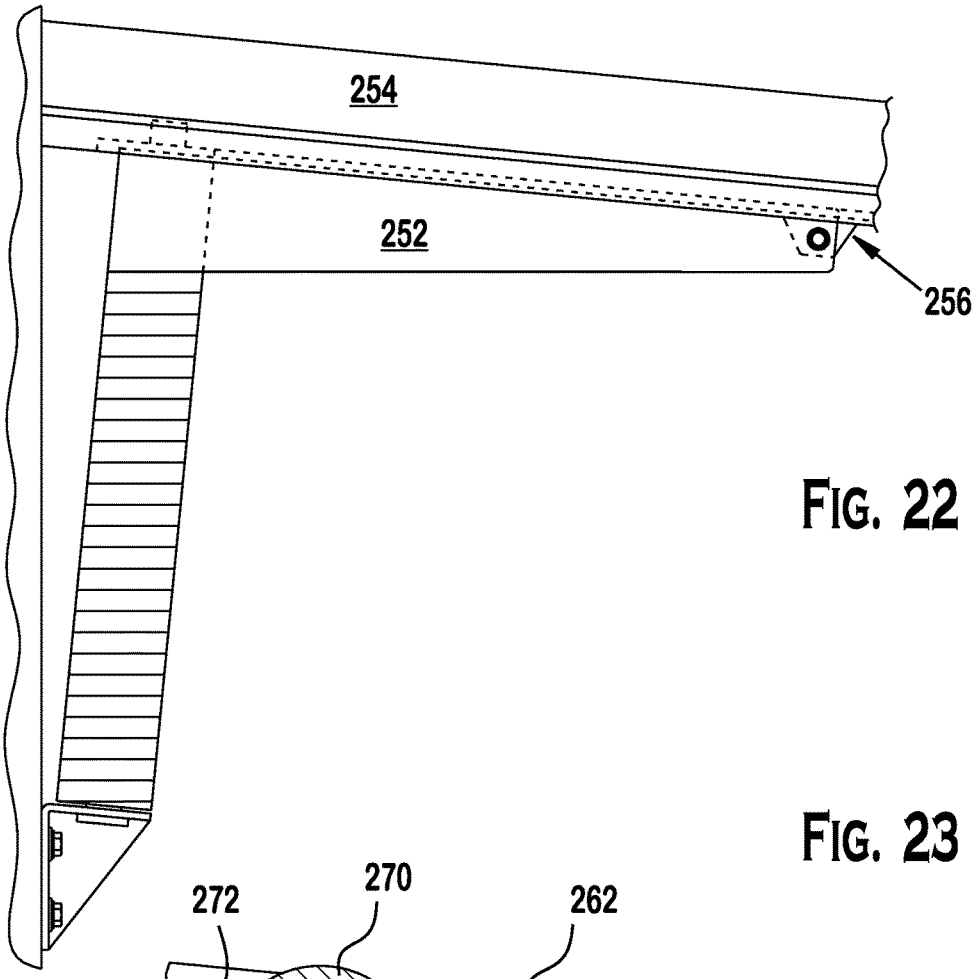
FIG. 22
FIG. 23
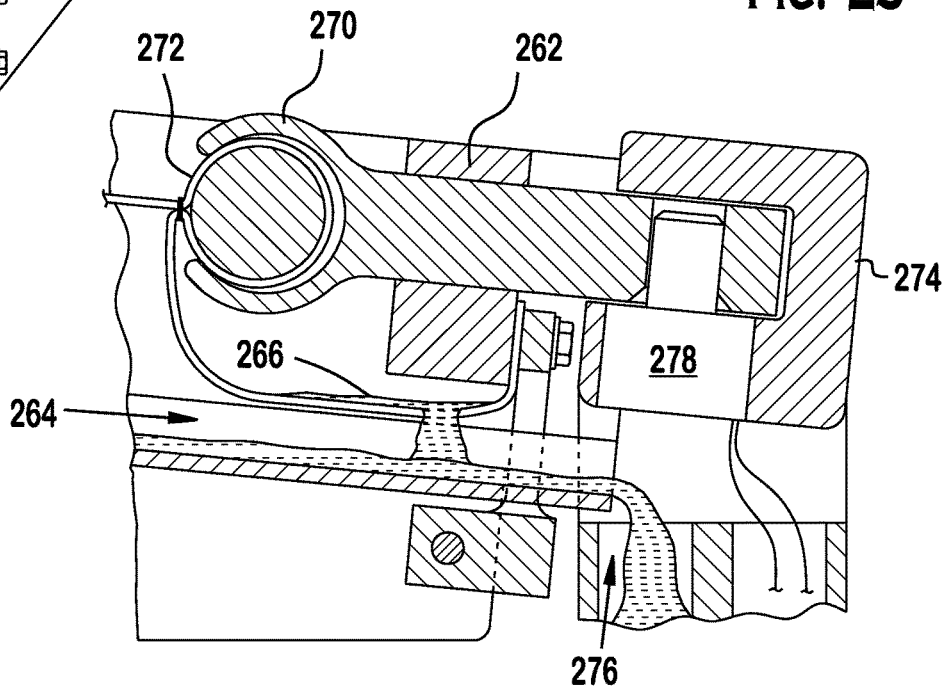

ROLL-UP WALL AND ACOUSTIC BARRIER SYSTEM

CROSS REFERENCE TO RELATED APPLICATIONS

This application claims priority to United States provisional patent application entitled "Retractable Wall System and Roll-Up Acoustic Barrier" with Ser. No. 61/993,975 filed May 15, 2014, which is incorporated by reference herein in its entirety.

FIELD OF THE INVENTION

The present invention generally relates to a retractable wall system. More particularly, this invention relates to a retractable wall system which may be used to divide a room or space and create an acoustic barrier.

BACKGROUND

Roller shades may be useful for blocking light and enhancing privacy for windows. Retractable walls may provide the ability to divide a room or provide shade for exterior porches. Still, a need exits for retractable wall systems that may provide sound blocking properties and allow for customized panel designs.

SUMMARY

Hence, the present invention is directed to a roll-up wall and acoustic barrier system, which may comprise a tube that includes a longitudinal axis, and a first vertical track that may include a first elongated member. The first elongated member may include a first cross-sectional profile which comprises a first channel. Further, the roll-up wall and acoustic barrier system may include a second vertical track that may include a second elongated member. The second elongated member may include a second cross-sectional profile which comprises a second channel.

A horizontal track may be disposed between the first vertical track and the second vertical track. The horizontal track may comprise a third elongated member. The third elongated member may include a third cross-sectional profile which comprises a front wall, a rear wall spaced from the front wall, a bottom wall connecting the front wall and the rear wall, a top wall adjacent the front wall, another top wall adjacent the rear wall, and an open channel disposed between the top wall and the other top wall.

The open channel may comprise a first side wall connected to the top wall, a second side wall connected to the other top wall, a first ledge extending from the first side wall toward the second side wall, and a second ledge extending from the second side wall toward the first side wall. The first and second ledges may define a slot between the first side wall and the second side wall. The third cross-sectional profile further may include a conduit disposed between the front wall and the rear wall. The conduit may be connected to the open channel via the slot. Additionally, the roll-up wall and acoustic barrier system may include a flexible membrane barrier connected to the tube which comprises a first barrier side, a second barrier side, and a third barrier side. The third barrier side may include a zipper, the first barrier side may be disposed in the first channel, the second barrier side may be disposed in the second channel, and the zipper may be disposed in the conduit of the horizontal track.

In another aspect, the first cross-sectional profile may further comprise a first front wall, a first rear wall spaced from the first front wall, a first bottom wall which connects the first front wall and the first rear wall, a first top wall adjacent the first front wall, a second top wall adjacent the first rear wall, a first interior wall connected to the first top wall, the first interior wall being disposed parallel to the first front wall, and a second interior wall connected to the second top wall. The second interior wall may be disposed parallel to the first rear wall, and the first channel may be situated between the first and second top walls and the first and second interior walls. The first channel may extend toward the first rear wall.

In another aspect, the first front wall may comprise a first front wall length, and the first channel may comprise a first channel length, the first channel length may be substantially equal to or greater than one half the first front wall length. Moreover, the first bottom wall may comprise a first bottom wall length, the first channel may comprise a first channel width, and the first channel width may be substantially equal to or less than one third the first bottom wall length.

In another aspect, first side wall is separable from the first ledge and the front wall is separable from the bottom wall.

In another aspect, the flexible membrane barrier may comprise a sound dampening material. The sound dampening material may be mass loaded vinyl. The flexible membrane barrier may comprise a two pound per square foot sheet of flexible mass loaded vinyl. The mass loaded vinyl may be B-10 R noise barrier.

In another aspect, the sound dampening material may comprise an engineered sound abatement material. The engineered sound abatement material may transform sound energy into inaudible friction energy. The engineered sound abatement material may comprise a viscoelastic polymer material.

In another aspect, the flexible membrane barrier may possess a Sound Transmission Class rating of at least 26 in accordance with ASTM E413.

In another aspect, the roll-up wall and acoustic barrier system may comprise first and second operable configurations such that in the first operable configuration a first amount of the flexible membrane barrier is wound around the tube and the horizontal track is in a raised position, and such that in the second operable configuration the horizontal track is in a lowered position. The measured insertion loss of pink noise across the roll-up wall and acoustic barrier system in the second operable configuration may be approximately 20 dBA.

In another aspect, the roll-up wall and acoustic barrier system may comprise another flexible membrane barrier which is spaced from the flexible membrane barrier. The roll-up wall and acoustic barrier system further may comprise a third operable configuration such that in the third operable configuration the measured insertion loss of pink noise across the roll-up wall and acoustic barrier system may be approximately 25 dBA.

In another aspect, the roll-up wall and acoustic barrier system may further comprise a center track assembly, the flexible membrane barrier may comprise an upper segment and a lower segment, and the center track assembly may securely connect the upper segment to the lower segment.

In another aspect, the roll-up wall and acoustic barrier system may further comprise an entry guide piece disposed between the tube and the first elongated member such that the entry guide piece comprises a guide surface which facilitates travel of the flexible membrane barrier between the tube and the first channel.

In yet another aspect, the roll-up wall and acoustic barrier system further may comprise a skeleton which comprises a U-shape, and a center support positioned inside the U-shape. The first vertical track may be secured to the center support. The roll-up wall and acoustic barrier system may further comprise an access cover connected to the center support. The skeleton may comprises sound blocking material, and the access cover may comprise sound blocking material and sound absorbing material.

In yet another aspect, the tube may be a thin wall hollow member. The tube may include a cross-sectional profile that comprises a substantially circular outer wall.

In yet another aspect, the present invention is directed to a track for a roll-up wall and acoustic barrier system. The track for a roll-up wall and acoustic barrier system may include an elongated member having a first cross-sectional profile.

The first cross-sectional profile may comprise a front wall which comprises a first length, a rear wall spaced from the front wall, and a bottom wall which connects the front wall and the rear wall. The bottom wall may comprise a second length. The first cross-sectional profile further may comprise a first top wall adjacent the front wall, a second top wall adjacent the rear wall, a first interior side wall disposed parallel to the front wall that is connected to the first top wall, and a second interior side wall disposed parallel to the rear wall that is connected to the second top wall. The first and second top walls and the first and second interior side walls may form a channel that extends toward the rear wall such that the channel comprises a channel length and a channel width. The channel length may be substantially equal to or greater than one half the first length. The channel width may be substantially equal to or less than one third the second length.

DESCRIPTION OF THE DRAWINGS

In the accompanying drawings, which form a part of the specification and are to be read in conjunction therewith and in which like reference numerals (or designations) are used to indicate like parts in the various views:

FIG. 22 is a side view of the retractable awning system of FIG. 20;

FIG. 23 is a sectional view of the front partition of the retractable awning system of FIG. 20;

FIG. 114 is a schematic diagram of acoustic testing equipment in the commercial office space of FIG. 113 arrayed for measuring insertion loss across the roll up acoustic barrier 608';

FIG. 115 is a graph showing measured insertion loss across the roll up acoustic barrier 608' of FIG. 114.

DESCRIPTION

Figure 1:
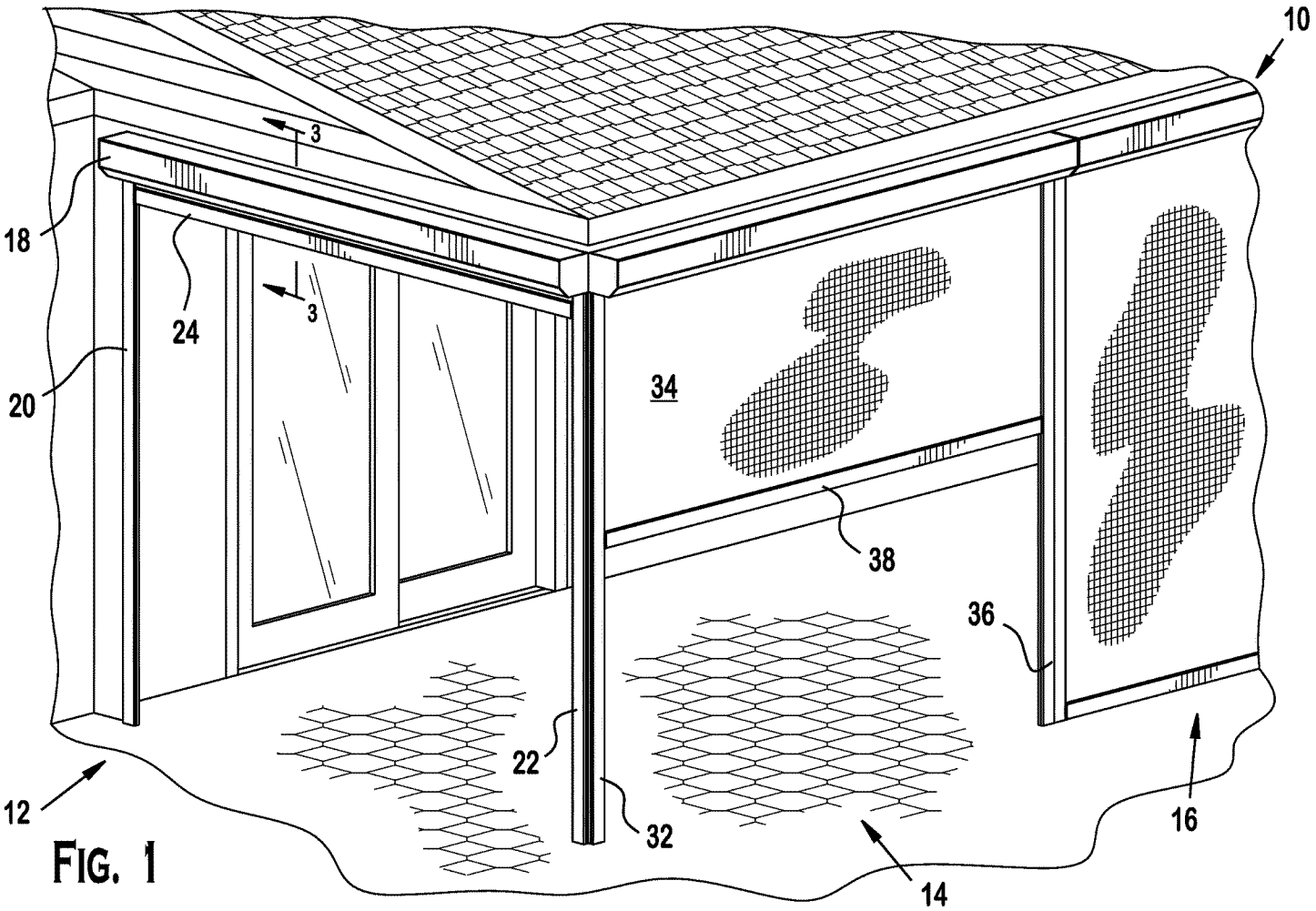
FIG. 1 is a perspective view of a covered patio enclosed on two sides by an embodiment of the retractable wall system of the present invention.

FIG. 1 is a perspective view of a patio enclosure 10 formed by three retractable wall systems 12, 14, 16. The first retractable wall system 12 may be disposed perpendicular to the house and may extend from the side of the house to a first corner of the patio. The second retractable wall system 14 may be disposed perpendicular to the first retractable wall system 12 and may be parallel to the sliding door of the house. The third retractable wall system 16 may be next to the second retractable wall system 14. The first retractable wall system 12 may be disposed in an opening under the roof structure of the house. The first retractable wall system 12 may include a head rail 18, a left side track 20, right side track 22, and a horizontal track 24 disposed between the left side track 20 and the right side track 22. In a preferred embodiment, the left side track 20, the right side track 22 and the horizontal track 24 have the same cross-sectional profile.

Figure 2:
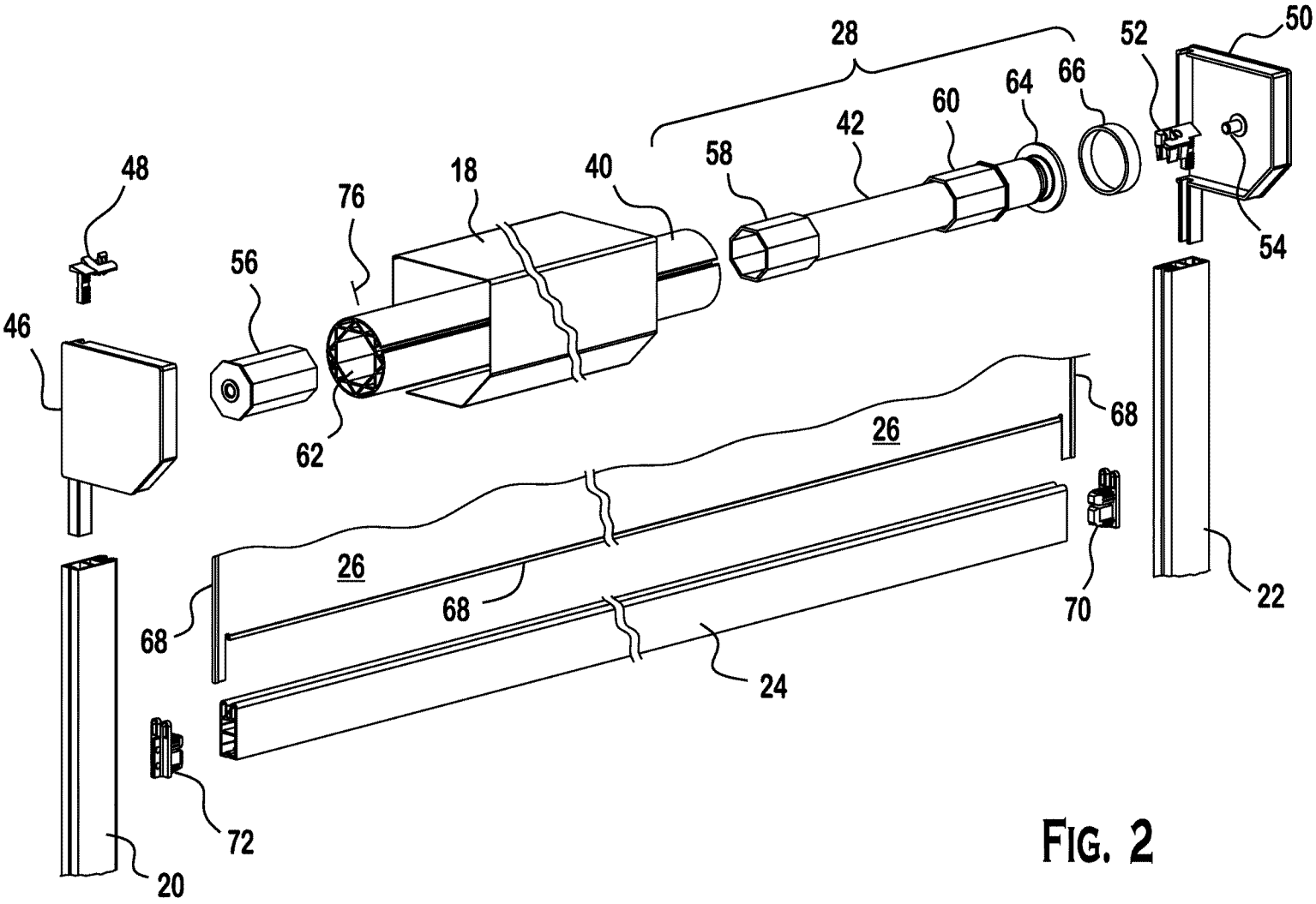
FIG. 2 is an exploded view of an exemplary embodiment of the retractable wall system of the present invention.
Figure 3:
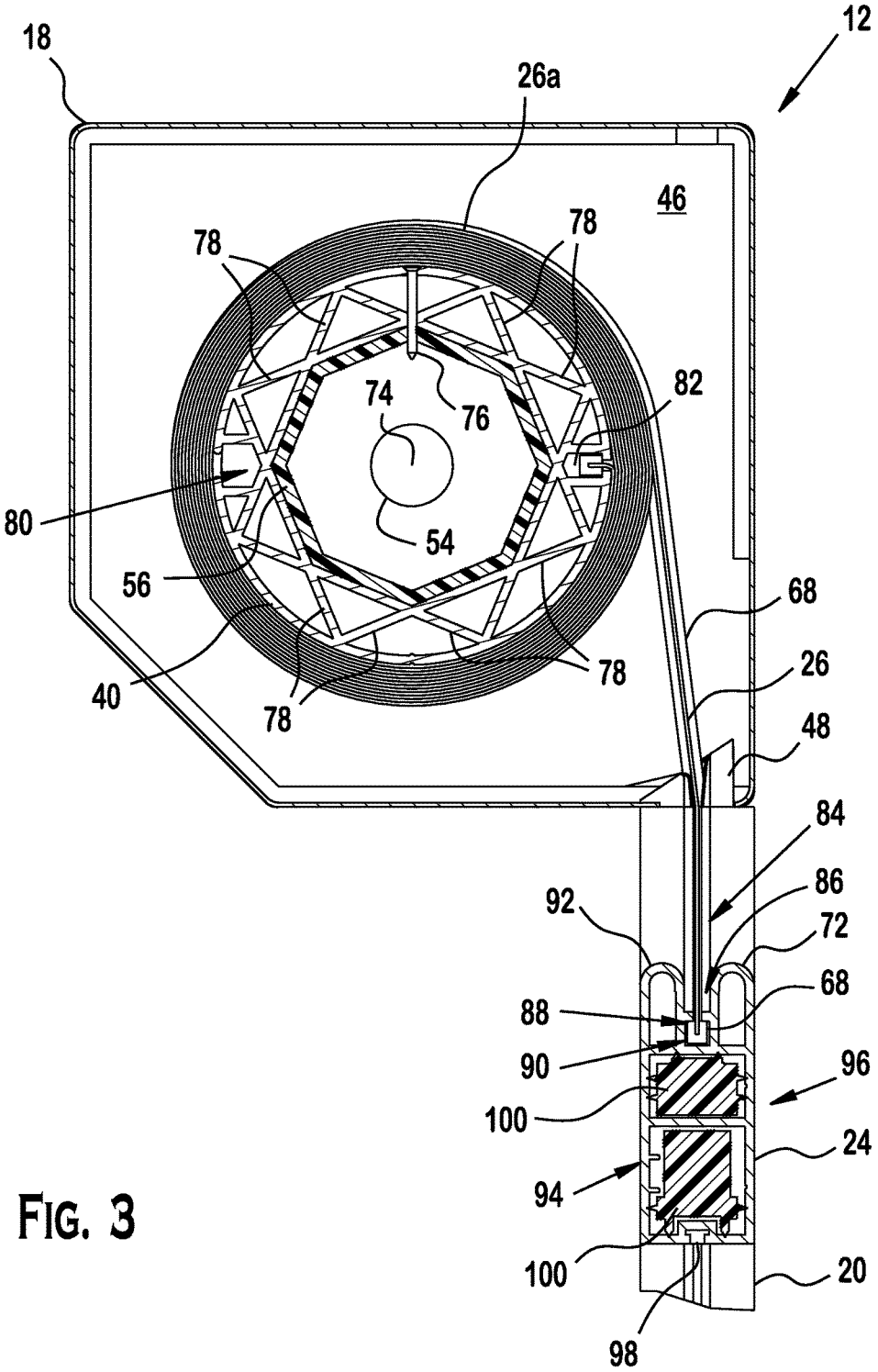
FIG. 3 is a partial sectional view of the first retractable wall system along line 3-3 of FIG. 1.

In FIG. 1, the first retractable wall system 12 is in a raised configuration. In the raised configuration the horizontal track 24 abuts the head rail 18. Referring to FIG. 3, the head rail 18 may contain a roll of flexible barrier material **26*a*, as well as a mechanism (not shown) 28 for raising and lowering the flexible barrier membrane 26. As shown in FIG. 2, the mechanism 28 may include an electrical motor 42**, which may be controlled by a wireless remote or switch. Alternatively, the mechanism may include a hand crank or a chain drive with a looped strap for manually raising and lowering the flexible barrier membrane.

Referring to FIG. 1, the left side track 20 of the first retractable wall system 12 may be secured to the building. By contrast, the right side track 22 of the first retractable wall system 12 may be connected to the left side track 32 of the second retractable wall system 14 at a 90 degree angle to form a corner assembly. The second retractable wall system 12 is shown in a partially lowered configuration. A flexible barrier material 34 may be disposed between the left side track 32, right side track 36 and horizontal track 38 of the second retractable wall system 14. The flexible barrier material 34 may extend from inside each of these three tracks 32, 36, 38 to create a wall.

As shown in FIG. 3, the flexible barrier material 26 may be disposed on a tube 40 in the head rail. The flexible barrier material 26 may be rolled onto the tube 40 and unwound from the tube as the horizontal track 24 is lowered. Referring to FIG. 1, the third retractable wall system 16 may be disposed parallel to the second retractable wall system 14. The right side track of the second retractable wall system 14 and the left side track of the third retractable wall system 16 may be secured together or connected to a secondary structural member (e.g., a post or stud). The third retractable wall system 16 is shown in the lowered configuration.

FIG. 2 shows an exploded view of the first retractable wall system 12. The retractable wall system 12 may include a left side track 20, a right side track 22, and a horizontal track (or weight bar) 24 extending between the left side track and the right side track. Additionally, the retractable wall system 12 may include a left side end-cap 46 which is secured into the left side track 20 and a left side feeder-clip 48 that is positioned in the left side end-cap 46. Similarly, the retractable wall system 12 includes a right side end-cap which may be secured into the right side track 22, as well as a right side feeder-clip 52 that may be disposed in the right side end-cap 50. When the left side end-cap 46 is fully seated in the left side track 20 the left side feeder-clip 48 interlocks with features of the left side track 20 cross sectional profile to further secure the left end-cap to the left side track. Similarly, when the right side end-cap 50 is fully seated in the right side track 22, the right side feeder-clip 52 interlocks with features of the right side track 22 cross-sectional profile to further secure the right end-cap to the right side track. Each end-cap 46, 50 further may include a cylindrical stub 54 in the end-cap wall. The cylindrical stub 54 may receive the tube assembly and serve as axis of rotation for the tube 40.

The roller tube assembly may include an idler 56, a tube 40 having a central axis, and a mechanism 28 for rotating the tube 40 about the central axis of the tube. In a preferred embodiment, the mechanism 28 may include a motor 42 that is partially installed with the tube 40. The motor 42 may include a built in radio control receiver that provides a user the capability to operate the motor with a remote control. For example, the motor may be a Somfy RTS motor.

In FIG. 2, the mechanism 28 for rotating the tube includes a motor 42 with a remote control. The motor, which may be slidably received within the tube 40, may include a drive 58 and a crown 60. The drive 58 and crown 60 may be external features of the motor which interlock with an interior surface 62 of the tube so as to provide a mechanism for transferring rotational movement from the motor or the tube. The motor 42 further may include a drive wheel 64 at one end. The drive wheel 64 may be configured and dimensioned to be fixedly received within a motor bracket 66. The motor bracket 66 may be secured to one end-cap 50. The tube assembly 28 further may include a sheet of flexible material 26. The sheet of flexible material 26 may include a zipper border 68 on at least three sides. The sheet of flexible material 26 may be cut to be received in a pair of traveling guide pieces 70, 72 that are adapted to be received in the horizontal track 24.

FIG. 3 shows a cross-section of the retractable wall system 12 taken perpendicular to the central axis 74 of the tube 40. The tube 40 may be mounted on the cylindrical stub 54 of the left end-cap 46. The tube 40 may be secured to the idler 54 with a fastener. Inside the tube 40 are interior wall segments 78, which form a mating structure for the motor drive and crown. The interior wall segments 78 may be arranged to provide structural rigidity to the tube. In particular, the interior wall segments may span the internal space of the tube 40 so as to provide a three dimensional truss or space frame. Additionally, the tube may include a fabric pocket receiving channel 80 and a fabric zipper receiving channel 82, which may be used to connect the flexible barrier material 26 to the tube 40. Wrapped around the tube 40 is a sheet of flexible barrier material 26*a*, which may include a heat bonded zipper edge 68 on the left side and the bottom side of the sheet.

The end-cap 46 may be situated within the left side track 20. The left side of the flexible barrier material sheet 26 may be fed through the left side feeder-clip 48 into a rigid receiving channel 84*a* in the left side track 20. The bottom side of the flexible barrier material 26 sheet may be received within the horizontal track 24. The cross-sectional profile of the left side track 20 and horizontal track 24 may be the same. Accordingly, the flexible barrier material 26 may be secured to the horizontal track 24 through a rigid receiving channel 86 in the horizontal track 24. A slot 88 may connect the rigid receiving channel 86 to an internal anchoring cavity 90 that is configured and dimensioned to receive the bonded zipper edge 68 of the sheet. The rigid receiving channel 86 may be disposed between a pair of arcuate walls 92. The internal anchoring cavity 90 may be disposed adjacent to the rigid receiving channel 86.

The horizontal track 24 further may include a primary accessory receiving channel 94, a secondary accessory receiving channel 96, and a tertiary accessory receiving channel 98. Weights, for example, steel bars 100 may be placed with the primary accessory receiving channel 94 or the secondary accessory receiving channel 96 of the horizontal track 24 to facilitate lowering of the flexible material barrier 26. In another example, sound dampening material may be inserted in these spaces to increase the sound insulating properties of the retractable wall system. An elastomeric end cap, flexible seal, or brush may be inserted in the tertiary accessory receiving channel 98 to provide an improved connection with the ground surface for purposes such as, without limitation, increasing wall stability, slip resistance, draft prevention, or sound dampening.

Figure 4:
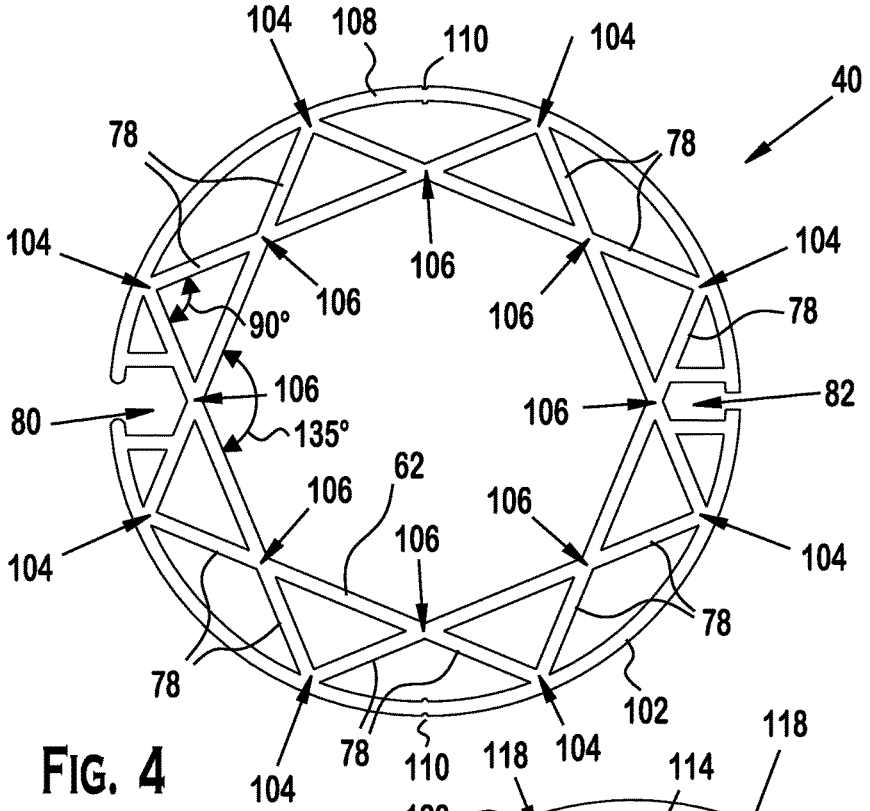
FIG. 4 is a sectional view of the tube of FIG. 3.

FIG. 4 shows a cross section of a preferred embodiment of the tube 40. Generally, the tube 40 may be a thin-wall hollow member. The outer surface 102 of the tube may be substantially circular, and the interior space of the tube may include a series of interior wall segments (or structural members) 78, which may reinforce the tube against bending moments that may be generated from the weight of flexible barrier material on the tube when the tube is positioned between the end caps. Each structural member 78 may form a cord within the tube 40. Each structural member 78 may connect to an adjacent structural member 78 to form an external node 104, which is located about the circumference of the tube. Additionally, each structural member 78 may intersect two other structural members 78 to form a pair of internal nodes 106. The intersection of a pair of structural members 78 at an external node 104 forms a right angle. The intersection of a pair of structural members 78 at an internal node forms an obtuse angle of approximately 135 degrees. The space between an internal node 106 and outer wall 108 of the tube may be used to house the pocket receiving channel 80 and the zipper receiving channel 82. Additionally, a fastener alignment groove 110 may be disposed above one or more internal nodes on the outer surface 102 of the tube. The interior surface 62 of the tube may form an eight sided shape for receiving a motor (with a mating drive and crown) or an octagonal tube for non-motorized applications (e.g., 40 mm, 60 mm, or 80 mm tubes).

Figure 5:
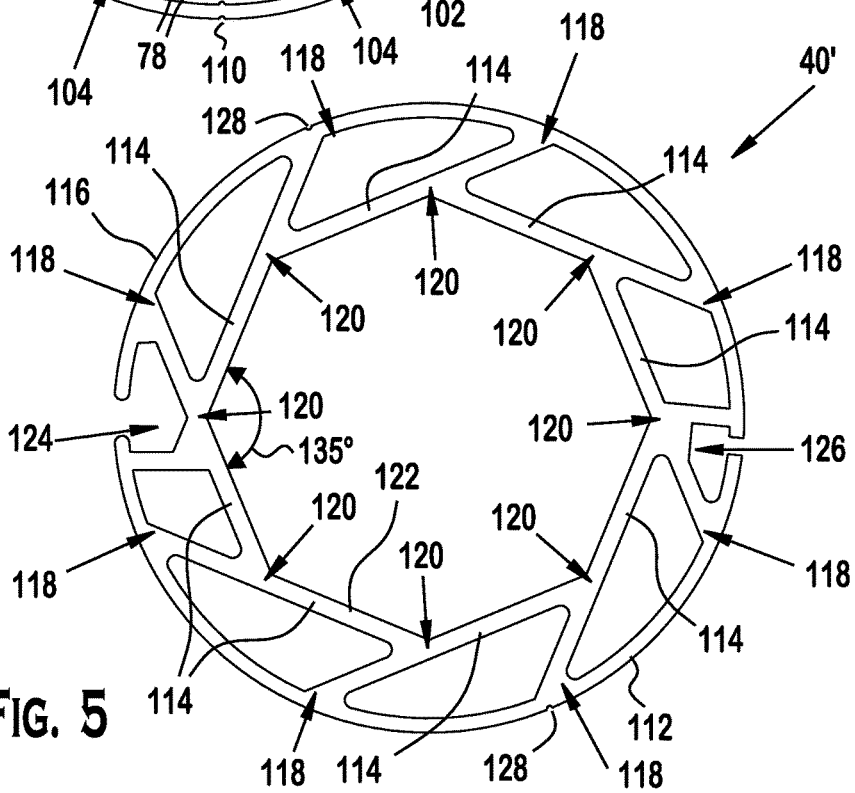
FIG. 5 is a sectional view of another embodiment of the tube of FIG. 3.

FIG. 5 shows the cross-section of another embodiment of the tube 40'. In this embodiment, the outer surface 112 of the tube 40' is substantially circular and the interior space includes a series of structural members 114 that reinforce the tube 40' from bending moments as in the previous embodiment. In contrast to the tube of FIG. 4, however, each structural member 114 connects to the outer wall 116 of the tube at one location (or external node) 118. Additionally, the opposite end of each structural member 114 may connect to an adjacent structural member 114 to form an internal node 120. The interior surface 122 of the tube 40' may form an eight sided shape for receiving a motor (with a mating drive and crown) or an octagonal tube for non-motorized applications (e.g., 40 mm, 60 mm, or 80 mm tubes). In this embodiment, the tube 40' also may include a pocket receiving channel 124, a zipper receiving channel 126, and two fastener alignment grooves 128.

Referring to FIGS. 4 and 5, the tube 40, 40' may have an outer diameter of approximately 1.0 inches to approximately 6.0 inches, but other dimensions may be used where appropriate for the application. In an exemplary embodiment, the tube 40, 40' may have an outer diameter of approximately 3.5 inches and an interior surface 62, 122 which is configured and dimensioned to receive a 60 mm octagonal tube. Additionally, the tubes 40, 40' may range from approximately one foot long to approximately 30 feet in length. The tube 40, 40' may be formed from aluminum or an aluminum alloy (e.g., 6061 aluminum alloy (International Alloy Designation System)), however, other suitable metals, alloys or materials may be used to form the tube provided the material has sufficient strength. For example, the tube 40, 40' may be formed from a carbon graphite reinforced polymer material. Preferably, the tube 40, 40' may be formed by materials having a high strength to weight ratio and the ability to be manufactured using extrusion technologies.

Referring to FIG. 4, the flexible barrier material 26 may be secured to the tube 40 by a pocket of flexible barrier material 130 and rod 132 inserted within the pocket receiving channel 80. In another alternative, the flexible barrier material 26 may be attached to a zipper 68 that is inserted into the zipper receiving channel 82. Generally, the flexible barrier material 26 may range from approximately 1/32 of an inch in thickness to approximately ½ inch in thickness. The flexible barrier material 26 may be formed, without limitation, from natural fibers, leather, PVC, polyester, or acrylic materials. Preferably, the flexible barrier material 26 may range from approximately 7 ounces to 60 ounces in weight. In one example, the flexible barrier material 26 may be constructed from a 20 ounce vinyl fabric. In another example, the flexible barrier material 26 may be constructed from a vinyl fabric that is capable of receiving a print design. In another example, the flexible barrier material 26 may be constructed from a screen, a transparent material or a natural fabric.

The flexible barrier material 26 may be a single layer of material or a multilayer material formed from two or more layers of material. For example, the flexible barrier material 26 may be formed from three layers: a middle layer having enhanced sound dampening properties (e.g., mass loaded vinyl, Acoustiblok®) and two outer fabric layers (e.g., cotton, polyester, rayon, vinyl, wall paper, or wall covering material) to create an acoustic barrier. In another example, the flexible barrier material 26 may be formed from clear plastic sound blocking material. Preferably, a flexible barrier material with enhanced sound dampening properties may have a STC (Sound Transmission Class) rating of 26 or greater.

Figure 6:
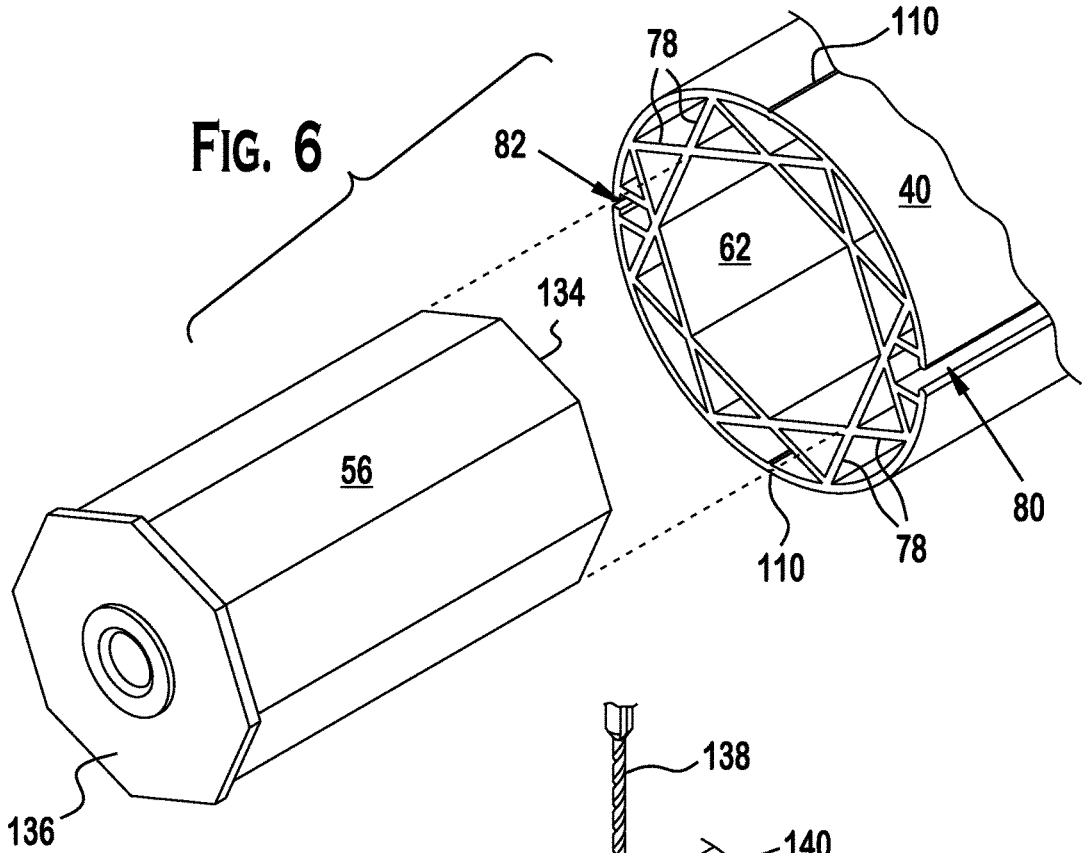
FIG. 6 is a perspective view of an exploded view of an idler and tube of FIG. 3.
Figure 7:
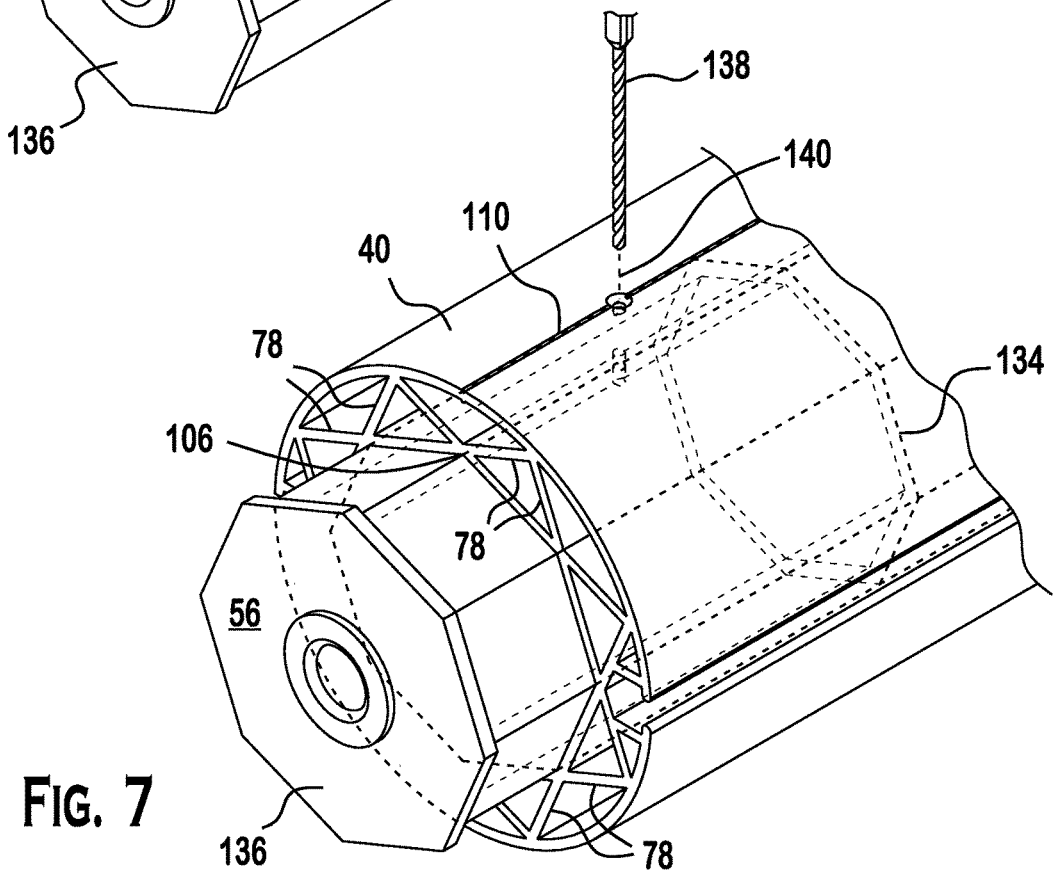
FIG. 7 is a perspective view of the idler and tube of FIG. 6 being assembled.

FIG. 6 shows an exploded view of the idler 56 and the tube 40 of FIG. 4. One end 134 of the idler 56 may be inserted into the tube 40. The opposite end 136 of the idler 56 may be mounted on the end-cap cylindrical stub 54 (not shown) to form an axis of rotation. The tube 40 may include one or more fastener alignment grooves 110. As shown in FIG. 7, a drill (or fastener) 138 may be placed in a fastener alignment groove 110 to create a fastener alignment path 140 for securing the idler 56 to the tube 40. The fastener alignment groove 110 may be located above an internal node 106 of the tube. Placement of a fastener alignment groove 110 above an internal node 106 provides a mechanism for promoting a repeatable, quick, and straightforward method of securing the idler 56 and the tube 40 with a fastener 138. More particularly, the fastener path 140 connects the fastener alignment groove 110 and the internal node 106 of the tube. A fastener that is aligned in this manner may be expected to penetrate the tube 40 beneath the fastener alignment groove 110 and be guided by adjacent internal structural members 78 to a position above the internal node 106. This fastener path may provide a secure connection because the fastener may be driven perpendicular to the outer surface of the tube wall and through the internal node 106 before advancing into and securing the idler 56.

Figure 8:
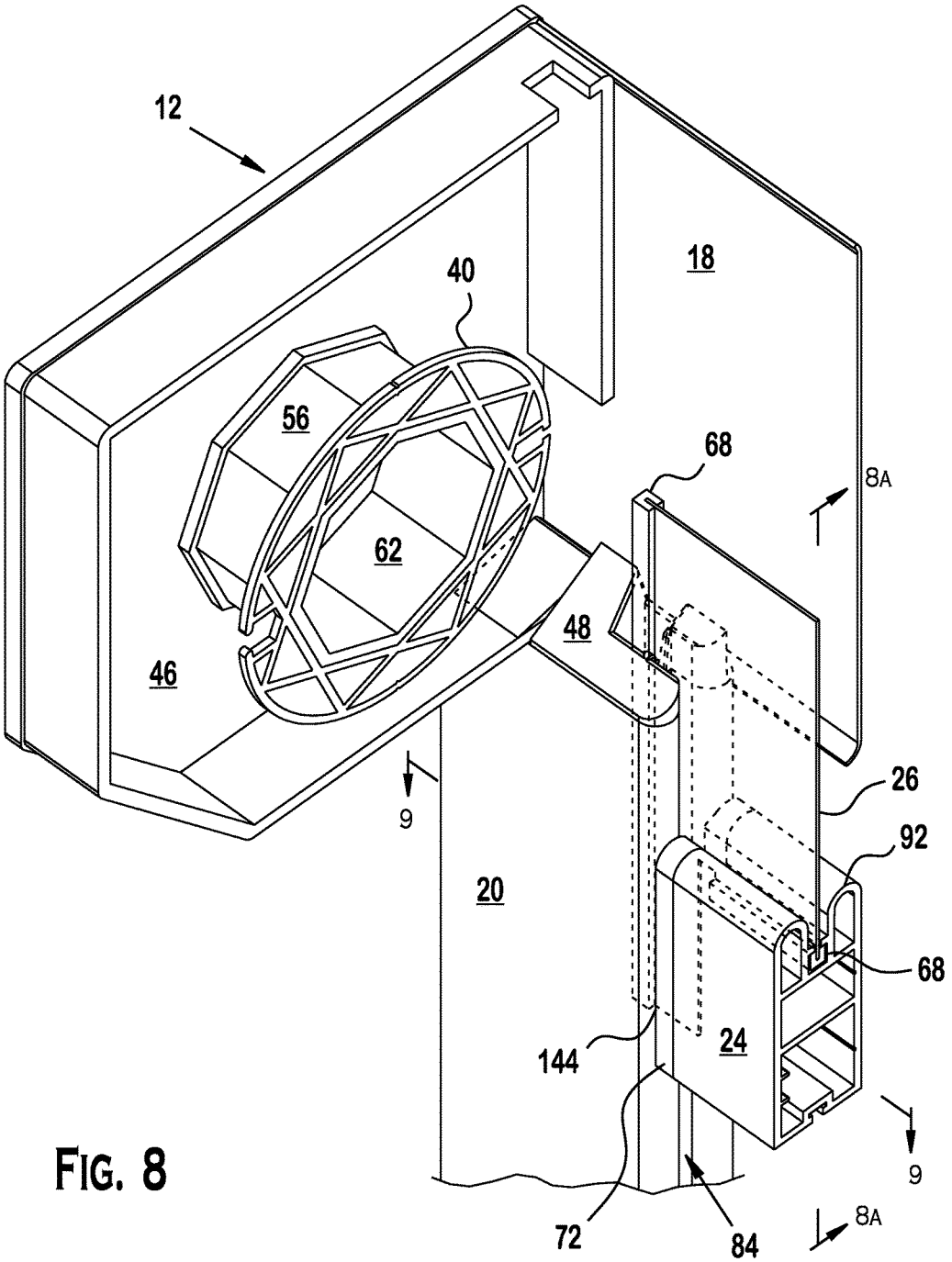
FIG. 8 is a partial sectional view of the tube, horizontal track, and flexible barrier of FIG. 1.
Figure 8A:
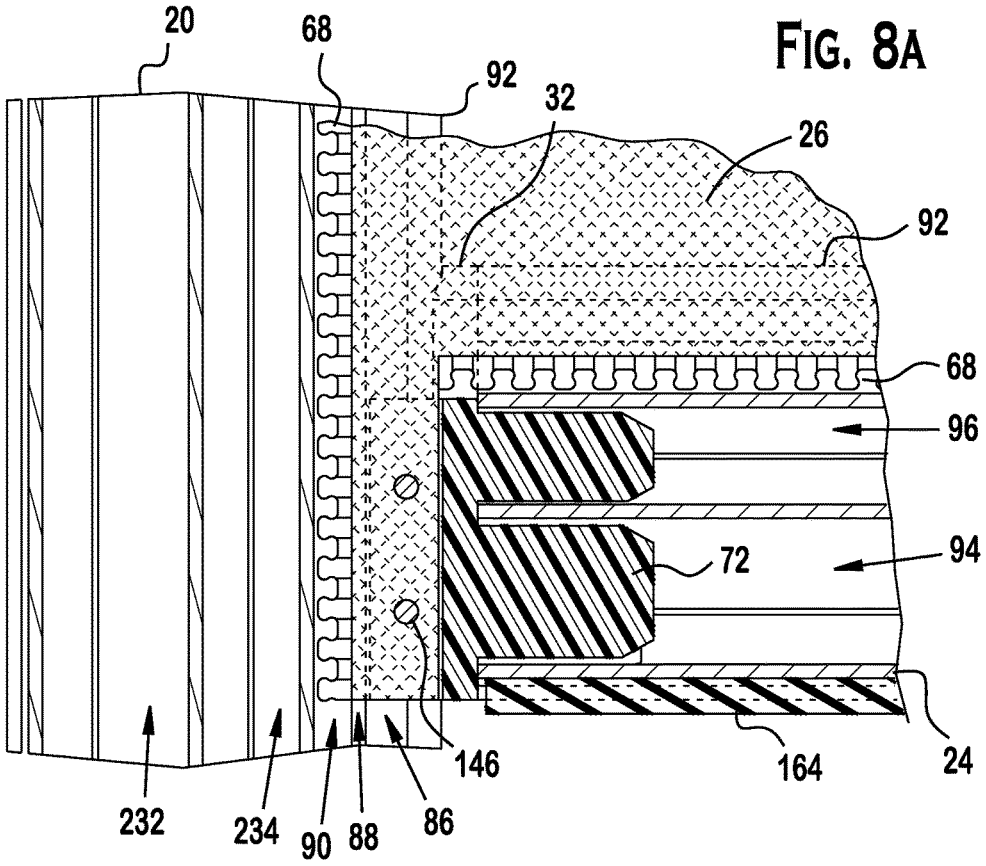
FIG. 8*a* is a partial sectional view of FIG. 8.

FIG. 8 shows the left side of the flexible barrier member 26 disposed in the left side feeder-clip 48 and left side track 20 of the retractable wall system 12. Also, the bottom of the flexible membrane barrier 26 is shown locked into the horizontal track 24. As shown in FIG. 8A, the left side of the flexible material barrier is fully seated within the traveling guide pin 72. The full length square cut double pin construction 142 provides rigid reinforcement of the flexible barrier material 26 at a leading edge 144 of the sheet. As the leading edge of the sheet 144 may be subject to compressive and sheering forces as the barrier is lowered, the traveling guide pin 72 may prevent the flexible barrier material 26 from wearing, tearing, bunching or binding in the vertical track 20 when the horizontal track 24 is lowered or raised.

Figure 9:
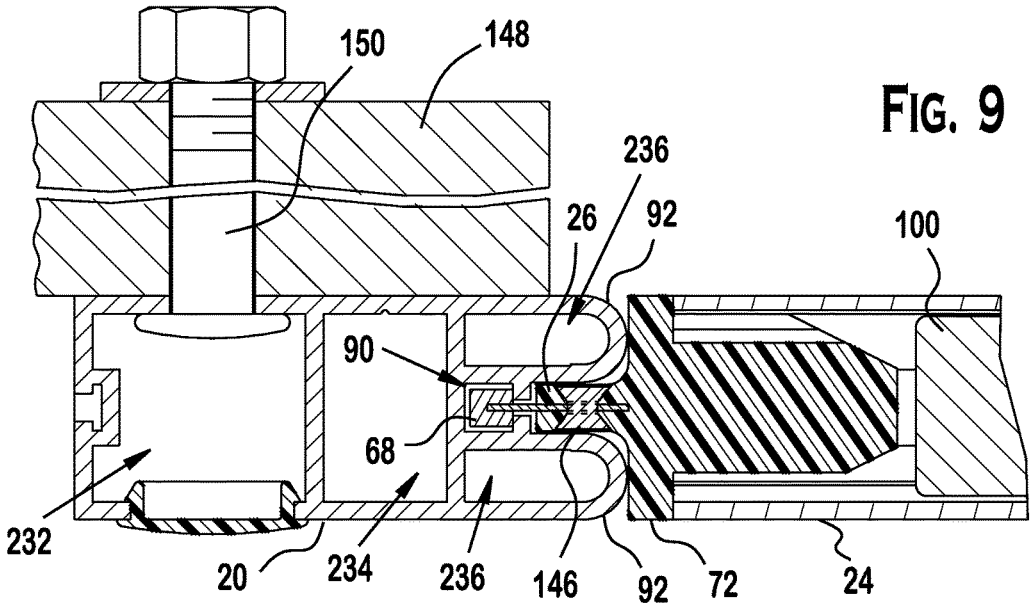
FIG. 9 is a partial cross-sectional view of the left side track and horizontal track of FIG. 1, taken perpendicular to the longitudinal axis of the left side track.

Moreover, as shown in FIG. 9, the traveling guide pin 72 may be configured and dimensioned to be slidably received within the rigid receiving channel 84 of the vertical track 20. As the fasteners, which secure the flexible membrane barrier 26 to the traveling guide pin 72 are located with the rigid receiving channel 84, they may be recessed or flush with the exterior surfaces of the traveling guide pin 72. The zipper portion 68 of the flexible membrane barrier 26, when disposed in the internal anchoring cavity 90, pulls the traveling guide pin 72 into the rigid receiving channel 84 of the vertical track 20. In this manner, the horizontal track 24 and the sides of the flexible membrane barrier 26 may be securely positioned within the left side track 20 and the right side track 22.

The reinforcement of the flexible barrier material 26 and tension across the vertical tracks 20, 22 may increase the structural integrity of retractable wall system 12, provide for more reliable operation of the system, and reduce mechanical fatigue of the zipper-material interface. Also, the generally uniform tension across the flexible membrane barrier 26 may increase the aesthetic appeal of the retractable wall system 12 by enhancing a uniform appearance of the flexible barrier material across the structure. Moreover, in outdoor applications, this construction may prevent drafts. In sound barrier applications, this construction may promote the deployment of a continuous sound dampening barrier and prevent fugitive sound emissions from passing individual barrier elements to reduce the effective sound dampening properties of the retractable wall system. Sound dampening material may be placed in the primary accessory receiving channel 232, the secondary receiving channel 234, and the arcuate receiving channels 236 as well.

The vertical track 20 of the retractable wall system may be secured to a structural member such as a stud or post. A pilot hole may be drilled and then a larger access hole placed in the track 20 to allow a fastener 150 to be advanced though the opposite side the track and into external structural framing 148 to securely attach the vertical track 20 to structural framing of an adjacent wall or post.

Figure 10:
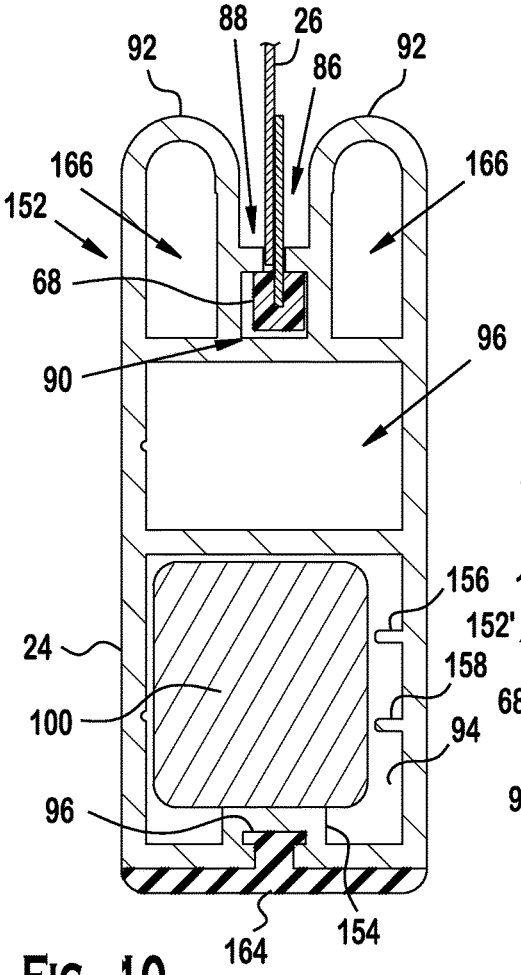
FIG. 10 is a cross-sectional view of the horizontal track of FIG. 1, taken perpendicular to its longitudinal axis.
Figure 15:
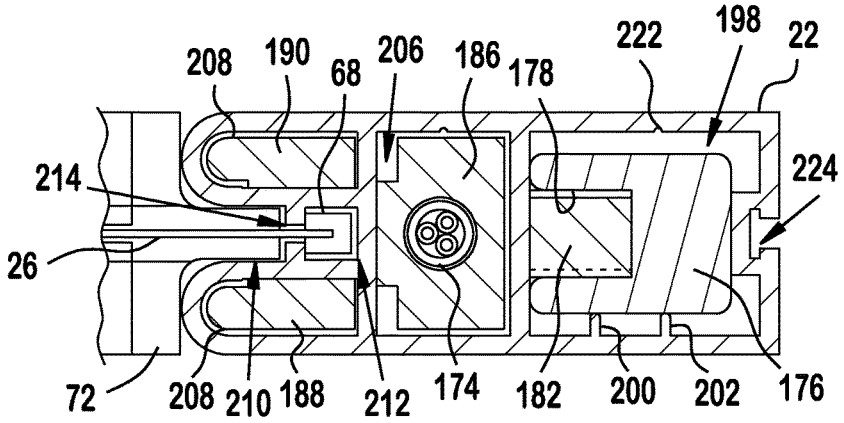
FIG. 15 is a cross-sectional view of the right side track along with a partial cross-sectional view of the horizontal track of FIG. 1.

Referring to FIGS. 10 and 15, the horizontal track 24, the left side track 20, and the right side track 22 may share a single cross-sectional profile 152. In FIG. 10, the track profile 152 is shown in use as a horizontal track 24. In this configuration, the primary accessory receiving channel 94 may accommodate a weight bar 100, which may be a ½ inch by ¾ inch steel bar. The weight bar 100 may be positioned within the primary accessory receiving channel 94 by the end-cap stem blocking member 154, the upper rail guide 156, and the lower rail guide 158.

Figure 11:
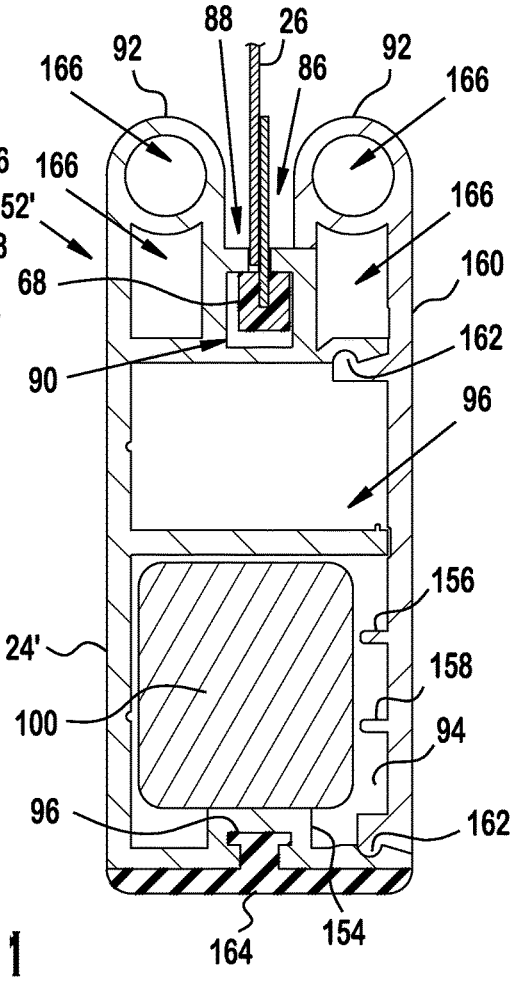
FIG. 11 is a cross-sectional view of another embodiment of the horizontal track of FIG. 1, taken perpendicular to its longitudinal axis.

In FIG. 11, the cross-sectional profile of the track 152' is substantially the same as in FIG. 10, but a front portion 160 of the track 24' is removable and forms a cover. The removable portion 160 may be secured to the track 24' with snap fittings 162. This feature allows weight bars 100 to be installed in the horizontal track 24' after the retractable wall structure 12 has been erected. This may improve constructability of the system and enhance the safety of workers because handling the horizontal track with preloaded weight bars 100 is significantly heavier than handling an empty horizontal track.

FIGS. 10 and 11 show an elastomeric cap 164 disposed in the tertiary accessory channel 96. Arcuate, upper receiving channels 166, as well as the primary and secondary accessory receiving channels 94, 96 may receive sound damping materials to enhance the sound dampening effect of the retractable wall system.

Figure 12:
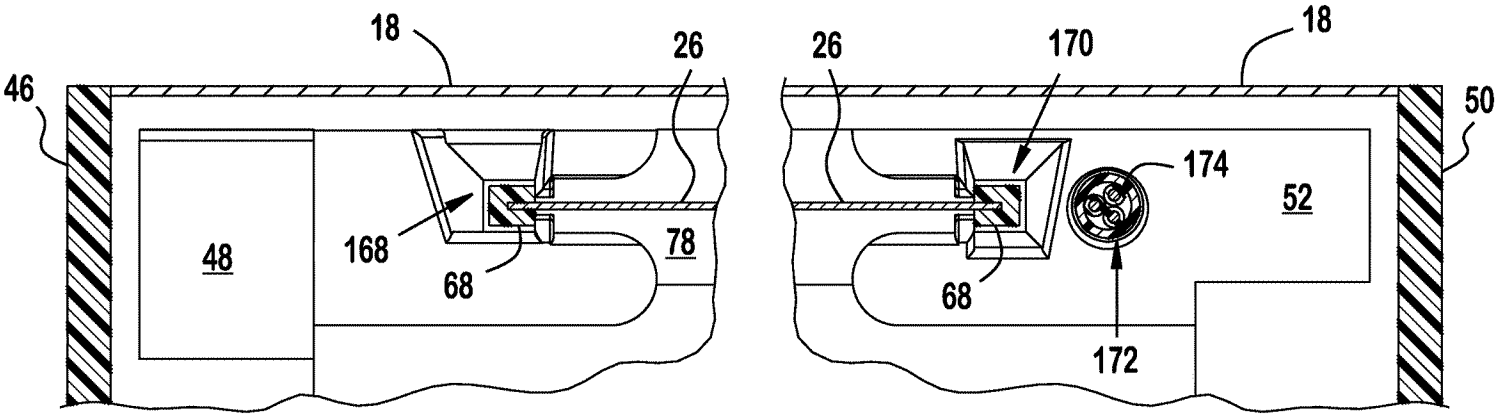
FIG. 12 is a partial sectional view of the head rail of FIG. 1, taken perpendicular to the vertical tracks and from below the tube and motor assembly.
Figure 13:
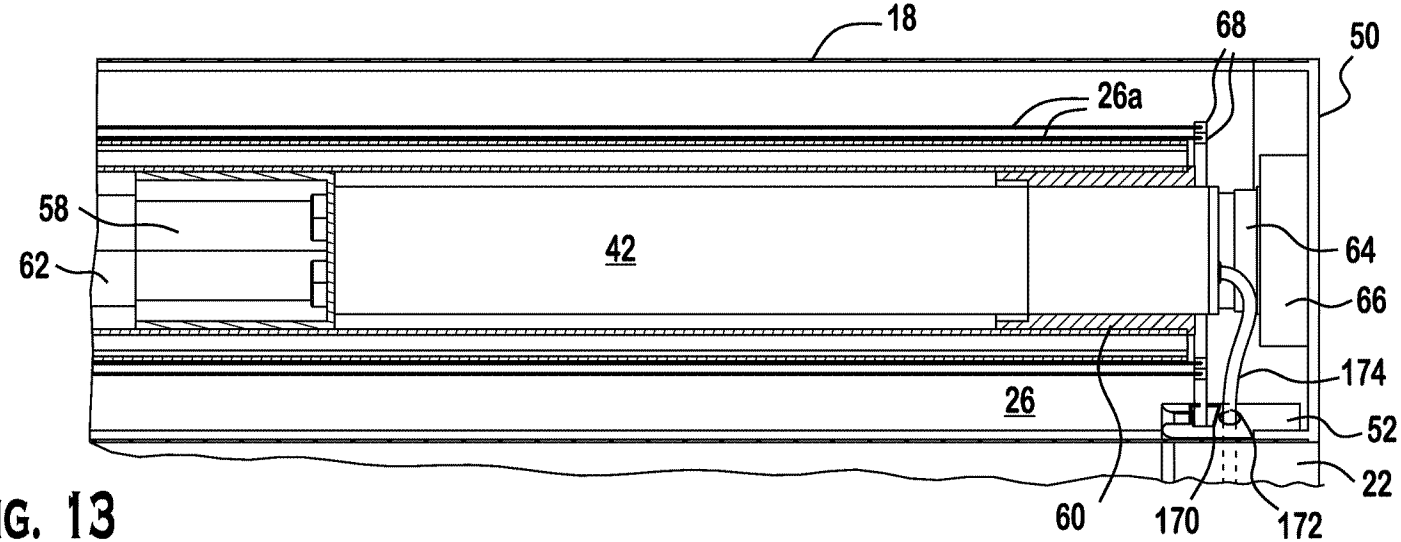
FIG. 13 is a partial sectional view of the head rail, tube and motor assembly of FIG. 1, taken parallel to the vertical tracks.

FIG. 12 shows the left feeder-clip 48 and its tapered guide hole 168. The tapered guide hole 168 receives the zippered edge 68 of the flexible barrier material 26 as it spools off the tube (not shown). Similarly, FIG. 12 and FIG. 13 show the right feeder-clip 52 and its tapered guide hole 170, which receives the zippered edge 68 of the other side of the flexible barrier material 26. The right feeder clip 52 may further include a circular passage 172 for receiving a power cord 174 from the motor 42.

Figure 14:
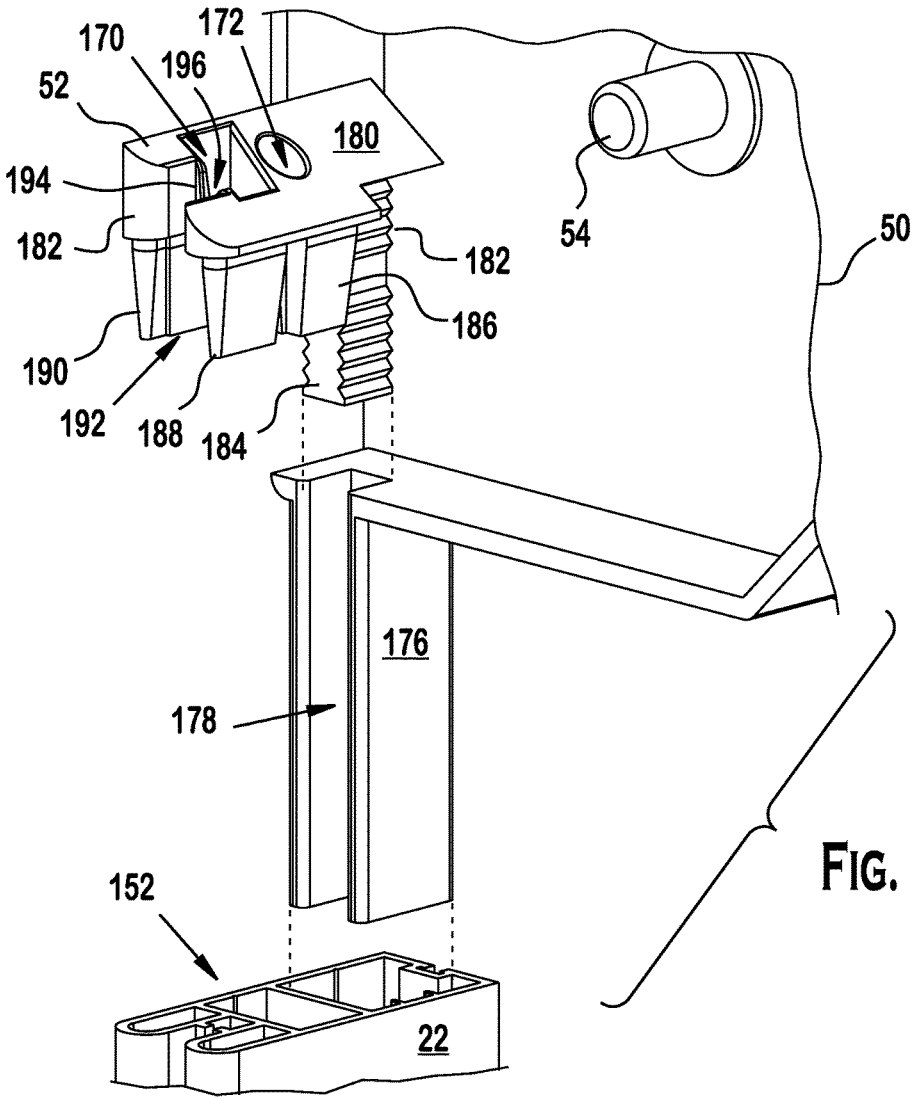
FIG. 14 is an exploded view of the right side end-cap assembly of the retractable wall system of FIG. 1.

Referring to FIG. 14, the right end-cap 50 may include a stem 176 having a rectangular channel 178. The right side feeder-clip (or entry guide) 52 may include a beveled top surface 180, a central base portion 182, and four plugs 184, 186, 187, 188. One end of the feeder-clip 52 may include an elongated and corrugated plug 184. Next to the elongated and corrugated plug 184 and disposed in the middle of the feeder-clip 52 may be a second plug 186. The second plug 186 may be wider and shorter than the elongated corrugated plug 182. Also, a pair of contra-lateral plugs 188, 190 may be disposed on the other side of the second plug 186.

The right feeder-clip 52 may include a circular passage 172 that extends from the beveled top surface 180 through the second plug 186. The passage 172 may be configured and dimensioned to receive an electrical cable for the motor. Additionally, the beveled top surface 180 may include a first tapered rectangular passage 170 which extends through the feeder-clip 52. A second rectangular passage 192 may extend from the beveled top surface 180 through the feeder-clip 52 between the contra-lateral plugs 188, 190. The first rectangular passage 170 and the second rectangular passage 192 may be separated by a thin wall 194. The thin wall 194 may include a tapered slit 176 which extends from the top of the thin wall to the bottom of the thin wall.

As shown in FIG. 15 the right feeder-clip 52 may be inserted into the rectangular channel 178 of the end-cap 50. The stem 176 of the end-cap may be seated within the primary accessory channel 198 and may be positioned in the primary accessory channel 198 by the upper guide rail 200, the lower guide rail 202, and the end-cap stem blocking member 204. The second plug 186 of the feeder-clip 52 may be received in the secondary accessory receiving channel 206. The secondary accessory receiving channel 206 may be used to accommodate an electrical cable 174 that extends from the motor 42 to an electrical outlet outside the track. The pair of contra-lateral plugs 188, 190 may be disposed in the opposing arcuate cavities 208 at the front of the track. The traveling guide member 72 may be disposed in the rectangular receiving channel 210 of the track and the zippered end 68 of the flexible membrane barrier 26 may be disposed in the internal anchoring cavity 212. The material connecting the zipper 68 and the flexible membrane barrier 26 may be disposed in the slot 214 between the rectangular receiving channel 210 and the internal anchoring cavity 212.

Figure 16:
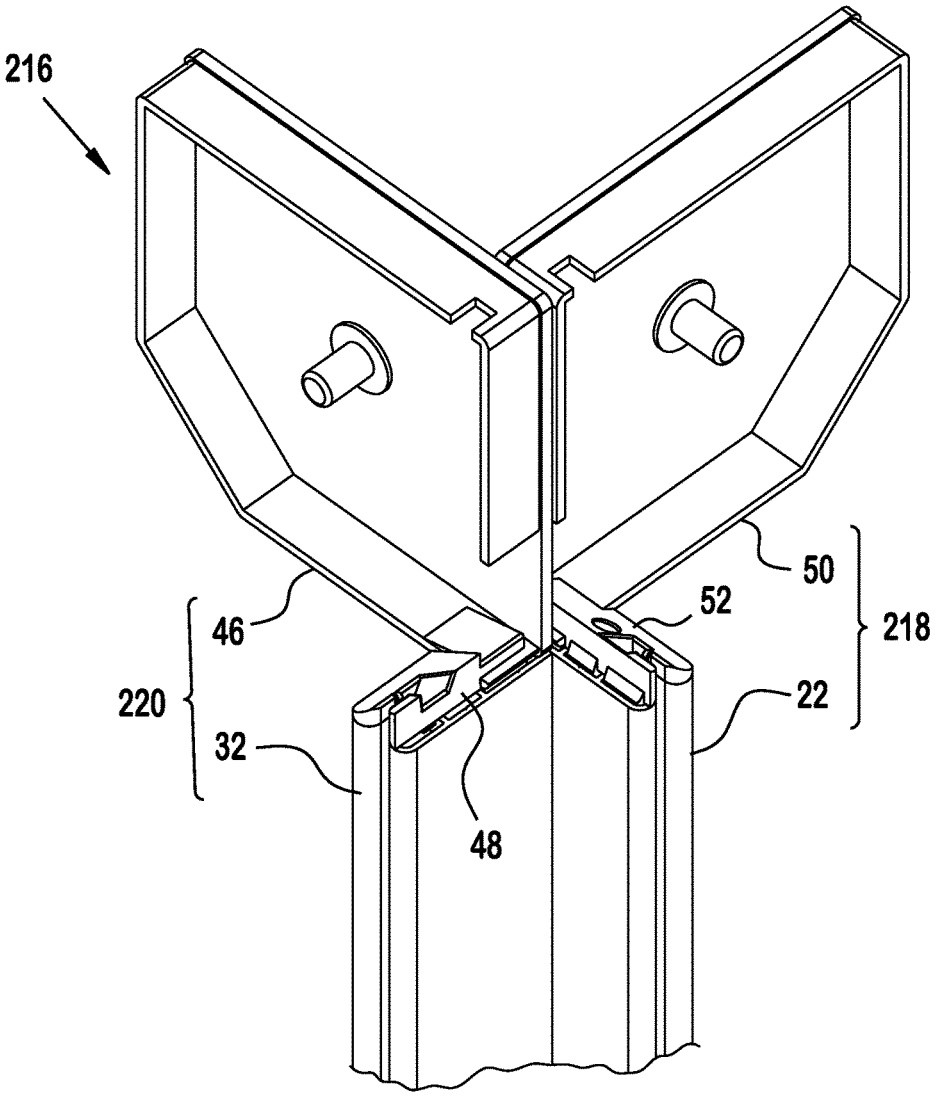
FIG. 16 is a perspective view of a pair of adjacent tracks and end caps from abutting retractable wall systems of FIG. 1.

FIG. 16 shows an exemplary corner assembly 216 formed from a first end-cap and track 218 and a second end-cap and track 220. The first end-cap and track 218 and the second end-cap and track 220 may be disposed at an approximately 90 degree angle. The corner assembly 216 may be used to construct adjacent retractable wall systems, as shown in FIG. 1.

Figure 17A:
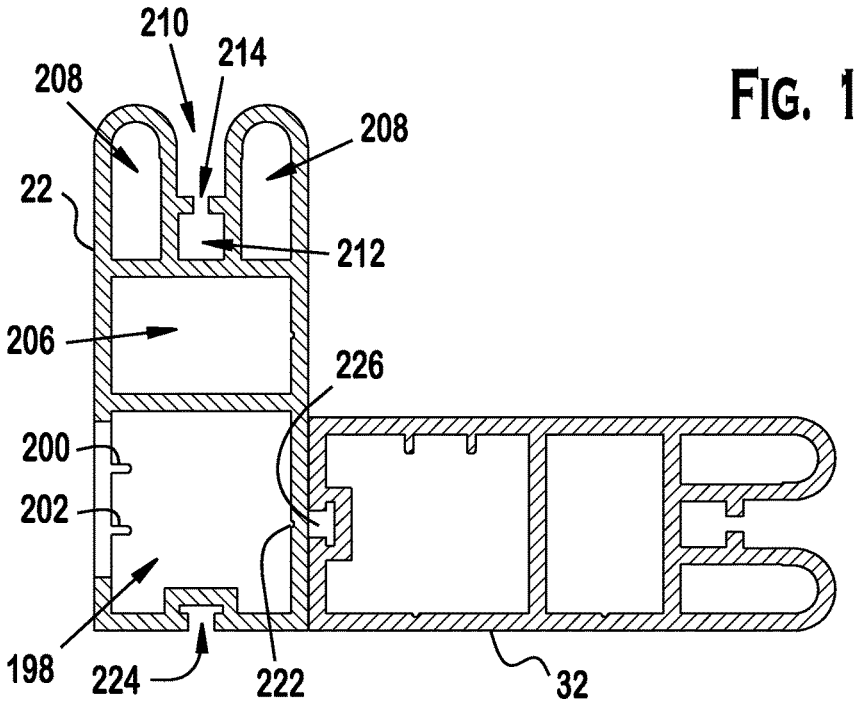
FIG. 17*a* is a view of the tracks of FIG. 17 fastened together to form a corner assembly.
Figure 17:
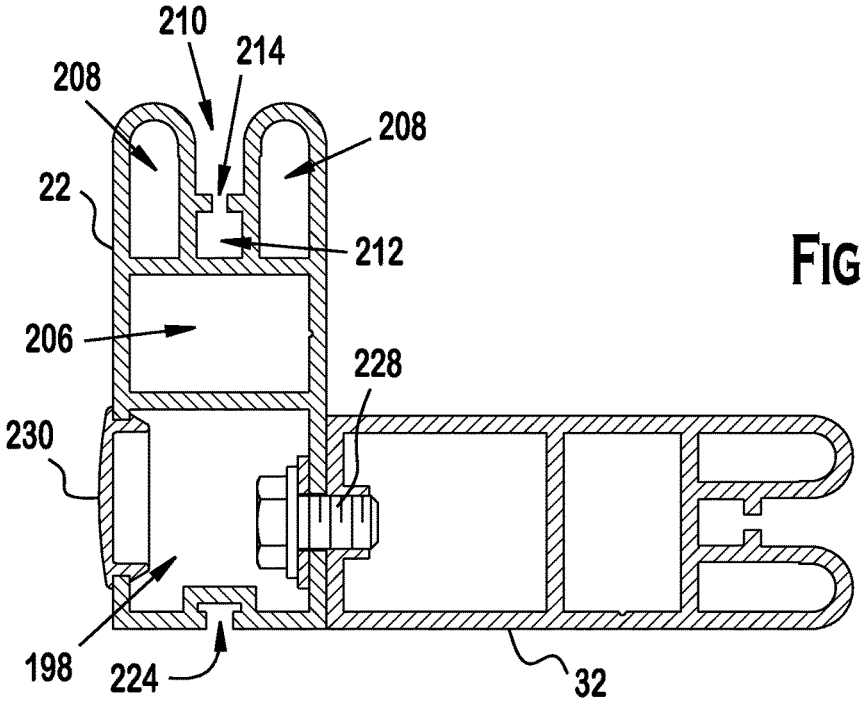
FIG. 17 is a detailed view of a pair of tracks aligned to form a corner assembly.

FIG. 17 shows an exemplary alignment of two tracks 22, 20 which may be used to construct a corner assembly 216. In the track alignment, the alignment groove 222 in the primary accessory receiving channel 198 may be disposed opposite the tertiary accessory groove 226 of the adjacent track. FIG. 17*a* shows how the two tracks 20, 32 may be securely fastened to each other. In a preferred method, a guide hole may be drilled between the upper and lower guide rails 200, 202 in the primary accessory receiving channel 198. The guide hole may be enlarged to an entry hole in order to provide access to the interior of the primary accessory receiving channel. A fastener 228 may be positioned in the alignment groove 222 (FIG. 17) and advanced into the tertiary accessory groove 226 (FIG. 17) of the adjacent track. The enlarged hole may be covered with a plastic cap 230.

Figure 18:
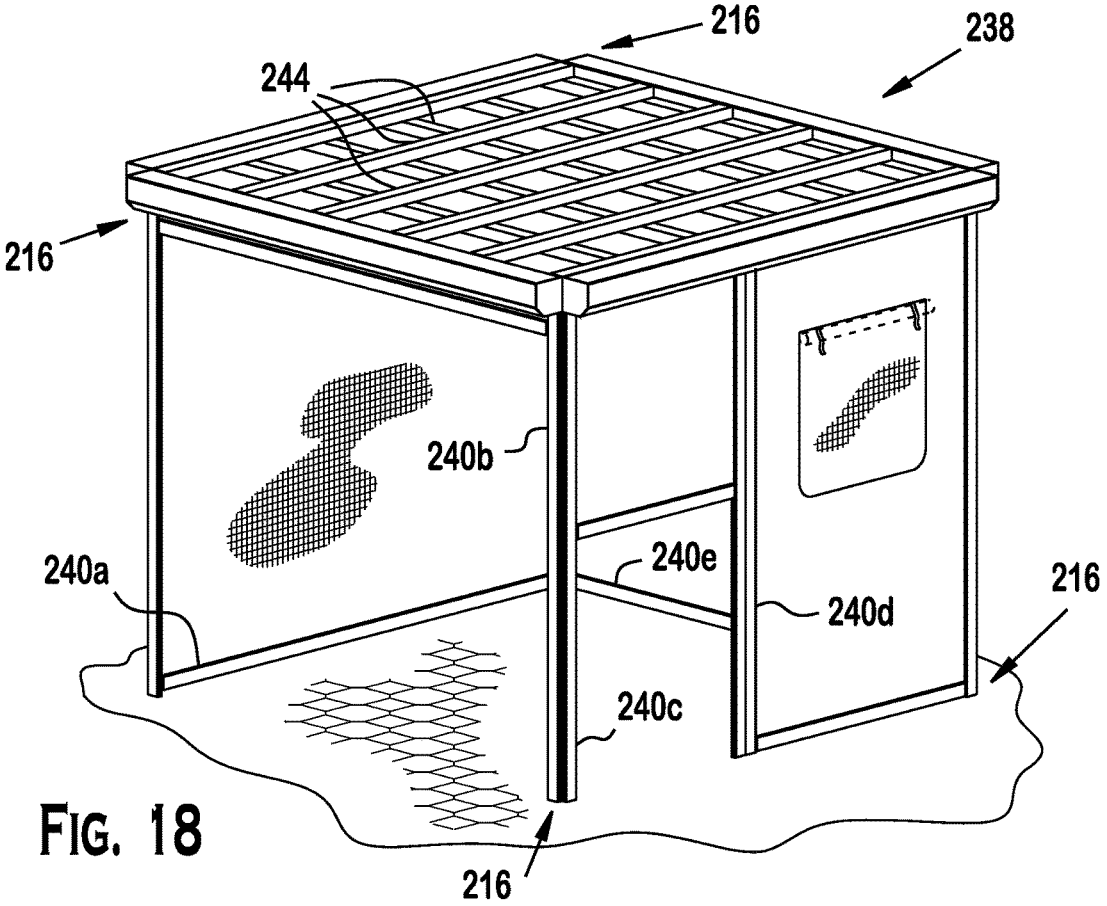
FIG. 18 is a perspective view of a free standing retracting wall system structure.

Referring to FIG. 18, four corner assemblies 216 may be used to construct a free standing structure. The free standing structure may be formed from four (or more) retractable wall systems 240*a*, 240*b*, 240*c*, 240*d*, 240*e*. Two retractable wall systems 240*c*, 240*d* may be joined together to form one side of the structure. One of the retractable wall systems 240*c* may be used as a door for the structure.

Figure 19:
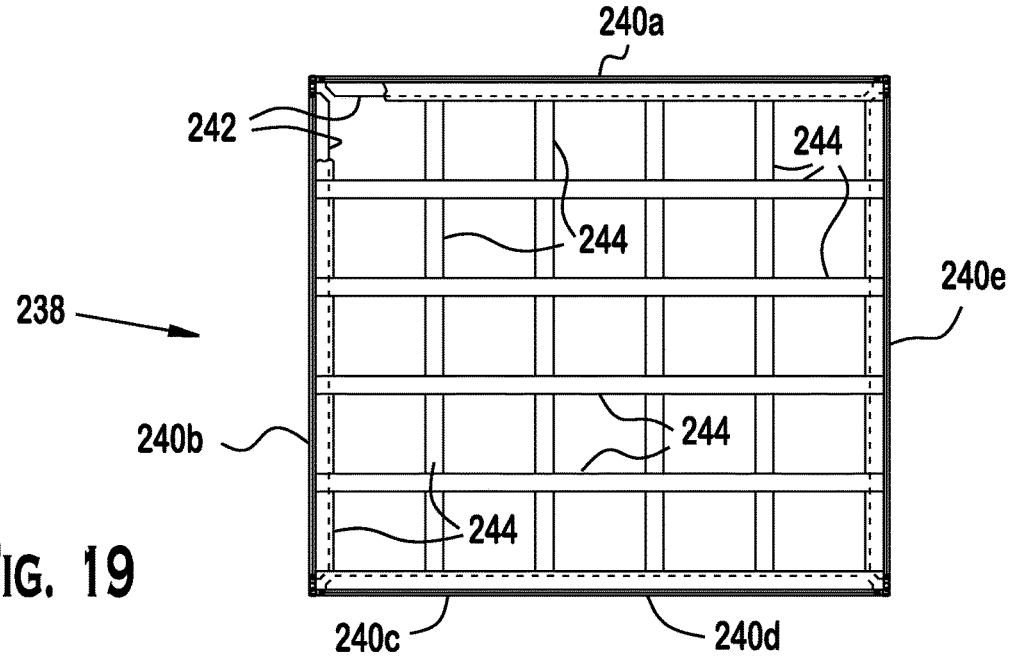
FIG. 19 is a plan view of the free standing structure of FIG. 18.

Referring to FIG. 19, a short ledge 242 may extend from the lower portion of the head rail into the enclosed space. The short ledges 242 of opposing retractable wall systems 240*b*, 240*e* may be used to support beams 244, which may form a cover for the structure 238. The beams may be used to form a continuous cover or a lattice cover. For example, wood boards (e.g., 1"×2" or 2"×4" boards) may be supported by the head rail ledges to form a lattice cover, which may allow the structure to be used as a temporary booth (or Sukkah) that is constructed for use during the Jewish festival of Sukkot.

Figure 20:
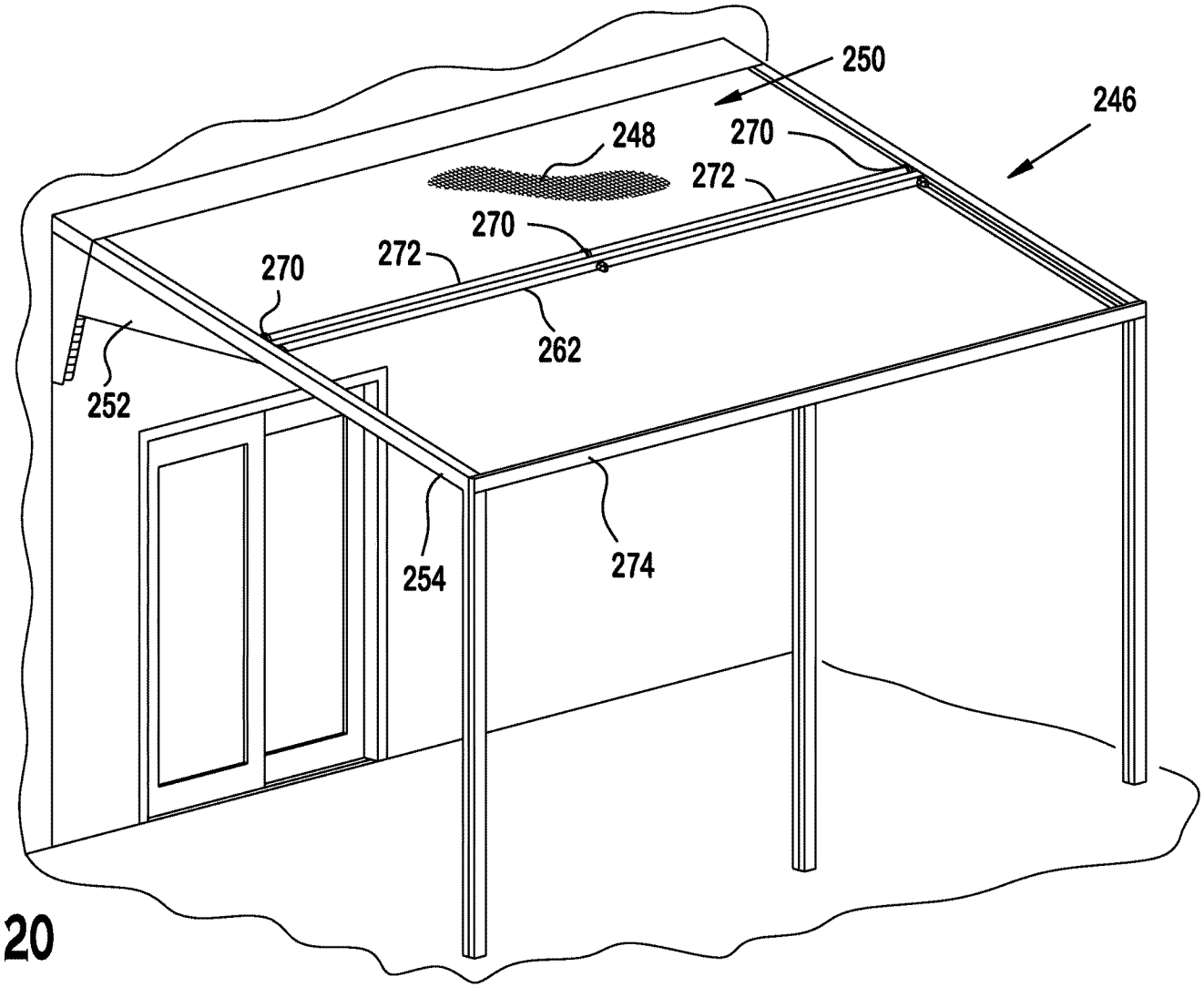
FIG. 20 is a perspective view of an exemplary retractable awning system.

Referring to FIG. 20, the retractable wall system may be adapted for use as an awning 246. A webbing material may 248 be molded to the flexible membrane barrier 250 that forms the awning cover in order to make the canopy stronger while maintaining light weight. The awning 246 may include a side pennant 252. As shown, in FIG. 21, the side track of the retractable wall system may be modified such that the side frame 254 incorporates a reinforced flexible membrane barrier connection 256 to provide a taunt but retractable ceiling canopy. The side frame 254 may include a roller track 258 for a wheel 260 which is connected to the front crossbar 262. Also, the side frame 254 may include a gutter 264 for collecting and transporting rain water 266. An exterior groove 268 on the side frame may be used to house a sealant for sealing the frame to a structure or an abutting awning frame.

Figure 21:
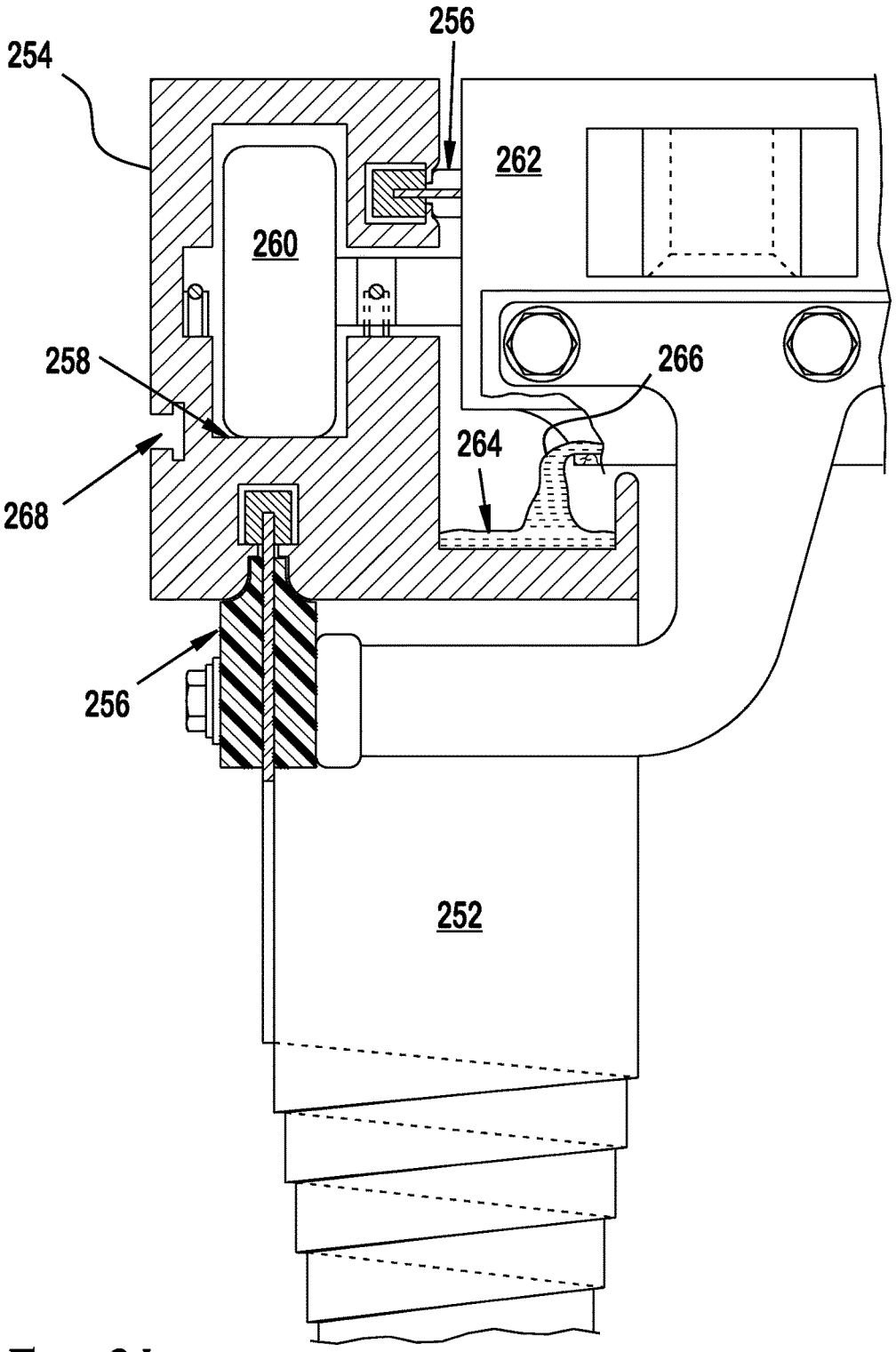
FIG. 21 is a sectional view of the left track of the retractable awning system of FIG. 20.

As depicted in FIG. 21, FIG. 22 and FIG. 23, a reinforced flexible membrane barrier connection 256 may be used to deploy a side pennant 252 with the ceiling canopy. Referring to FIG. 23, the front cross bar 262 may support a bracket 270 that holds a loop of canopy material 272 to form a pocket to collect and direct rain water 266 to the gutter 264. The front partition 274 of the awning structure 246 may include a channel 276 for receiving water from the gutter. In another embodiment, the gutter and wheel track may include the same structure. The front partition 274 further may include a solenoid 278 that may be used to lock the awning in the deployed configuration. Additionally, a brake (not shown) may be available on the motor end and the non-motor end of the awning spool. The retractable wall system may be constructed from materials selected to better withstand changes in temperature, corrosion, or degradation from ultraviolet light.

Figure 24:
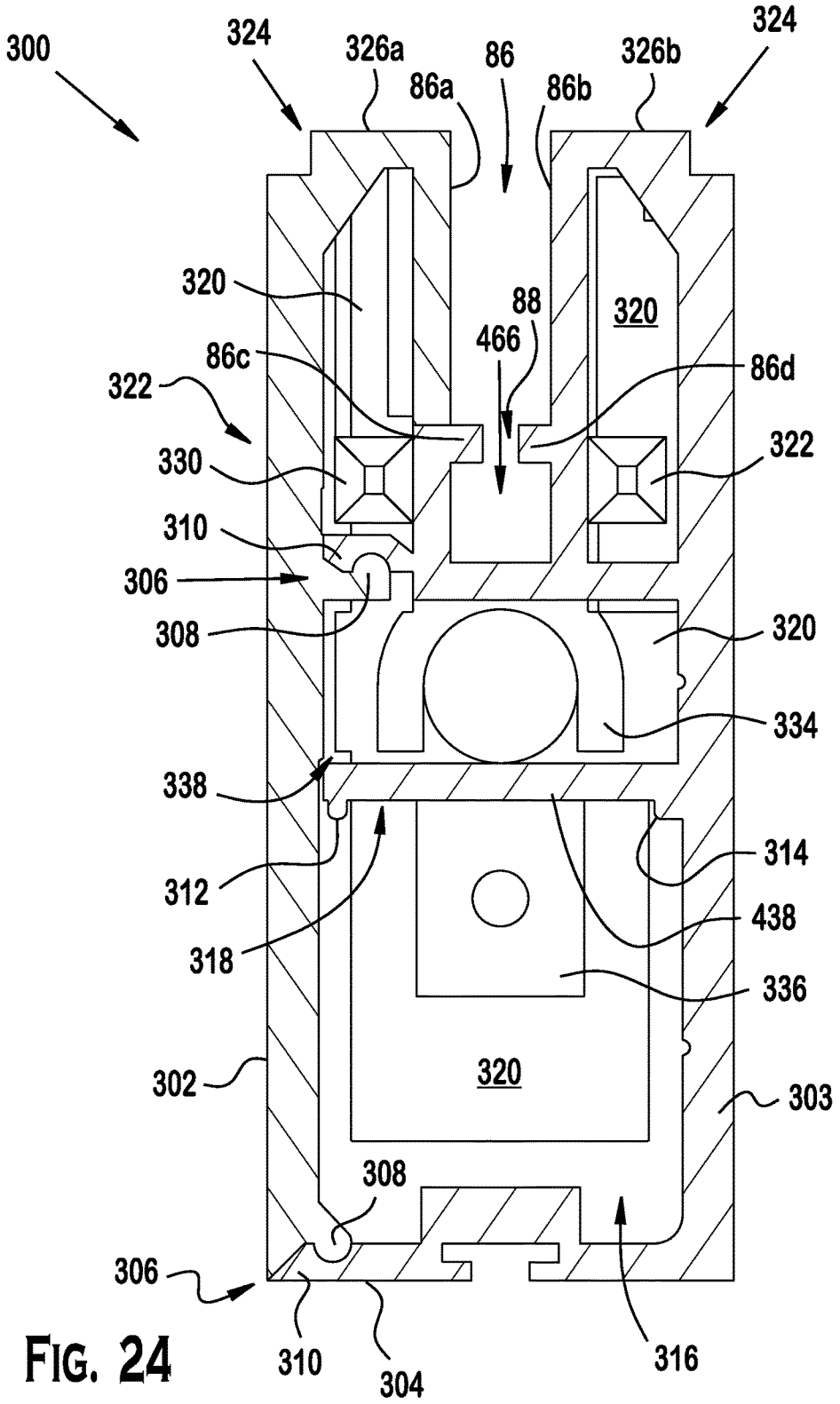
FIG. 24 is a cross-sectional view of another embodiment of the horizontal track of FIG. 1 taken perpendicular to its longitudinal axis and shown in a locked configuration.
Figure 25:
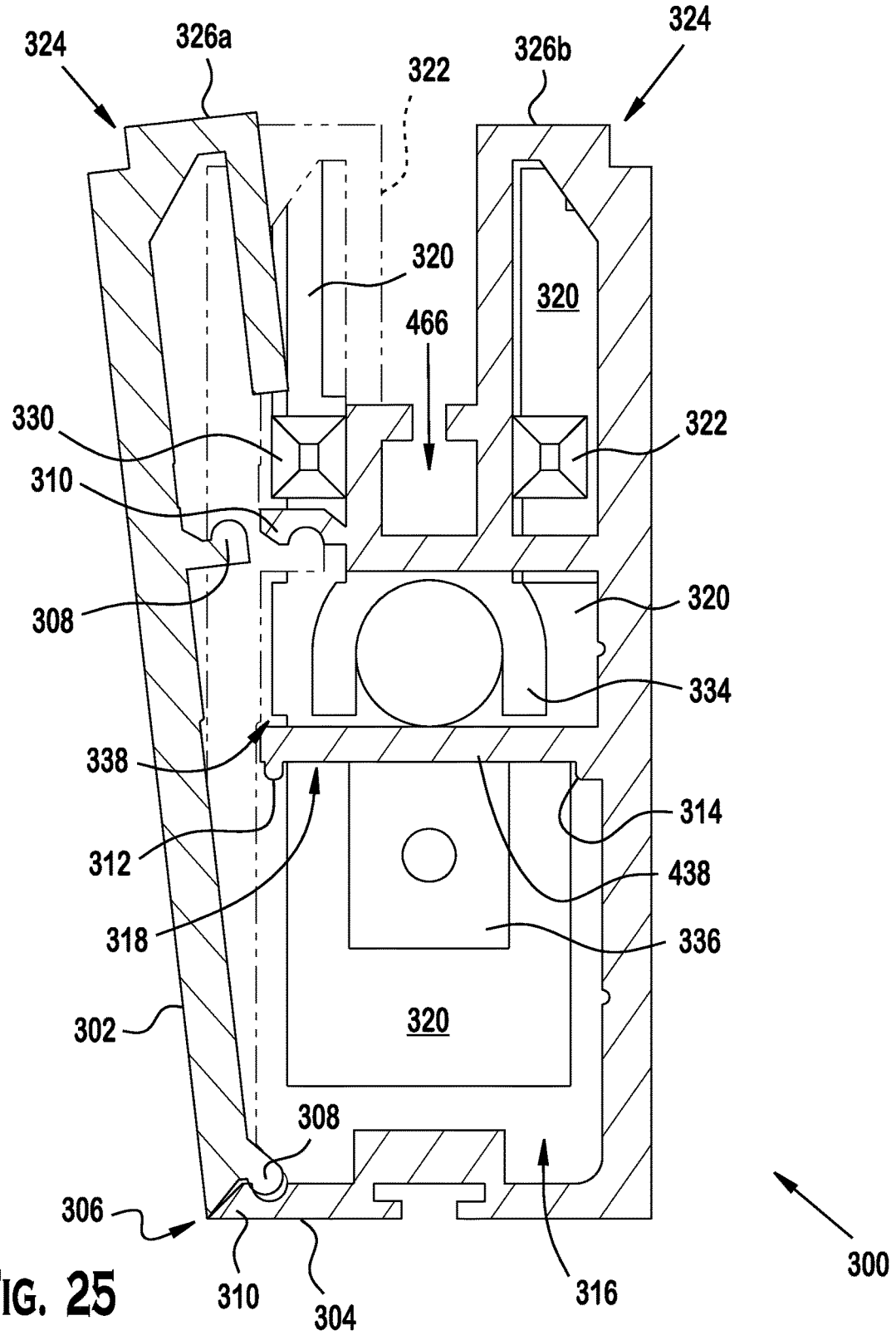
FIG. 25 is a cross-sectional view of the horizontal track of FIG. 24 shown in a released configuration.

Referring to FIG. 24, the cross-sectional profile of the track 300 is generally the same as in FIG. 10, but a first portion 302 of the track 300 may be removable, and may form a cover. The removable portion (e.g., Part 1) 302 may be secured to a receiving (or base) portion 304 (e.g., Part 2) with one or more snap fitting(s) 306. In an exemplary embodiment, the snap fitting 306 may be a mechanical joint system where part-to-part attachment is accomplished with locating and locking features that are homogenous with one or the other of the components being joined. Joining may require the (flexible) locking features to move aside for engagement with the mating part, followed by return of the locking feature toward its original position to accomplish the interference required to latch the components together. Locator features may be inflexible, providing strength and stability in the attachment. Each snap fitting (or snap fit locking pair) 306 may be formed from a hook 308 and an undercut 310. In FIGS. 24 and 25, the undercut 310 may be a cantilevered lug; and the hook 308 may be a lip or projection that snaps into the undercut. Assembly of the snap fitting 306 may require temporary deformation of one or both pieces, but the parts may return to an unstressed state in the final assembled position. Additionally, the retaining force of a cantilevered lug may be a function of the bending stiffness of the cantilevered lug. Thus, the lugs may be loaded partially to achieve a tight assembly. Although the retention of each snap fit locking pair 306 may be releasable, the retention may be permanent in certain applications.

As shown in FIG. 24 and FIG. 25, a retention wall 312 and a guide wall 314 may be configured and dimensioned to retain an accessory in the primary receiving channel 316. For example, the retention wall 312 and guide wall 314 may form parallel sides of a channel 318 that may hold the accessory, for example, an entry guide piece 320 within the primary receiving channel 318 of the track when the cover 302 is removed from the receiving portion 304. In FIG. 24, the track is shown in an assembled (or locked) configuration 322. During installation the recessed, square profile 324 of the upper contour of the track 326 may allow the track to integrate smoothly with drywall and other construction materials without the appearance of cracks or spaces between the finished drywall and track.

Referring to FIG. 25, the track 300 may have a released configuration 328 in which the cover 302 is separated from the other part (Part 2) 304. Thus, the cover 302 may be attached to receiving portion 304, after the receiving portion 304 has been connected to other structural members of the retractable wall system. For example, the entry guide 320 may include a high side fitting 330, a low side fitting 332, a block 334, and a stem 336, which are configured to attach to the receiving portion 304 only. Likewise, the cover 302 may be removed from the receiving portion 304 after the retractable wall system has been installed. This severability feature allows weight bars to be installed in the primary receiving channel 316 of a horizontal track of a previously erected retractable wall system. It also allows for cabling (e.g., structural, control, or electric cable) to be run through the secondary receiving channel 338 after the retractable wall structure (or awning) has been assembled. Moreover, sound proofing material may be placed inside the track after the retractable wall structure (or awning) has been assembled. The severability feature may improve the constructability of the system, as well as enhance worker safety because handling a track with preloaded weight bars is significantly heavier than handling an empty horizontal track.

Referring to FIG. 2, in one embodiment of the retractable wall system 12 one end of the tube (40, 40') receives a motor assembly 28. A portion of the motor assembly may be secured to the bracket 90. The other end of the tube may receive an idler 56. The idler may include a ring of ball bearings that may be disposed on the end cap pin 54. In another embodiment, the idler may be spring loaded. In yet another embodiment the idler may be replaced with a "Chinese spring," which stores energy as the retractable wall is lowered and releases stored energy as the retractable wall is raised. The energy released by these devices may assist in retracting the wall. An energy storage device (e.g., a spring loaded idler or "Chinese spring") may be used in combination with a manual gearbox on the one end of the tube, in place of the electric motor assembly. Alternatively, an energy storage device may be used in combination with a chain drive mechanism on one end of the tube, instead of the electric motor assembly.

Figure 26:
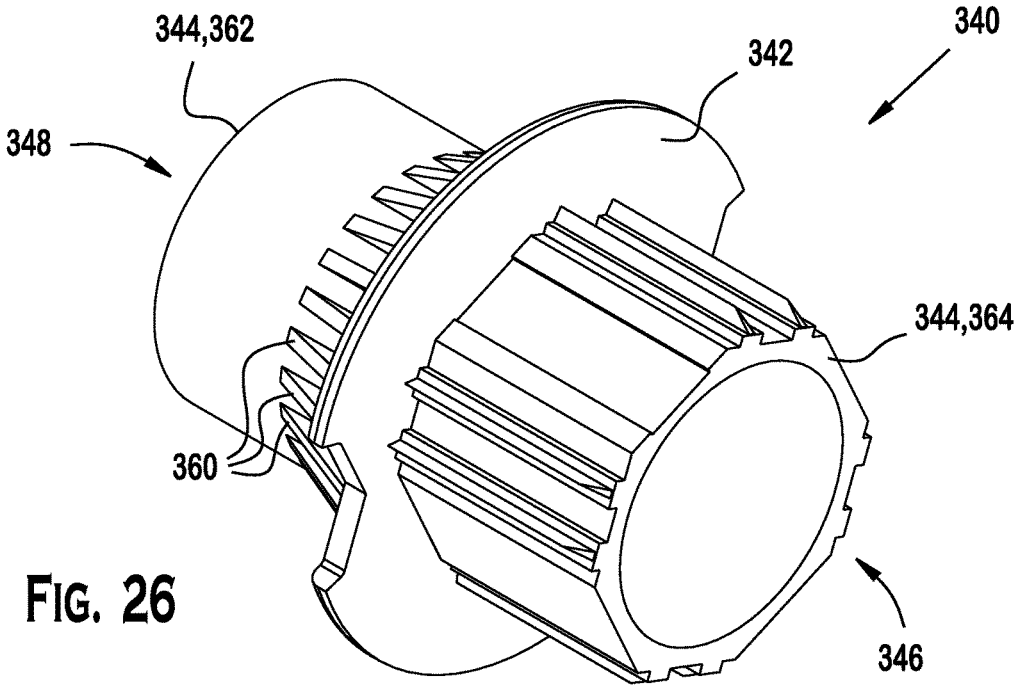
FIG. 26 is a perspective view of an embodiment of an adaptor flange of the present invention.
Figure 27:
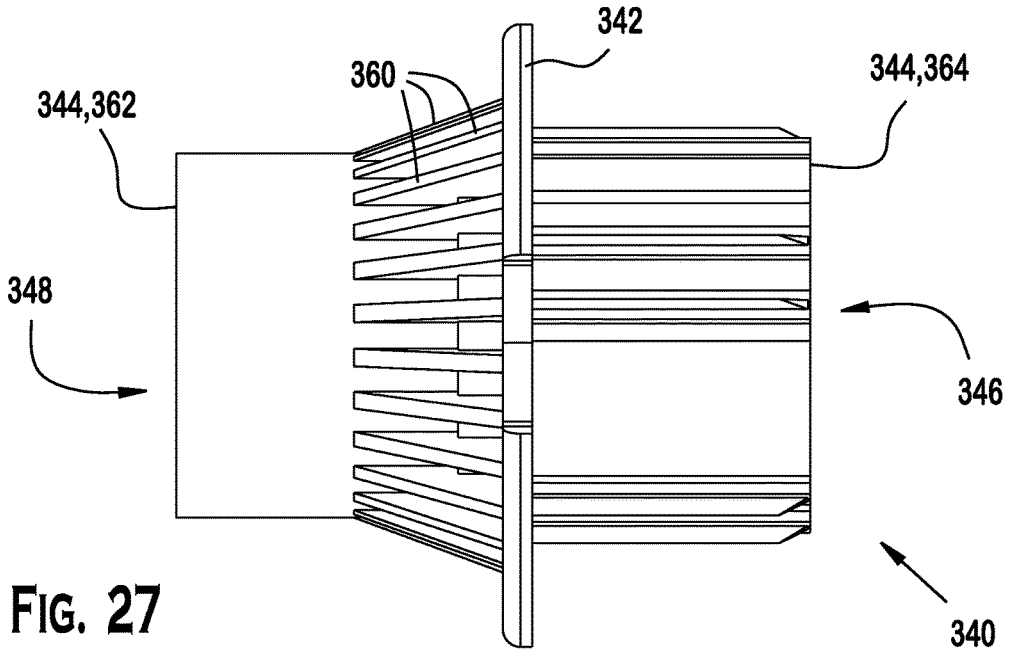
FIG. 27 is a side view of the adaptor flange of FIG. 26.

Referring to FIG. 26 and FIG. 27, an adaptor flange 340 may be used to connect a retractable wall system (FIG. 2) tube 40 to the end caps 46, 50. The adaptor flange 340 may have a flange 342 disposed between two working end portions 344. For example, one working end portion 346 of the adaptor flange may be configured and dimensioned to mate with the tube. By contrast, the other end 348 of the adaptor flange may be configured and dimensioned to mate with a customized insert 350 (FIG. 31 and FIG. 32) which in turn may be adapted to connect to a gear box, drive chain, or mounted on an end cap pin or like bracket.

Figure 28:
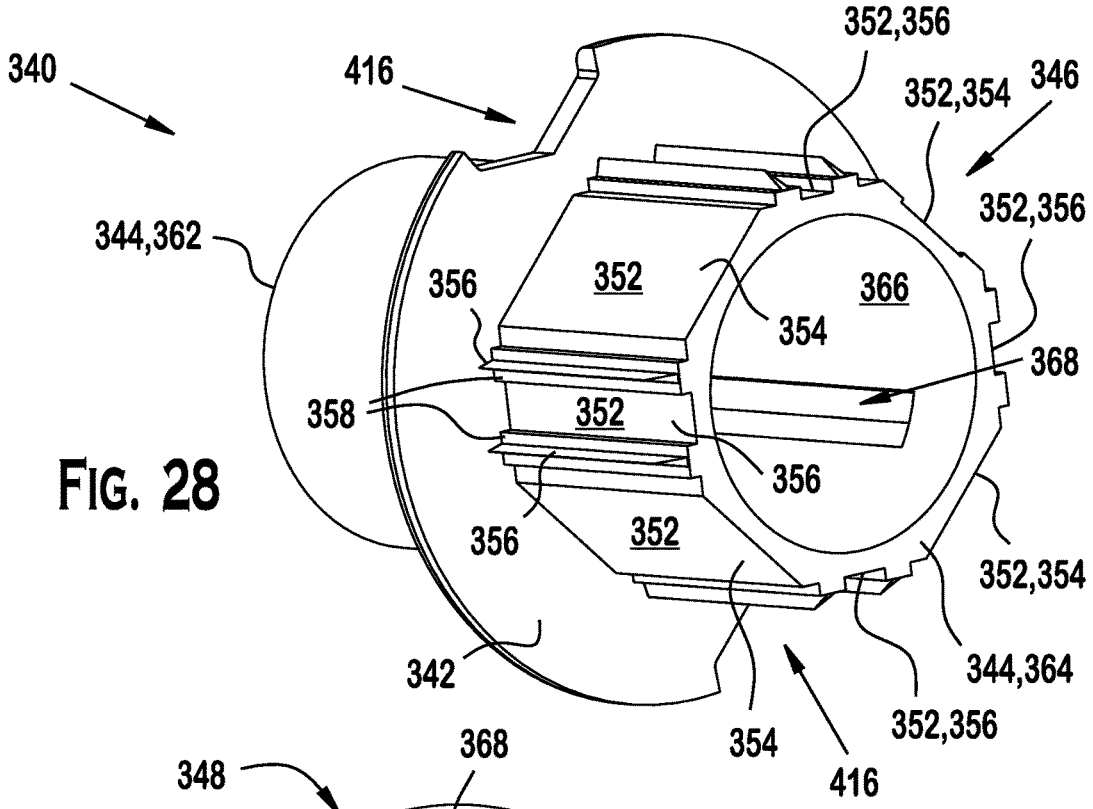
FIG. 28 is a perspective view of the tube mating portion of the adaptor flange of FIG. 26.

Referring to FIG. 28, the tube mating portion 346 may include one or more faces 352 that interlock with the internal features of the tube. For example, the one or more faces 352 of the tube mating portion 346 may be configured and dimensioned to form a press fit plug with the tube. For instance, interior wall segments or structural members 78 (FIG. 9) of the tube may receive and retain the press fit plug. The press fit plug may include four drive faces 354 and four rail faces 356. In one embodiment, a rail face 356 may include a base 358 and at a fin 360. Although the embodiment of the tube mating portion shown in FIG. 28 has an axis of symmetry, any configuration of plug features and fasteners may be used to connect with the tube end, provided the tube mating portion 346 is securely connected to the tube, rotation of the flange 342 turns the tube about an axis, and the structure can readily withstand the torque necessary to rotate the tube.

Figure 29:
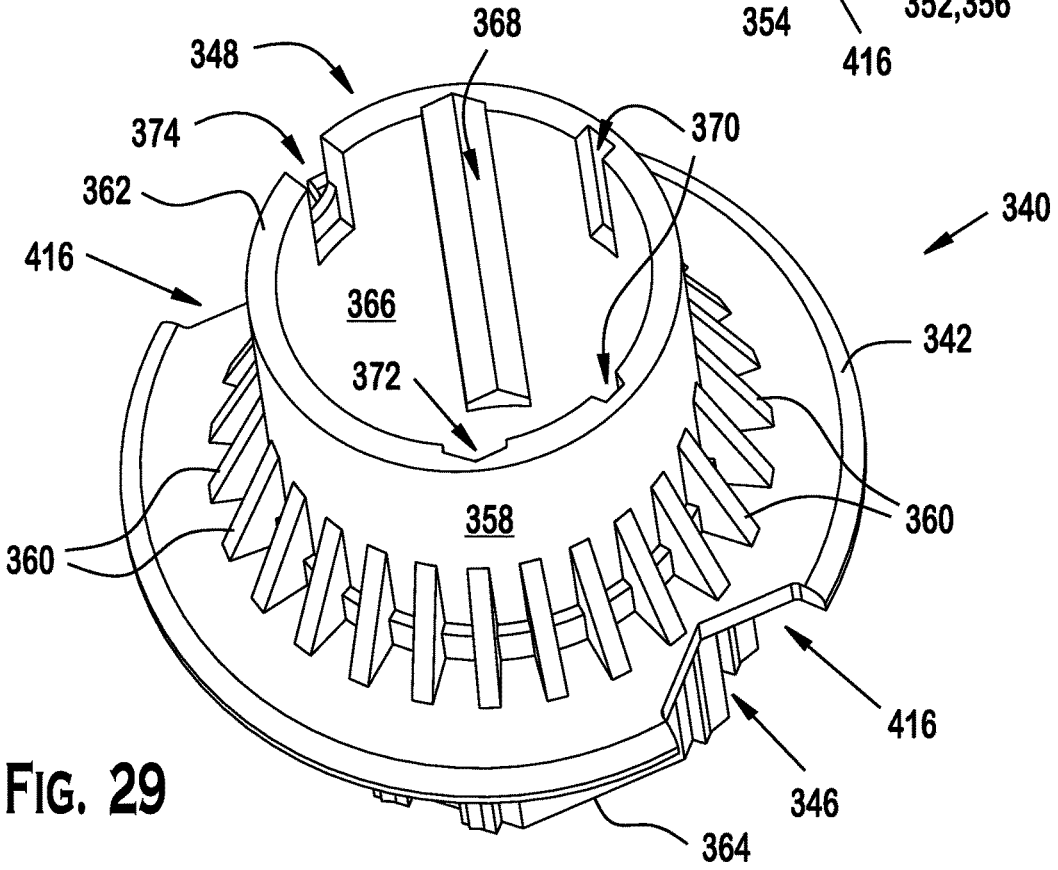
FIG. 29 is a perspective view of the insert mating portion of the adaptor flange of FIG. 26.
Figure 31:
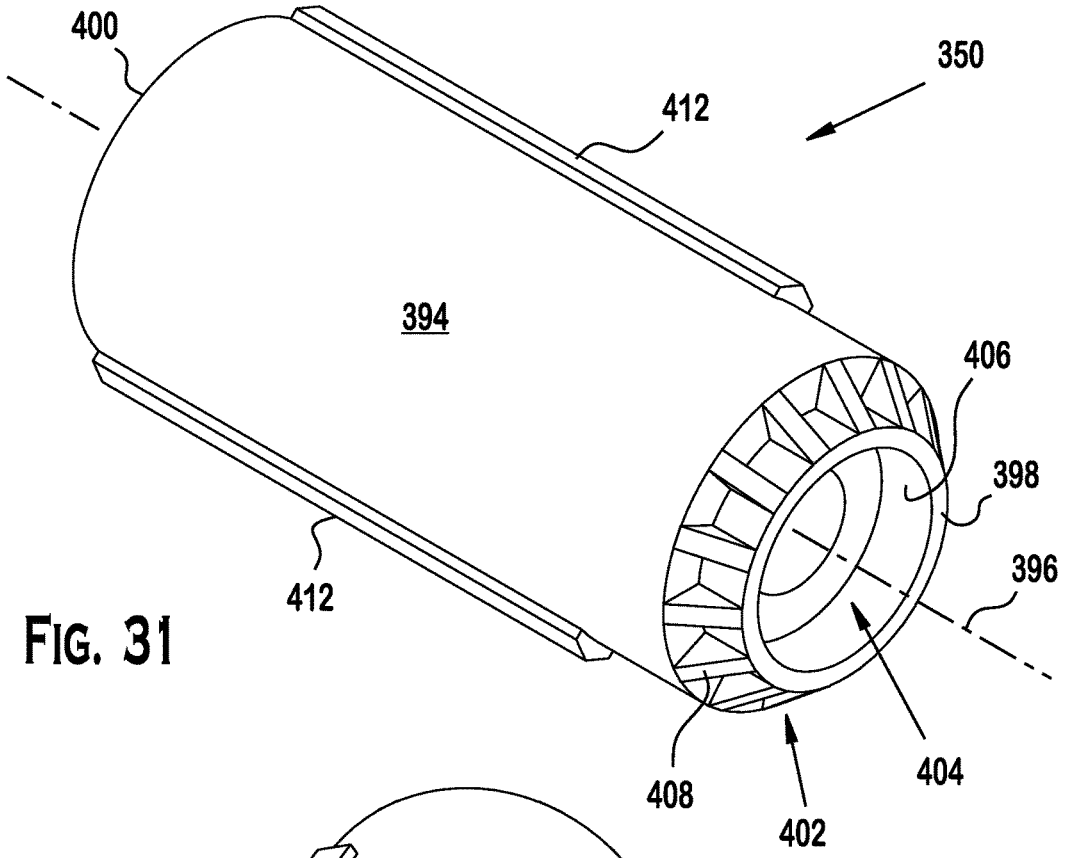
FIG. 31 is a front perspective view of an exemplary embodiment of an adaptor insert of the present invention.

Referring to FIG. 29, the insert mating portion 348 may include a tube member 358 that is configured and dimensioned to mate, for example, with an idler, a spring loaded idler, an electric motor assembly, or a "Chinese spring." Additionally, the hollow, tube member 358 may be configured and dimensioned to mate with the reversible insert of FIG. 31. In the embodiment shown in FIG. 29, the hollow, tube member 358 is circular cylindrical, however, a cylinder of any shape may be used provided that the tube member is adapted to cooperate with a drive mechanism (or hinge joint) that may be connected to (or cooperate with) an end cap. The outer surface of the hollow tube member 358 further may include structural elements 360 that reinforce the flange-tube member interface against sheering forces. The structural members 360 may include a plurality of reinforcing members. One (or more) of the reinforcing members 360 may form a buttress between the tube member 358 and the flange 342.

Figure 32:
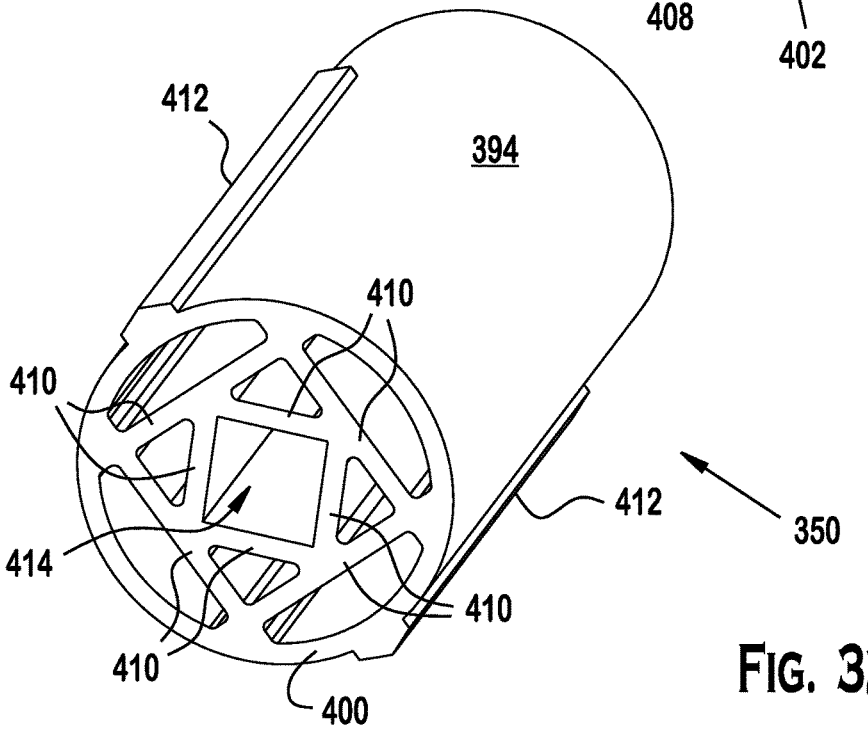
FIG. 32 is a rear perspective view of the adaptor insert of FIG. 31.

The adaptor flange 340 may have a leading end 362, a trailing end 364, and an internal side wall 366 extending from the leading end to the trailing end. The internal side wall may define a passage through the adaptor flange 340. The internal side wall 366 may include one or more grooves. A groove 368 may extend from the leading end 362 to an interior location on the internal side wall 366. Another groove(s) 370 may have a square cut. Yet another groove 372 may be spaced from the leading end groove 368 and the square cut groove(s) 370 on the side wall. The square cut groove(s) 370 may be configured and dimensioned to receive a raised key on the crown of an electrical motor assembly or similar accessory. For instance, the one or another square cut groove(s) 370 may be configured to receive one or more raised keys on the head of a Chinese spring. Additionally, the leading end groove(s) 368, 372 may be configured and dimensioned to receive a radial projection on the reversible insert 350 (FIG. 31 and FIG. 32). A slot or opening on the groove 374 may extend through the side wall to provide a fastener attachment site for securing a fastener to the adaptor flange 340 and the flange accessory (e.g., crown of electrical motor, Chinese spring, and reversible insert 350).

Figure 30:
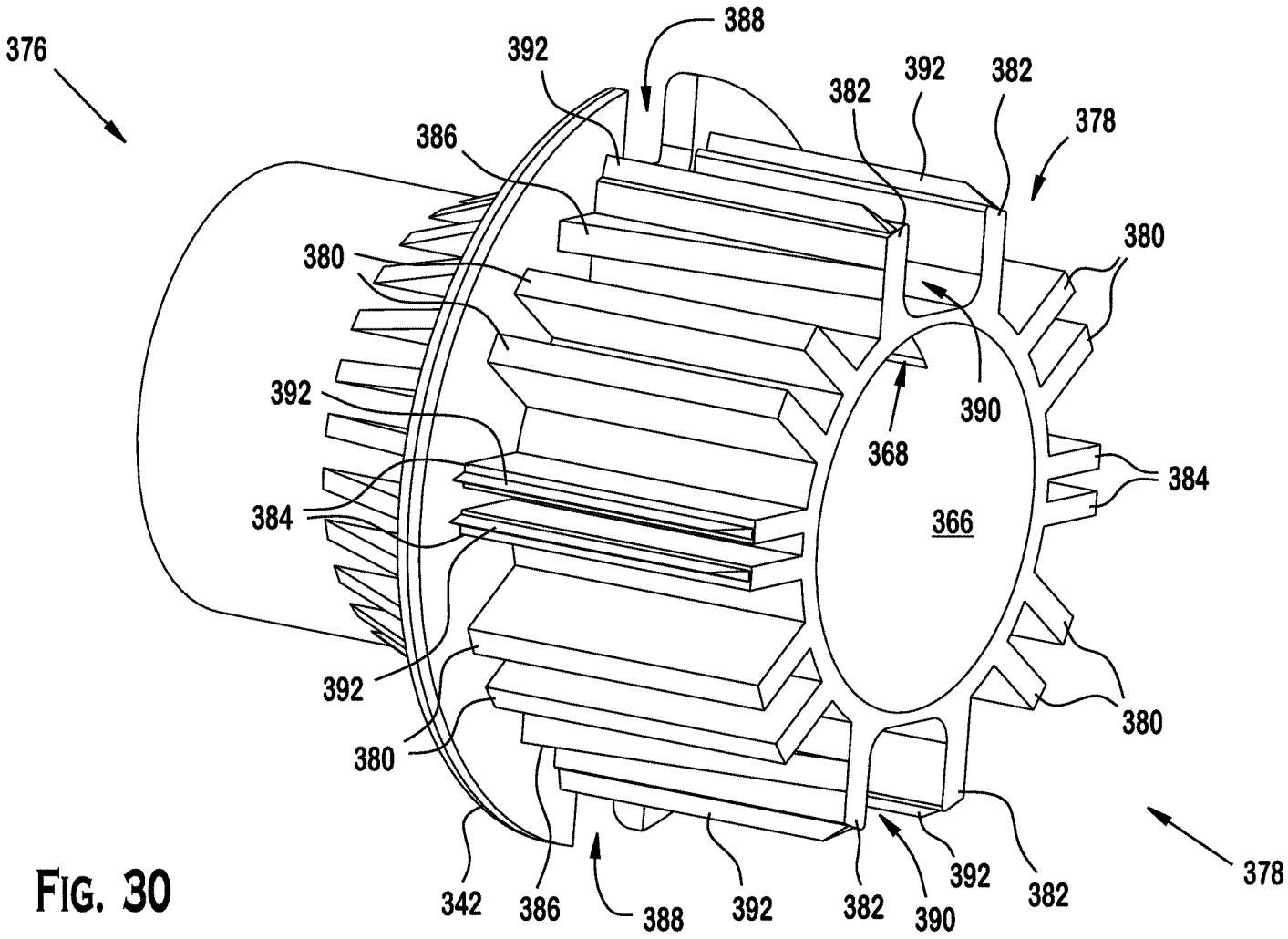
FIG. 30 is a perspective view of another embodiment of an adaptor flange of the present invention.
Figure 30B:
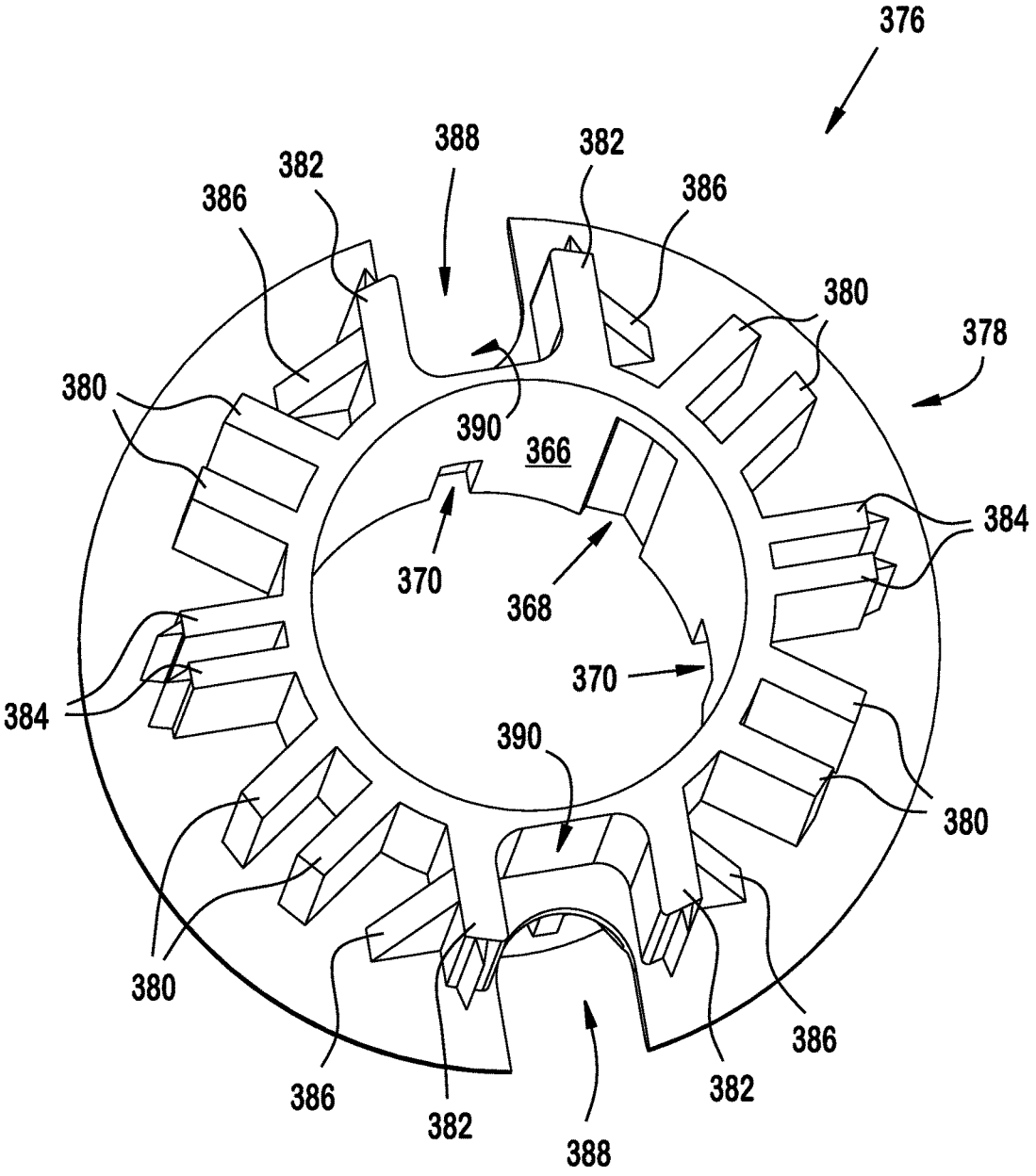
FIG. 30*b* is a perspective view of the tube mating portion of the adaptor flange of FIG. 30.

FIG. 30 and FIG. 30*b* show another embodiment of an adaptor flange 376 of the present invention. The adaptor flange 376 may be configured and dimensioned to mate with a conventional awning tube or a galvanized steel roller tube. In this embodiment, the tube mating portion 378 may include three different connectors for securing the tube mating portion 378 within a conventional tube. For instance, the connectors may include a plurality of blocks 380, primary rails 382 and secondary rails 384, as well as a wing that forms a buttress between the flange 342 and the primary rails 380. The distribution of the connectors may be uniform or may form a pattern around the exterior side wall of the tube mating portion 378. For example, pairs of like connectors may be disposed about the circumference of the tube mating portion at a radial interval of approximately 180 degrees. In one configuration, one primary rail 380 may be disposed next to each lateral edge of the respective flange cutouts 388. The primary rails 380 may define a passage 390 behind the flange cutout 380 that allows a loop of awning material to be slipped into a tube pocket (see FIG. 33). The primary rails 380 may be reinforced with a wing structure 386 that buttresses the primary rail with respect to the flange. A pair of blocks 380 may be disposed on either side of the primary rails 384 to provide additional structural support for the inner wall of the tube. A pair of secondary rails 384 may be disposed between two pairs of blocks 380. Each rail may include a fin 392 that projects beyond an imaginary circumference defined by the end surface of the rail base and blocks so as to provide for a tighter, more secure press fit to the tube.

FIG. 31 shows an exemplary embodiment of an insert 350. The insert 350 may include a body 394 formed from a cylindrical member. The cylindrical member may have a central axis 396 as well as a proximal end 398 and a distal end 340. The cylindrical member may be circular cylindrical. The cylindrical member may be tapered such that the diameter at one end of the member is larger than at the opposite end. The insert 350 may include a nose 402 adjacent to the proximal end 398. The nose 402 may include a bearing receiving port 404. The bearing receiving port 404 may include an annular wall 406 that defines a circular cylindrical port which may be configured and dimensioned to receive a ring of ball bearings. One or more reinforcing members 408 may connect the circumference of the annular wall 406 to the body 394 in order to buttress the nose 402 against sheering forces. The distal end 400 of the body 394 may include internal structures 410 that are adapted to receive the driver of a gearbox or a pulley chain drive. The insert may further include one or more radial projections 412 on the body. Each radial projection 412 may be configured and dimensioned to mate with a respective groove 368, 372 on the internal side wall 366 of either adaptor flange described above. Additionally, the one or more radial projections 412 may be located on the body 394 such that: (1) the nose 402 protrudes from the adaptor flange when the distal end 400 is inserted into the adaptor flange; and (2) the gearbox or drive chain receiving end 398 are flush with the distal end 400 of the insert when the nose 402 is inserted in to the adaptor flange. (e.g., FIG. 34). This spacing differential provides the necessary space for the gearbox or drive chain assembly in the end cap when the distal end of the insert is disposed within the flange. Similarly, the spacing differential provides the necessary space for the bearing ring cage to mount on the end cap stub 54 (or similar structure).

FIG. 32 shows the distal end 400 of the insert of FIG. 31. The distal end 400 of the inset 394 may include a plurality of structural reinforcing members 410 inside the insert. The orientation of the structural reinforcing members 410 may be designed to make the insert 394 more resistant to bending moments and sheering forces. The internal structural reinforcing members may provide added rigidity to the insert 394 so as to prevent bending and cracking of the insert under the static and dynamic loads attendant to mounting and operating the tube-flange-insert assembly. Additionally, the structural reinforcing members 410 may define a driver receptacle 414 for receiving the driver of a manually operated gear box or the driver of a pull chain mechanism.

Figure 33:
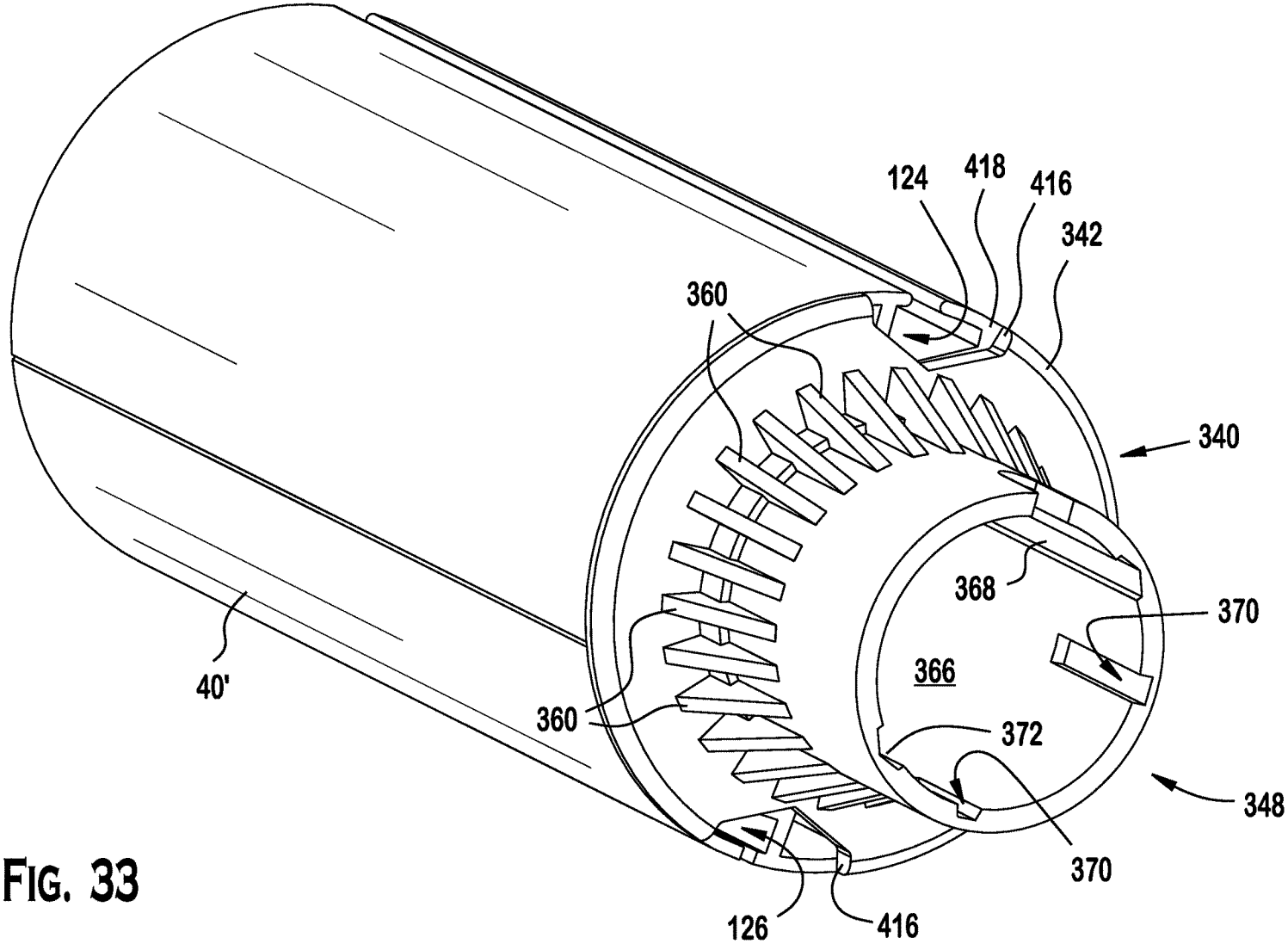
FIG. 33 is a perspective view of the adaptor flange of FIG. 26 connected to the tube of FIG. 5.

As shown in FIG. 33, the tube mating portion 352 of the adaptor flange 340 may be inserted into the tube 40 until the flange 342 contacts the end 418 of the tube. The adaptor flange may be oriented such that the flange cutouts 416 are generally aligned with the pocket receptacles 124, 126. Depending on the application, an insert 350, motor 42, idler or "Chinese spring" may be placed into the insert receiving end (or insert mating end) 348 and interlocked with the appropriate grooves 368, 372 on the internal sidewall 366.

Figure 34:
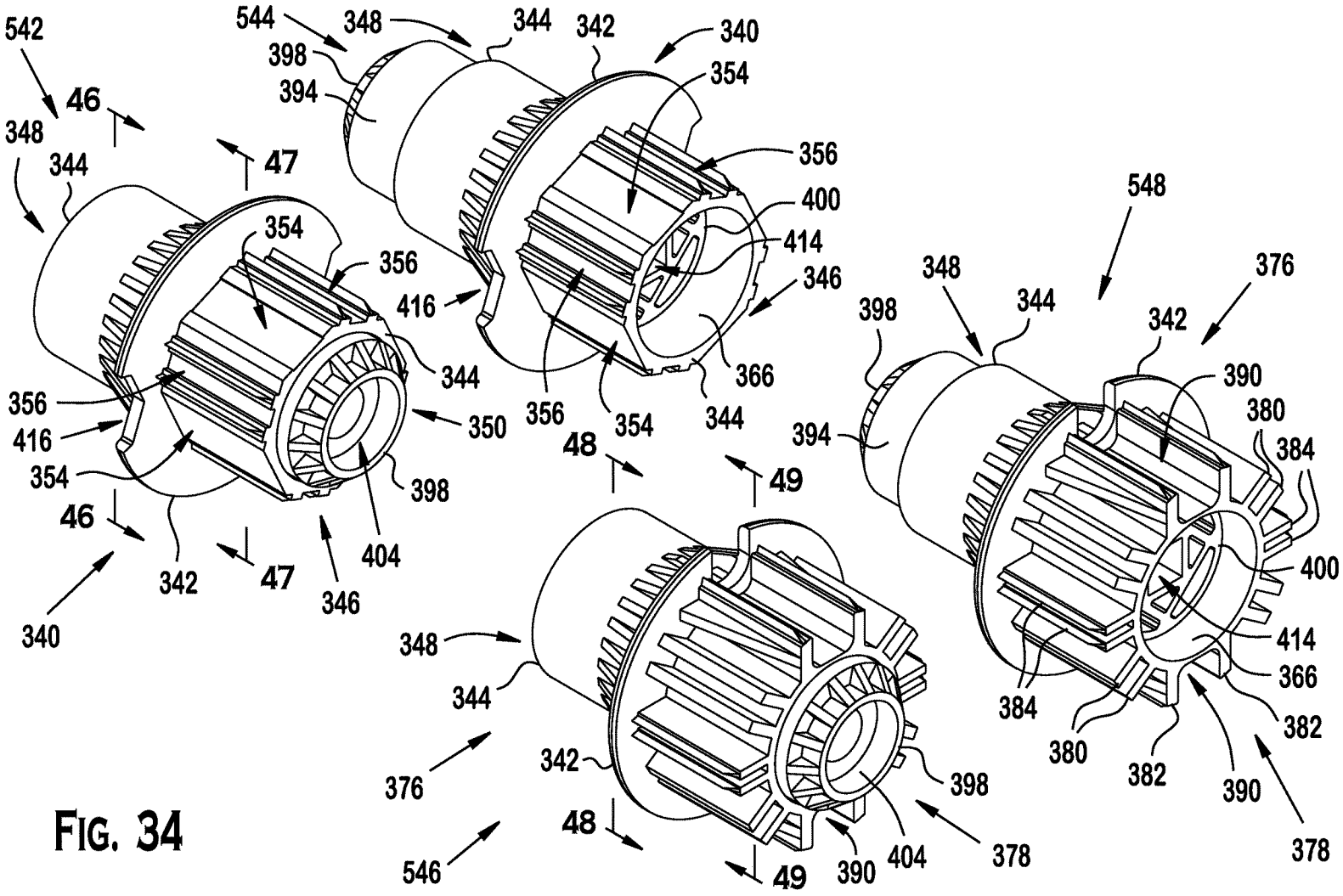
FIG. 34 is a perspective view of exemplary adaptor flange and insert assembly combinations.
Figure 34B:
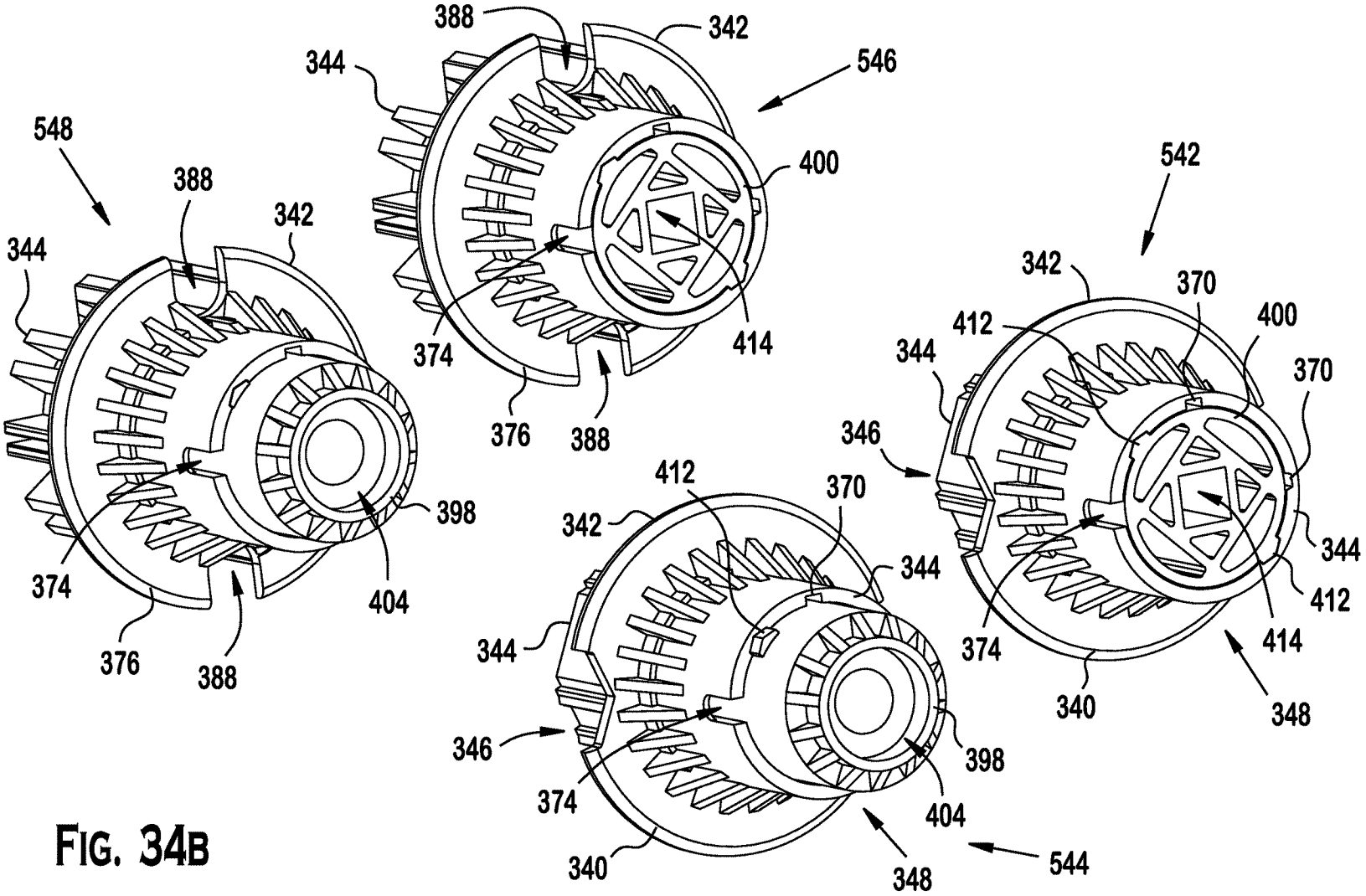
FIG. 34B is another perspective view of the exemplary adaptor flange and insert assembly combinations of FIG. 34.

FIG. 34 and FIG. 34*b* show a rear and front perspective view, respectively, of two adaptor flange embodiments 340, 376 with the insert 350 of FIGS. 31-32.

Figure 46:
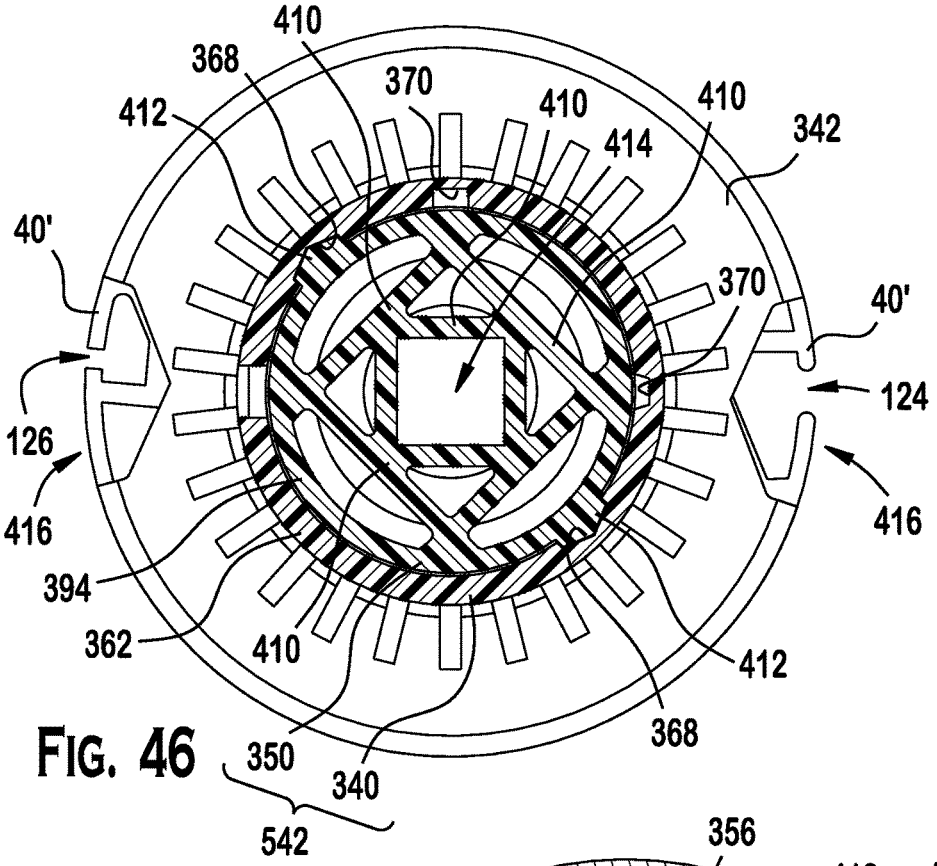
FIG. 46 is a cross-sectional view of the adaptor flange of FIG. 26 along line 46-46 of FIG. 34.
Figure 47:
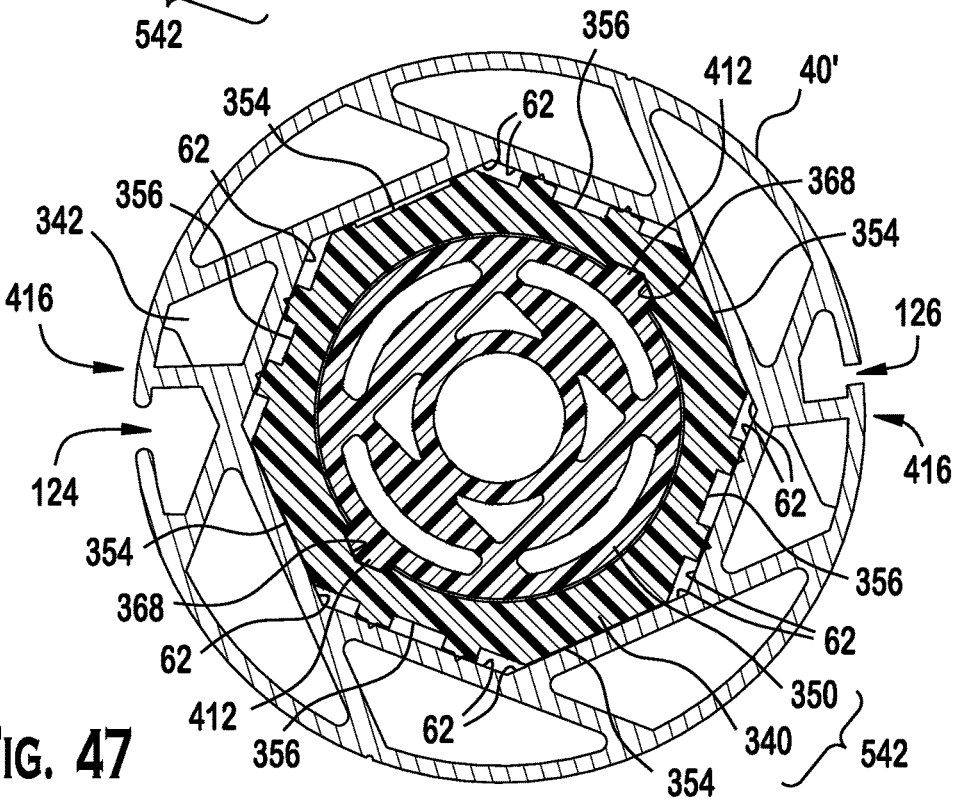
FIG. 47 is a cross-sectional view of the adaptor flange of FIG. 26 along line 47-47 of FIG. 34.

Referring to FIG. 34, one adaptor flange 340 and insert 350 assembly configuration 542 depicts the insert 350 after being placed within the adaptor flange 340 from the insert mating portion 348 with the proximal end 398 of the insert 350 facing inward. In this configuration 542, the bearing receiving port 404 is not available for use at the working end 344 of the insert mating portion 348 of the adaptor flange 340. Instead, the distal end 400 of the insert 350 is available for use at the working end 344 of the insert mating portion 348 of the adaptor flange 340. As shown in FIG. 34B, this configuration of the adaptor flange 340 and insert 350 assembly 542 provides working access to the driver receptacle 414 on the distal end of the insert 400. The radial projection(s) 412 of the insert 350 are disposed and interlocked within the leading end groove(s) 368 of the adaptor flange 340. The distal end 400 of the insert 350 may be flush with the working end portion 344 of the adaptor flange 340. In this configuration, the driver of a manual gearbox may be inserted into the driver receptacle 414 to rotate the adaptor flange 340 and insert 340 assembly 542. Referring to FIG. 46, internal structures 410 of the insert 350 strengthen (or reinforce) the assembly 542 from sheering forces and bending moments associated with a tube connected to the tube mating portion 346 of the adaptor flange 340. In another operable configuration of the adaptor flange 340 in which the insert 350 is not used, one or more square cut grooves 370 may be used to interlock with an electric motor or spring assembly. Referring to FIG. 47, a rail face(s) 354 and a drive face(s) 356 of the adaptor flange 340 may bear on an interior surface(s) 62 of the tube so as to provide a mechanism for transferring rotational movement from the driver of a manual gearbox or other device.

Referring to FIG. 34, another adaptor flange 340 and insert 350 assembly configuration 544, depicts the insert 350 after being placed within the adaptor flange 340 from the insert mating portion 348 with the distal end 400 of the insert 350 facing inward. In this configuration 544, the bearing receiving port 404 is available for use at the working end 344 of the insert mating portion 348 of the adaptor flange 340. The proximal end of the insert 398 may project from the working end 344 of the insert mating portion 348. The proximal end of the insert 398 may project from the working end 344 of the insert mating portion 348 such that a ring bearing placed in the bearing receiving port 404 may be received onto a cylindrical stub 54 of an end-cap wall. As shown in FIG. 34B, this configuration of the adaptor flange 340 and insert 350 assembly 544 provides working access to the bearing receiving port 404 on the proximal end of the insert 398. The radial projection(s) 412 of the insert 350 are disposed and interlocked within the leading end groove(s) 368 of the adaptor flange 340. In this configuration 544, a bearing ring cage may be placed in the bearing receiving port 404, which may be disposed onto a cylindrical stub 54 of an end-cap wall.

Figure 48:
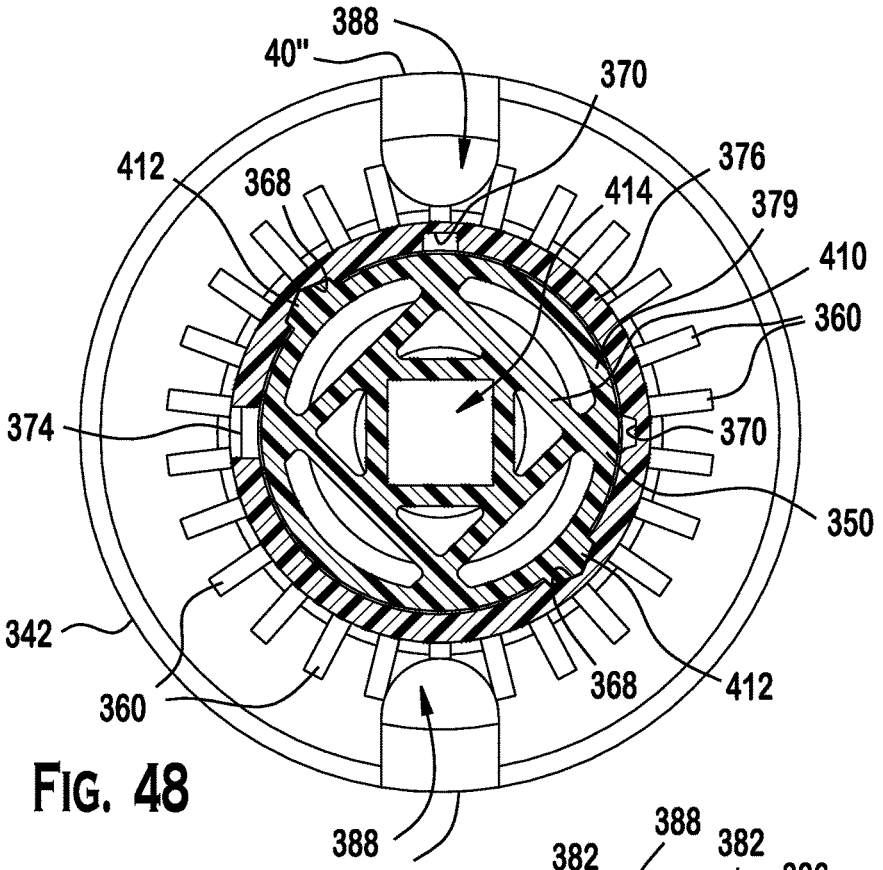
FIG. 48 is a cross-sectional view of the adaptor flange of FIG. 30 along line 48-48 of FIG. 34.
Figure 49:
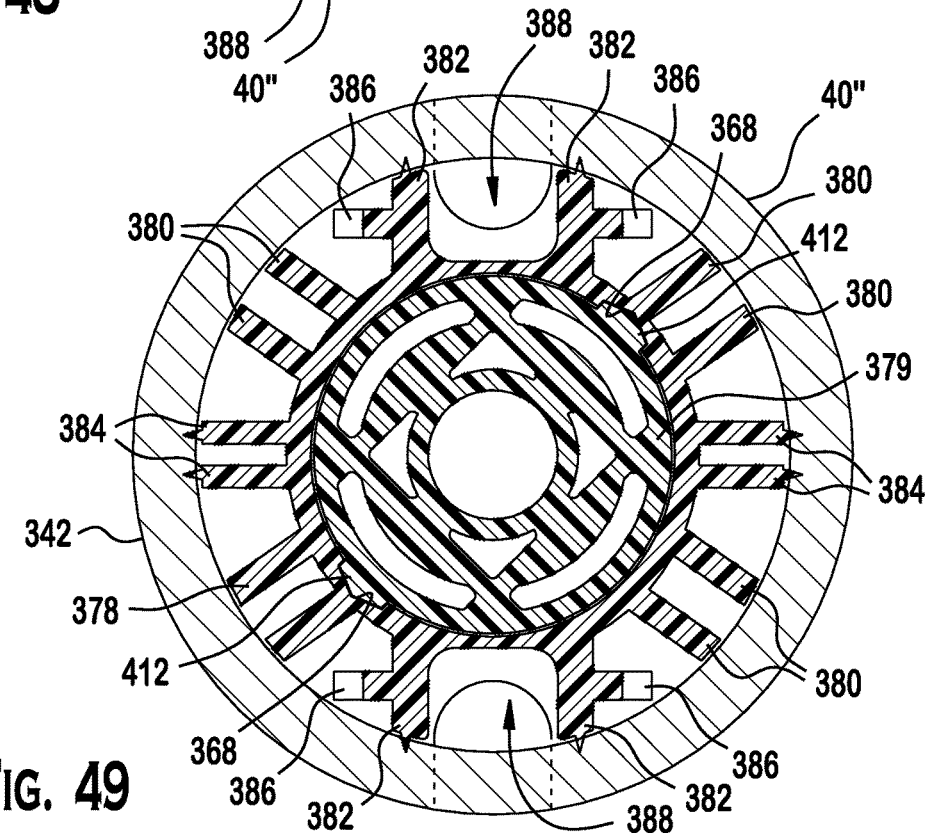
FIG. 49 is a cross-sectional view of the adaptor flange of FIG. 30 along line 49-49 of FIG. 34.

Referring to FIG. 34, another adaptor flange 376 and insert 350 assembly configuration 546 depicts the insert 350 after being placed within the adaptor flange 376 from the insert mating portion 348 with the proximal end 398 of the insert 350 facing inward. In this configuration 546, the bearing receiving port 404 is not available for use at the working end 344 of the insert mating portion 348 of the adaptor flange 376. Instead, the distal end 400 of the insert 350 is available for use at the working end 344 of the insert mating portion 348 of the adaptor flange 376. As shown in FIG. 34B, this configuration of the adaptor flange 376 and insert 350 assembly 546 provides working access to the driver receptacle 414 on the distal end of the insert 400. The radial projection(s) 412 of the insert 350 are disposed and interlocked within the leading end groove(s) 368 of the adaptor flange 376. The distal end 400 of the insert 350 may be flush with the working end portion 344 of the adaptor flange 376. In this configuration, the driver of a manual gearbox may be inserted into the driver receptacle 414 to rotate the adaptor flange 376 and insert 350 assembly 546. Referring to FIG. 48, internal structures 410 of the insert 350 strengthen (or reinforce) the assembly 546 from sheering forces and bending moments associated with a conventional tube connected to the tube mating portion 346 of the adaptor flange 376. In another operable configuration of the adaptor flange 376 in which the insert 350 is not used, one or more square cut grooves 370 may be used to interlock with an electric motor or spring assembly. Referring to FIG. 49, block(s) 380, primary rails 382, and secondary rail(s) 384 may bear on an interior surface(s) 62 of the conventional tube 40" so as to provide a mechanism for transferring rotational movement from the driver of a manual gearbox or other device.

Referring to FIG. 34, another adaptor flange 376 and insert 350 assembly configuration 548, depicts the insert 350 after being placed within the adaptor flange 376 from the insert mating portion 348 with the distal end 400 of the insert 350 facing inward. In this configuration 548, the bearing receiving port 404 is available for use at the working end 344 of the insert mating portion 348 of the adaptor flange 376. The proximal end of the insert 398 may project from the working end 344 of the insert mating portion 348. The proximal end of the insert 398 may project from the working end 344 of the insert mating portion 348 such that a ring bearing placed in the bearing receiving port 404 may be received onto a cylindrical stub 54 of an end-cap wall. As shown in FIG. 34B, this configuration of the adaptor flange 376 and insert 350 assembly 548 provides working access to the bearing receiving port 404 on the proximal end of the insert 398. The radial projection(s) 412 of the insert 350 are disposed and interlocked within the leading end groove(s) 368 of the adaptor flange 376. In this configuration 548, a bearing ring cage may be placed in the bearing receiving port 404, which may be disposed onto a cylindrical stub 54 of an end-cap wall.

Figure 35:
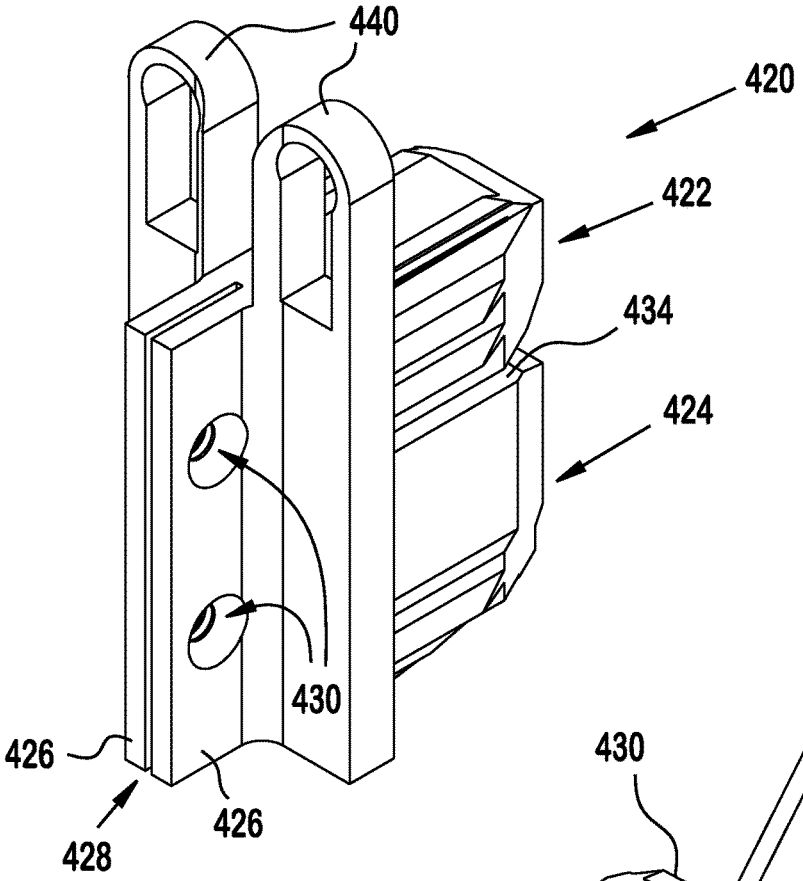
FIG. 35 is a front perspective view of an exemplary embodiment of an end piece of the present invention.

FIG. 35 shows another embodiment of an end piece 420 that may be used with a horizontal track 24 of the retractable awning system 12. The end piece 420 may include an upper guide plug 422 which is configured and dimensioned to form a press fit with the secondary accessory receiving channel 338 of the track 300. The end piece further may include a lower guide plug 424 which is configured and dimensioned to form a press fit with the primary accessory receiving channel 316 in the track 300. As described above, the end piece may include two planar members 426 and a slot 428 between the planar members 428 for receiving flexible barrier material 26. The planar members 426 may include fastener holes 430 for securing a flexible barrier material in the slot 428 between the planar members to form a flexible barrier material guide for a retractable wall system 12.

Figure 36:
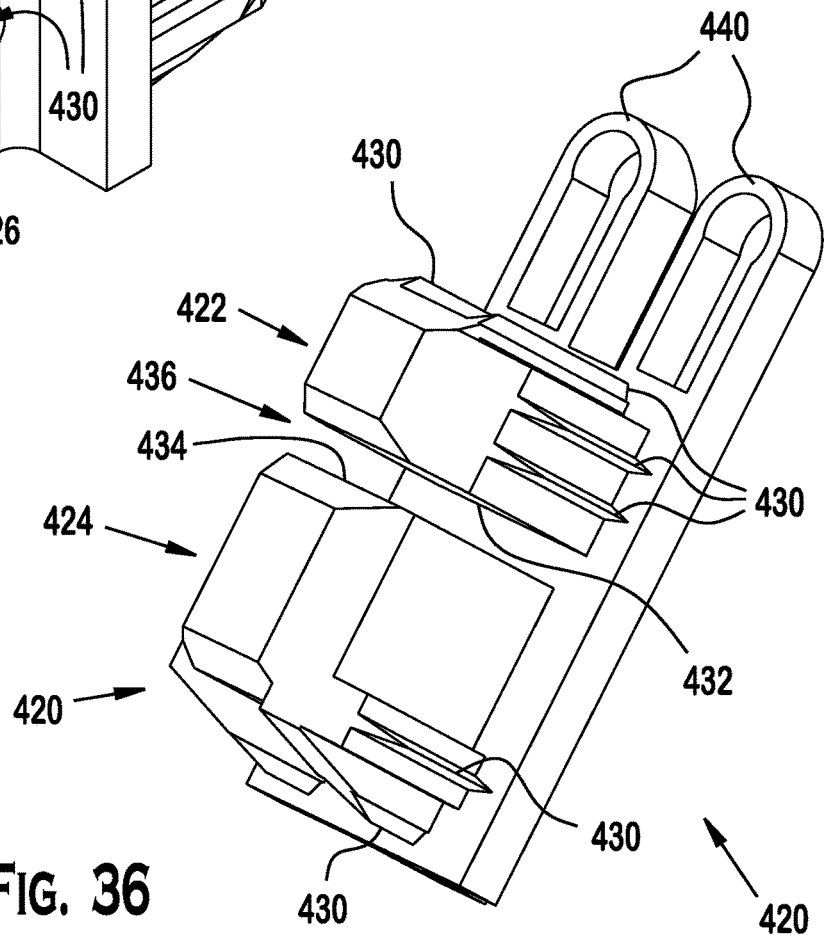
FIG. 36 is a rear perspective view of the end piece of FIG. 35.

FIG. 36 shows the end piece 420 from a rear perspective view. Visible from this view are fins 430 on the upper guide plug 422 and the lower guide plug 424 for helping to create a tight press fit between the plugs and their respective accessory channels. Additionally, opposing surfaces 432, 434 on the upper guide plug and the lower guide plug, respectively, may define a crevice 436 for receiving the track wall 438 (FIG. 24 and FIG. 25) that separates the primary accessory receiving channel 316 and the secondary accessory receiving channel 338. The end piece may further include a bumper 440. The bumper 440 may generally correspond to the profile of a portion of the track 300 that is situated next to the end piece 420.

Figure 42:
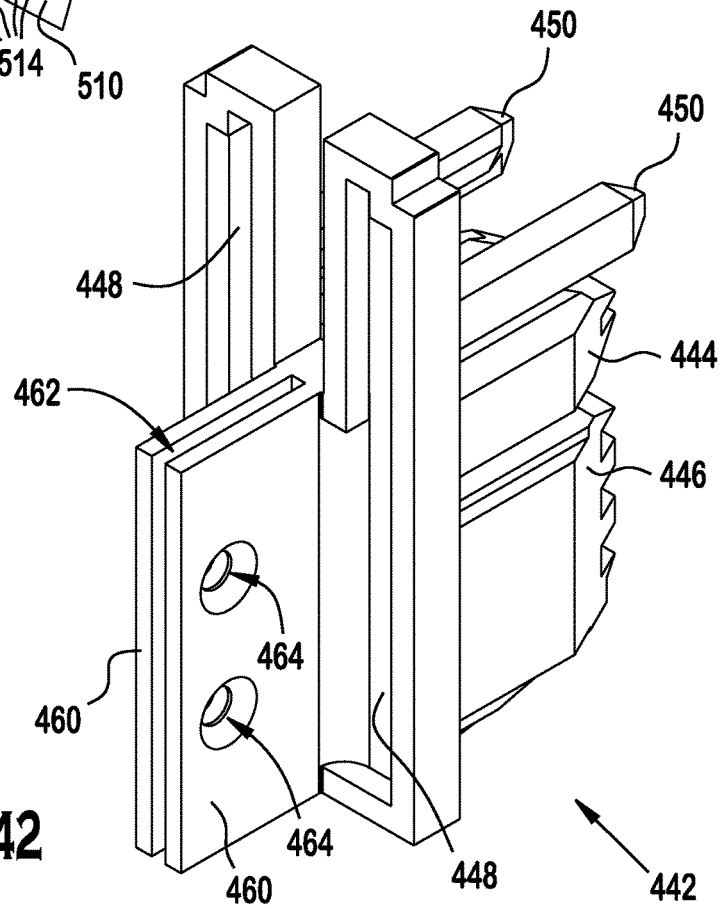
FIG. 42 is a front perspective view of another embodiment of an end piece of the present invention.
Figure 42B:
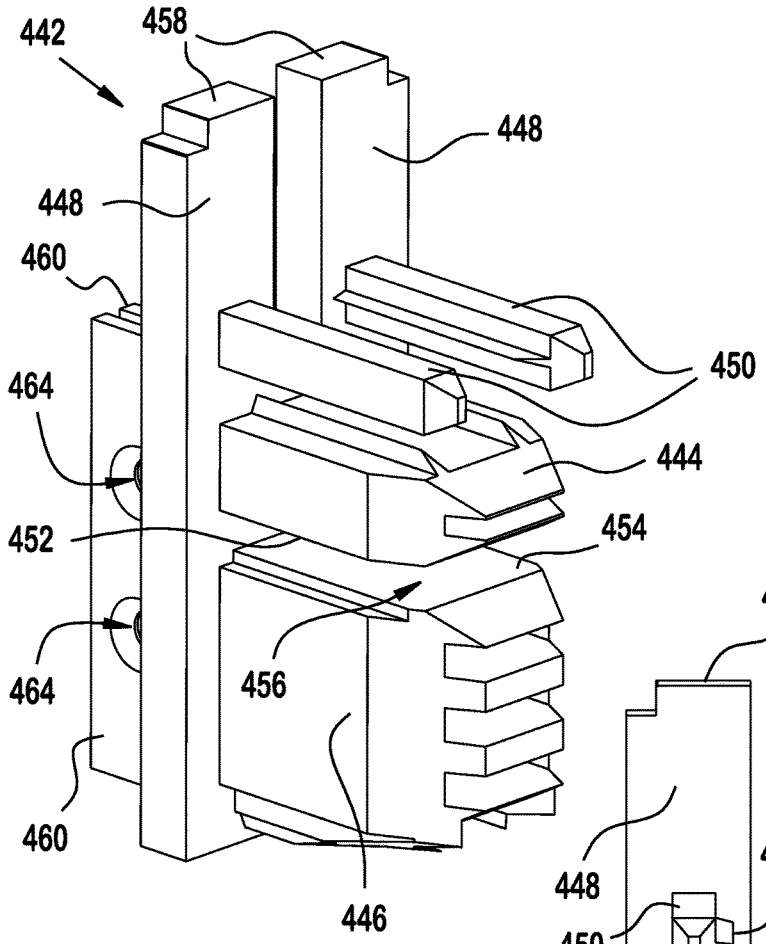
FIG. 42B is a rear perspective view of the end piece of FIG. 42.

FIG. 42, FIG. 42*b*, FIG. 43, FIG. 44 and FIG. 45 show yet another embodiment of an end piece 442. FIG. 42 and FIG. 42*b* show an end piece 442 which may be used with the track 300 of FIG. 24 and FIG. 25. The end piece 442 may include an upper guide plug 444 which may be configured and dimensioned to form a press fit with the secondary accessory receiving channel 338 of the track 300. The lower guide plug 446 may be configured and dimensioned to form a press fit with the primary accessory receiving channel 316 in the track 300. The end piece further may include a plate 448 and two prongs 450 extending from the plate. Furthermore, the end piece 442 may include opposing surfaces 452, 454 on the upper guide plug 444 and the lower guide plug 446, respectively, may define a crevice 456 for receiving the track wall 438 (FIG. 24 and FIG. 25), which may separate the primary accessory receiving channel 316 and the secondary accessory receiving channel 338. The end piece 442 may further include a bumper 458. The bumper 458 may generally correspond to the profile of a portion of the track 300 that is situated next to the end piece 442. Also, the end piece 442 may include two planar members 460 and a slot 462 between the planar members 460 for receiving flexible barrier material 26. The planar members 460 may include fastener holes 464 for securing flexible barrier material in the slot 462 to form a flexible barrier material guide for the retractable wall system 12.

Each prong 450 may be disposed on one side of the fabric receiving slot 462. Referring to FIG. 24 and FIG. 25, the prongs 450 may be configured and dimensioned to form a press fit with walls of the internal anchoring cavity 466 on the receiving portion 304 of the track 300. This may allow the cover 302 of the track 300 to be snapped into place after the end piece 442 has been installed into the receiving portion 304. This may have particular utility in allowing the retractable wall system 12 to be erected initially with receiving portion 304 only. Thereafter weight bars may be loaded into the primary accessory receiving channel 318. Then the cover 302 may be connected to the receiving portion 304 to complete the horizontal bar assembly.

Figure 43:
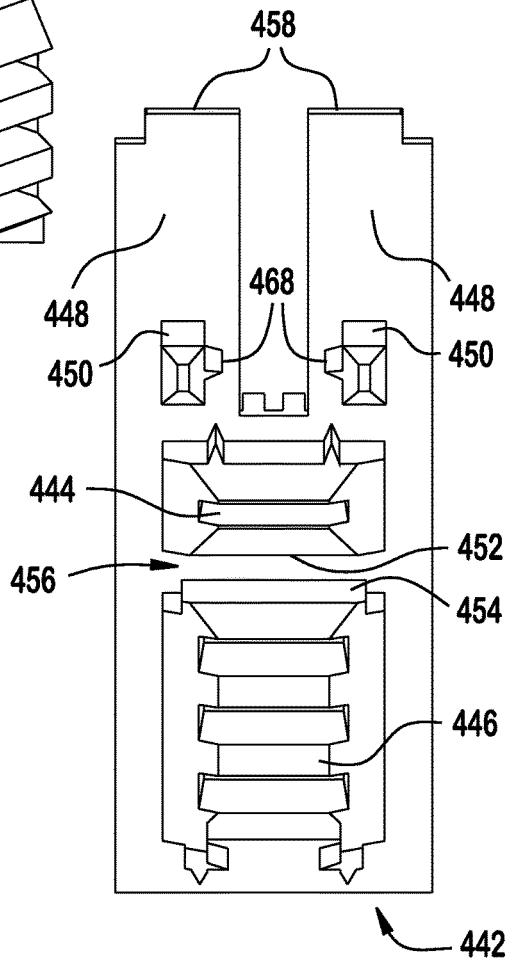
FIG. 43 is another rear perspective view of the end piece of FIG. 42.
Figure 44:
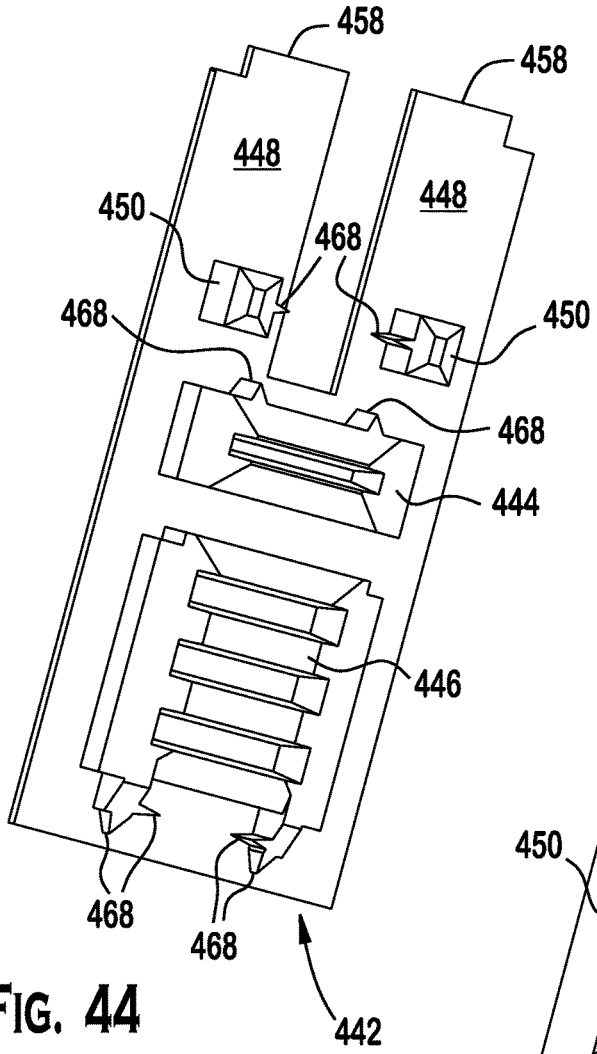
FIG. 44 is another rear perspective view of the end piece of FIG. 42.
Figure 45:
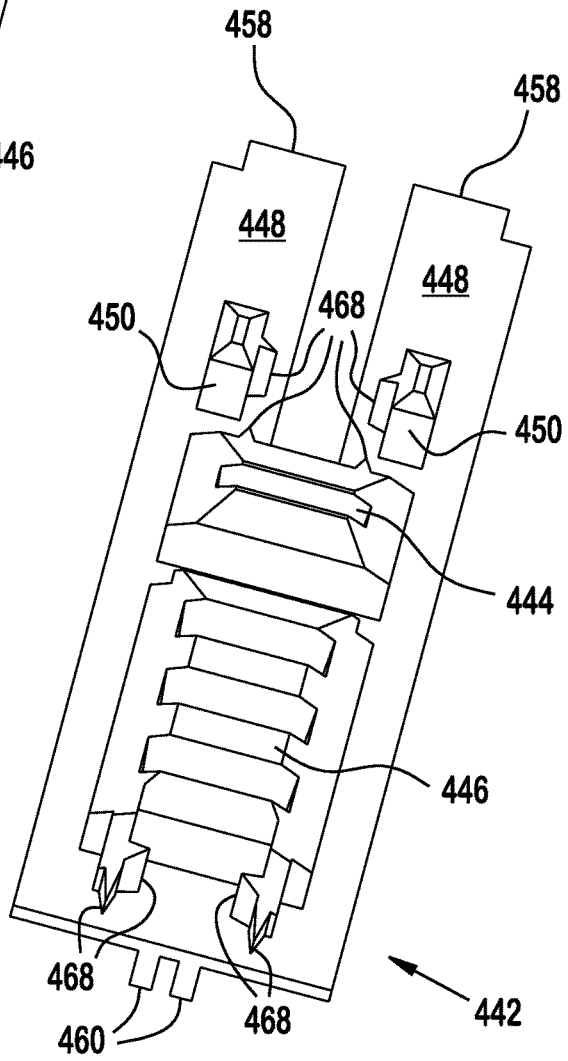
FIG. 45 is another rear perspective view of the end piece of FIG. 42.

FIG. 43, FIG. 44 and FIG. 45 show the end piece of FIG. 42 from various rear perspective views. Visible from these views are fins 468 on the upper guide plug 444 and lower plug 446 for helping to create a tight press fit between the plugs and their respective accessory channels. Fins 468 on the lower guide plug 446 may be positioned to form a press fit with the walls which form the tertiary accessory receiving channel 98, 224 (see e.g., FIGS. 10, 11 and 15). In this embodiment, the fins 468 are positioned to form a press fit with the receiving portion 304 only. Also, the fins 468 may be hard and sharp enough to score the track 300 to further provide a secure and tight fit. The bumper 458 may conform to the square cut of the two piece track 300 shown in FIG. 24 and FIG. 25.

Figure 37:
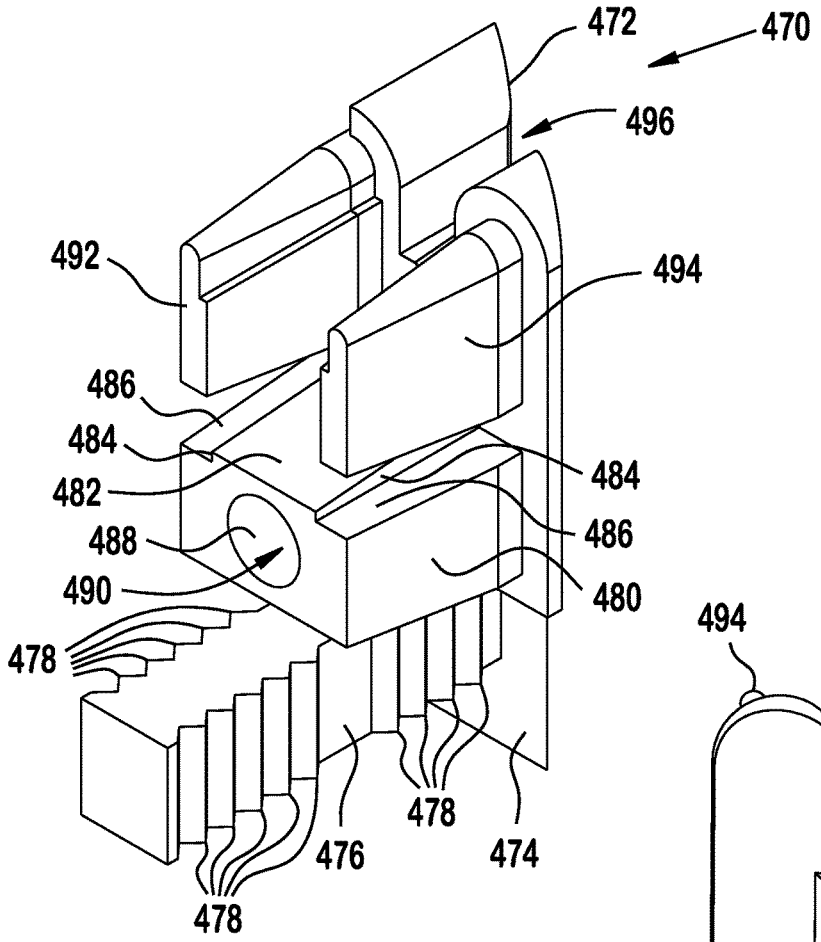
FIG. 37 is a bottom perspective view of an exemplary embodiment of an entry guide of the present invention.

FIG. 37 shows another embodiment of an entry guide 470. As previously described in connection with FIGS. 14 and 15, an entry guide 52, 470 may be inserted into the top end of the right side vertical track 22. A mirror image of the entry guide may be used for the left side vertical track 20. The entry guide 470 may be configured and dimensioned to create a press fit with the track 22 and stem 176 of the associated end cap 50. The entry guide may include an upper surface 472 and a lower surface 474, which is configured and dimensioned to abut the track when fully inserted into the track. The entry guide 470 further may include a stem 476, which projects from the lower surface 474 of the entry guide. The stem 476 may possess serrations (or teeth) 478 on its lateral sides. The stem 478 may be configured and dimensioned to form a press fit with the retention wall 312 and guide wall 314 in the primary accessory receiving channel 316 (FIG. 24). The entry guide 470 may further include a block 480 that is disposed adjacent to the stem 478 on the lower surface 474 of the entry guide. The block 480 may include a central landing 482 bounded by a pair of tapered risers 484 and treads 486 on one or more lateral faces of the block. The block 480 may further include a side wall 488 which extends from the rear surface of the block to an interior of the block. The side wall 488 may extend from the rear surface of the block to the upper surface 472 of the entry guide. The side wall 488 may form a through bore 490 that extends from the rear surface of the block to the upper surface of the entry guide. The through bore may have a central axis and a cross-sectional area perpendicular to the central axis. The cross-sectional area may be uniform or may vary through the entry guide. The through bore 490 may be sized for passage of an electrical motor cable or a steel tensioning cable. The size of the through bore 490 may be selected for the particular application. The block may be configured and dimensioned to form a press fit with the secondary accessory receiving channel 338. The entry guide 470 further may include a high side fitting 492 and a low side fitting 494 which may be configured and dimensioned to form a press fit with the upper channels of the track.

Figure 38:
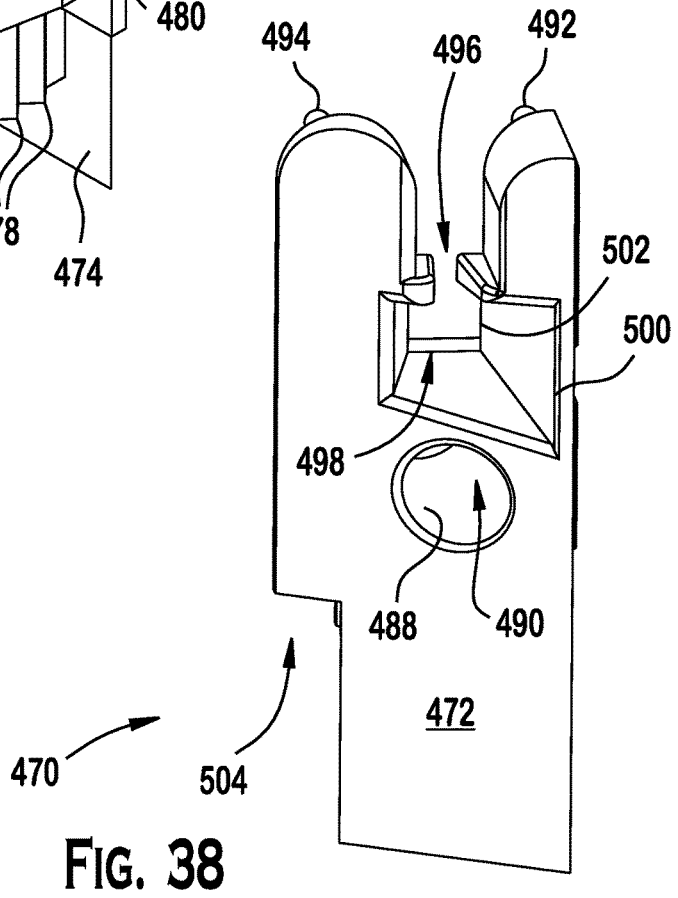
FIG. 38 is a top perspective view of the entry guide piece of FIG. 37.

Referring to FIG. 38, one side of the entry guide may be taller than a second side, and thus the upper surface 472 of the entry guide may form a diagonal surface that slopes from the high side to the low side of the entry guide. The entry guide may include a feed slot 496 and guide channel 498 disposed between the high side fitting 492 and the low side fitting 494. The feed slot 496 and guide channel 498 may taper from a wider opening 500 at the upper surface to a more narrow opening 502 at the lower surface of the entry guide. The through bore 490 is also visible in FIG. 38, along with the cut out 504 for the end cap stem.

Figure 39:
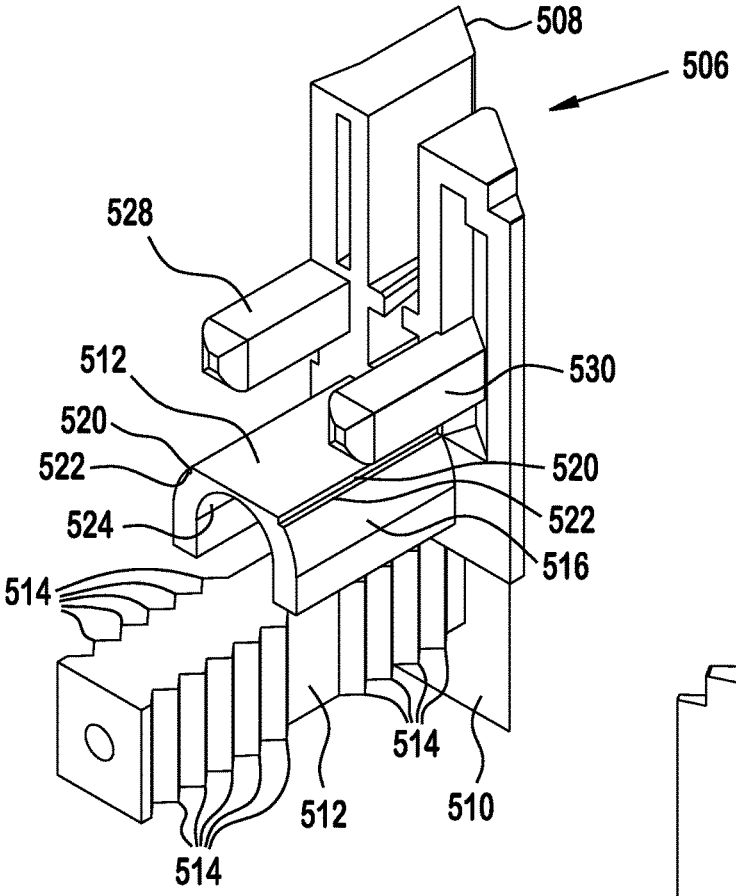
FIG. 39 is a bottom perspective view of another embodiment of an entry guide of the present invention.
Figure 40:
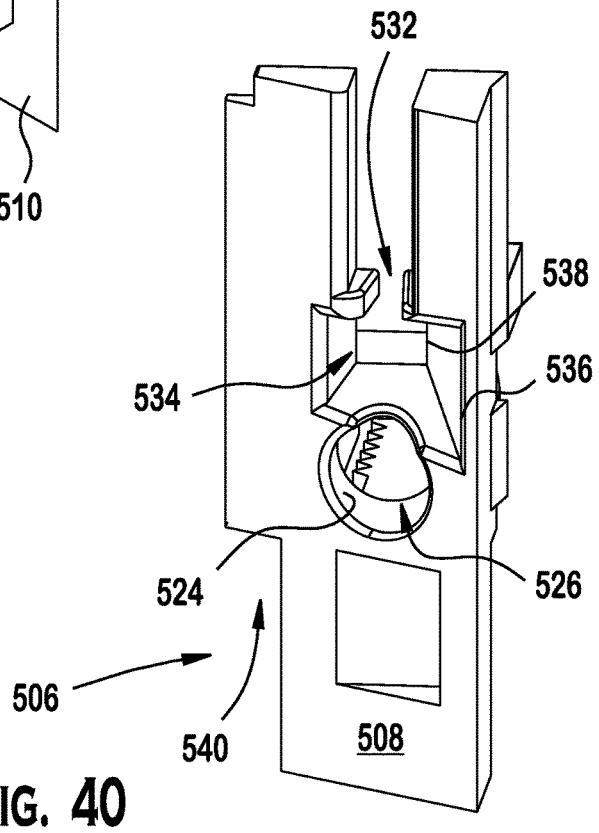
FIG. 40 is a top perspective view of the entry guide of FIG. 39.
Figure 41:
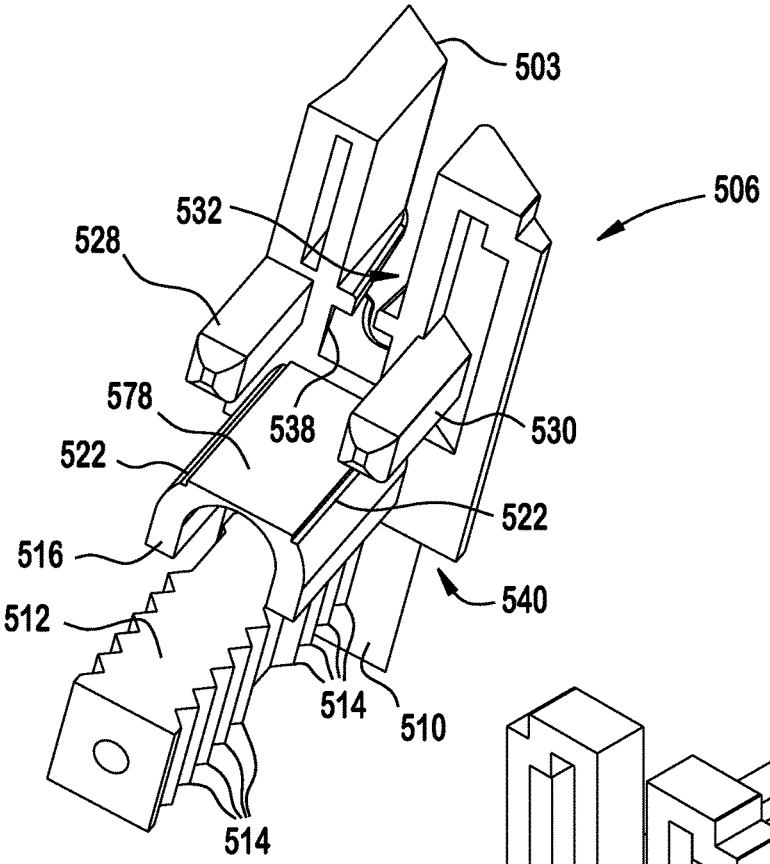
FIG. 41 is another bottom perspective view of the entry guide of FIG. 39.

FIGS. 39-41 show yet another embodiment of an entry guide 506 (or feeder clip 52). As previously described in connection with FIGS. 14 and 15 above, an entry guide 506 may be inserted into the top end of the right side vertical track. A mirror image of the entry guide 506 may be used for the left side vertical track. The entry guide 506 may be configured and dimensioned to create a press fit with the track 300 and stem of the associated end cap. The entry guide 506 may include an upper surface 508 and a lower surface 510, which is configured and dimensioned to abut the track when fully inserted into the track. The entry guide 506 may further include a stem 512 which projects from the lower surface 510 of the entry guide. The stem 512 may possess serrations (or teeth) 514 on its lateral sides. The stem 512 may be configured and dimensioned to form a press fit with the retention wall 312 and guide wall 314 in the primary accessory receiving channel 316 (FIG. 24). The entry guide 506 further may include a block 516 that is disposed adjacent to the stem 512 on the lower surface 510 of the entry guide. The block 516 may include a central landing 518 bounded by a pair of tapered risers 520 and treads 522 on one or more lateral faces of the block. The block may be configured and dimensioned to form a press fit with the secondary accessory receiving channel 339.

As shown in FIGS. 39-41, the block 516 of this entry guide may include a side wall 524 as described in connection with the embodiment of FIG. 37 and FIG. 38. Accordingly, a side wall may extend from the rear surface of the block to the upper surface of the entry guide. The side wall may form a through bore 526 that extends from the rear surface of the block to the upper surface of the entry guide. The through bore 526 may have a central axis and a cross-sectional area perpendicular to the central axis. The cross-sectional area may be uniform or may vary through the entry guide. The through bore may be sized for passage of an electrical motor cable or a steel tensioning cable. The size of the through bore may be selected for the particular application.

Referring to FIG. 39, the entry guide 506 may include a high side fitting 528 and a low side fitting 530 which may be configured and dimensioned to form a press fit with the walls of the internal anchoring cavity 466 on the receiving portion 304 of the track 300 (FIGS. 24 and 25). Such a configuration allows the cover 302 of the track 300 to be snapped into place after the end piece has been installed into the receiving portion 304. This may have particular utility in allowing the retractable wall system to be erected initially with the receiving portion 304 only. Thereafter cables may be strung through the bore in the block and the secondary accessory channel 339 of the track 300. The cover may be connected to the receiving portion 304 after the cable has been strung to complete the vertical track assembly.

Referring to FIG. 40 and FIG. 41, one side of the entry guide 506 may be taller than a second side, and thus the upper surface of the entry guide 506 may form a diagonal surface that slopes from the high side to the low side of the entry guide. The entry guide 506 may include a feed slot 532 and guide channel 534 disposed between the high side fitting 528 and low side fitting 530. The feed slot 532 and guide channel 534 may taper from a wider opening 536 at the upper surface to a more narrow opening 538 at the lower surface of the entry guide. Also, visible in FIG. 40 and FIG. 41 is the cutout 540 for the end cap stem.

Figure 50:
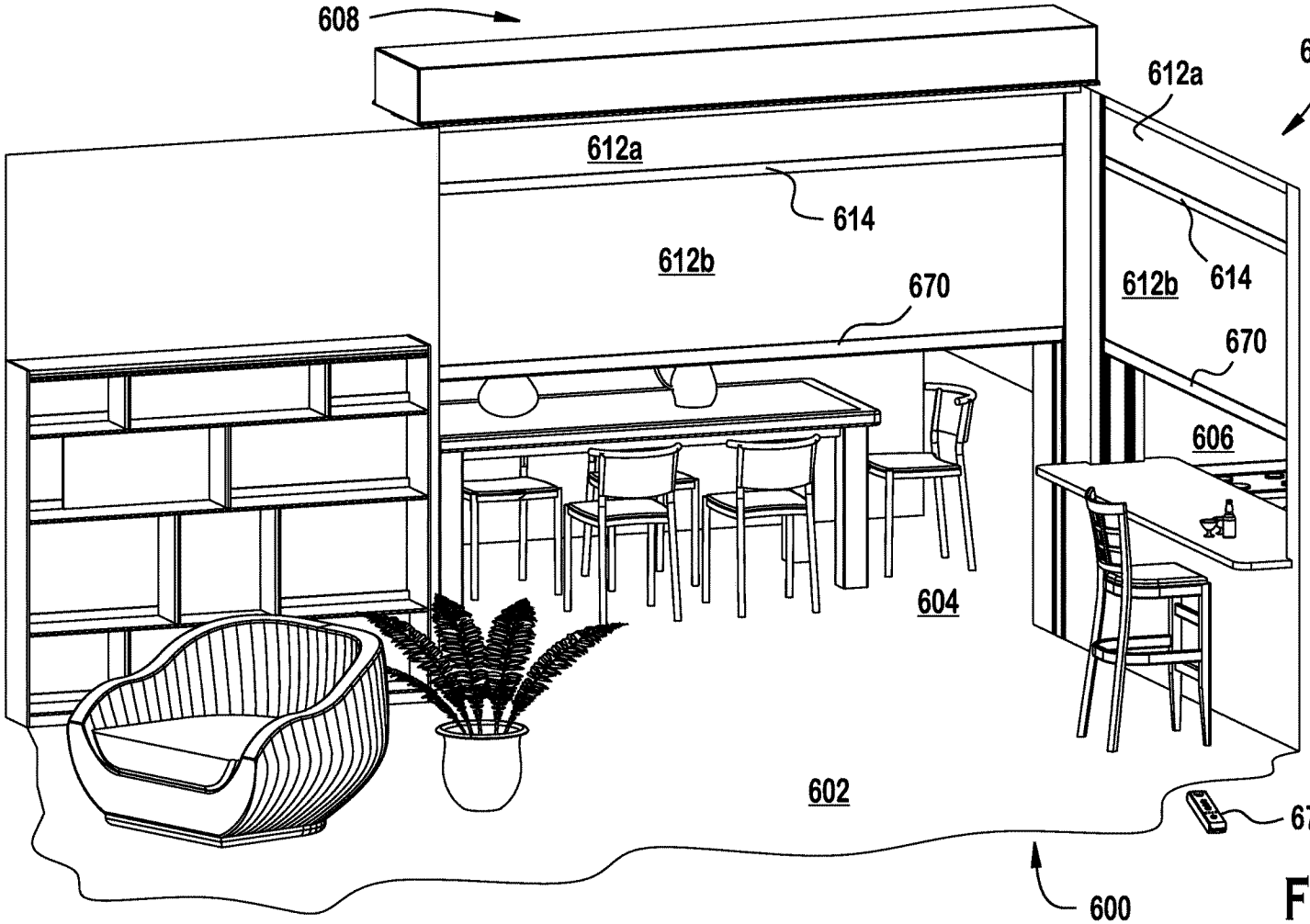
FIG. 50 is a perspective view of an illustrative group of interior rooms with two roll-up acoustic barrier systems in accordance with the present invention.

FIG. 50 shows an interior space 600 that includes a living room 602, a dining room 604 and a kitchen 606. A double track retractable wall system 608 is disposed between the living room and dining room. Another double track retractable wall system 610 is disposed between the kitchen and living room. The retractable wall systems 608, 610 may be roll up, designer, acoustic barriers. For example, the retractable wall systems may include several linked segments 612*a*, 612*b* of flexible barrier material. The linked segments may be fastened together by a center track assembly 614. The flexible barrier material 613 may include a layer of mass loaded vinyl and a layer of fabric. In such a fabric configuration, the mass loaded vinyl layer may provide sound blocking or dampening properties and the fabric layer may provide a screen printable surface for receiving a customized design. Each retractable wall system may be raised and lowered with an electric motor. The electric motor may be operated by a light switch and/or a remote control 616.

Generally, a retractable wall system may be implemented using a double track system to provide a roll up, acoustic barrier with enhanced sound blocking or dampening properties. Additionally, heavier or thicker segments of flexible barrier material may require new side tracks and guides as described below; whereas, lighter or thinner segments of flexible barrier material may be used with the tracks and guides previously described. For purposes of illustration, the roll-up acoustic barrier wall 608 located between the dining room and the living room may be constructed from thicker and heavier segments (e.g., 32 ounce mass loaded vinyl layer) and the roll-up acoustic barrier wall 610 located between the kitchen and the living room may be constructed from thinner and lighter segments (e.g., 8 ounce mass loaded vinyl layer). In both embodiments, the top box 618 may be placed within the ceiling and the side tracks may be flush mounted the conventional wall system.

Figure 51:
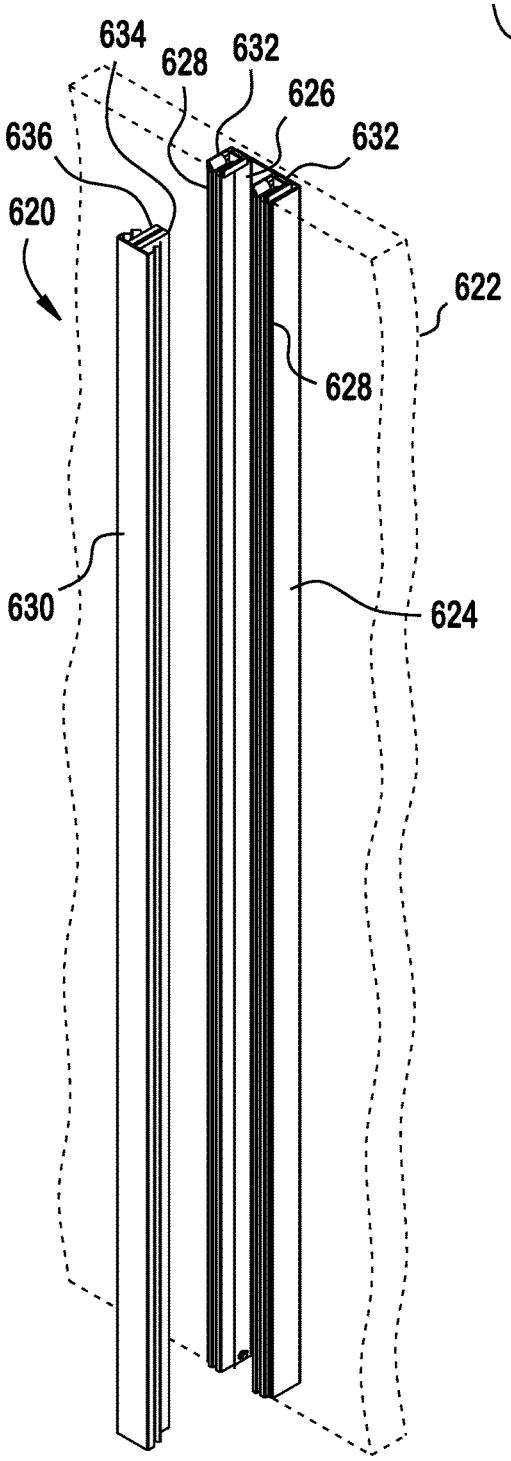
FIG. 51 is a perspective view of an exemplary embodiment of a vertical assembly of the roll-up acoustic barrier systems of FIG. 50.

FIG. 51 shows a vertical assembly 620 for the roll up, acoustic barrier shown between the dining room and living room of FIG. 50. The vertical assembly 620 may be positioned in an opening within a conventional wall system (e.g., a drywall or masonry wall) 622. The vertical assembly 620 may include a skeleton 624. The skeleton generally may have a U-shape and may be formed from sheet metal or other suitable structural materials. The skeleton may be wrapped with sound blocking material (e.g, 16 ounce mass loaded vinyl). The skeleton may be secured to structural elements (e.g., studs) of the conventional wall and may form an enclosure or structural support for the roll up, acoustic barrier.

The vertical assembly 620 further may include a center support 626, two side tracks 628, and an access cover 630. One side track may be fastened to each side of the center support. One or a screw more screws may be used to fasten the center support to the side track 628. The side track 628 may have threaded fastener holes for receiving the screws. The screws may be advanced into the side track from the inside of the center support. Preferably, the side tracks 628 may be formed from metal. For example, each side track may be formed from an aluminum alloy, such as, aerospace or cycling aluminum alloys. For instance, aluminum alloys 6005, 6361 or 6063 (International Alloy Designation System) may be preferred for forming part or all of the side tracks 628.

On top of each side track 628 may be an entry guide 632. The entry guide 632 may help feed the flexible barrier material 613 to and from the side track 628. The entry guide may be formed from metal, metal alloys, plastic, polymer materials, wood, ceramics or other suitable materials. For example, the entry guide may be formed from ABS plastic. The vertical assembly 620 may further include an access cover 630. The access cover 630 may further include a flat surface which extends between the side tracks. Additionally, the access cover may include a layer of sound blocking material 634 and one or more layers of sound absorbing materials 636.

Figure 52:
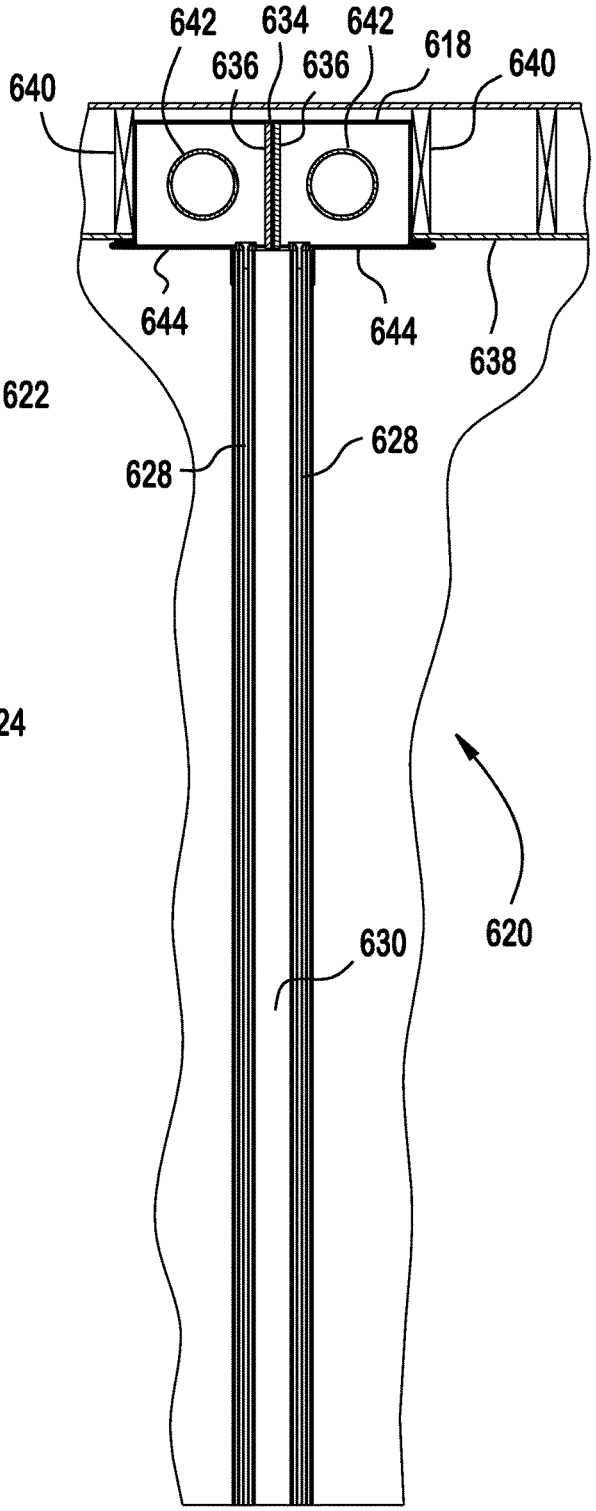
FIG. 52 is partial sectional view of an exemplary top box and the vertical assembly of FIG. 51.

Referring to FIG. 52, the roll up acoustic barrier may include a top box 618 located within the ceiling 638 of the structure. The top box may be formed from sheet metal and may be secured to ceiling joists 640 with fasteners. The top box may house a tube 642 for each retractable wall system in the roll up acoustic barrier. Each tube may be secured to brackets mounted in the top box and secured to structural members in the ceiling. The top box 618 further may include a layer of sound blocking material 634 and one or more layers of sound absorbing materials 636. The top box may be accessed from the outside of the acoustic barrier via removable access panels 644.

Figure 53:
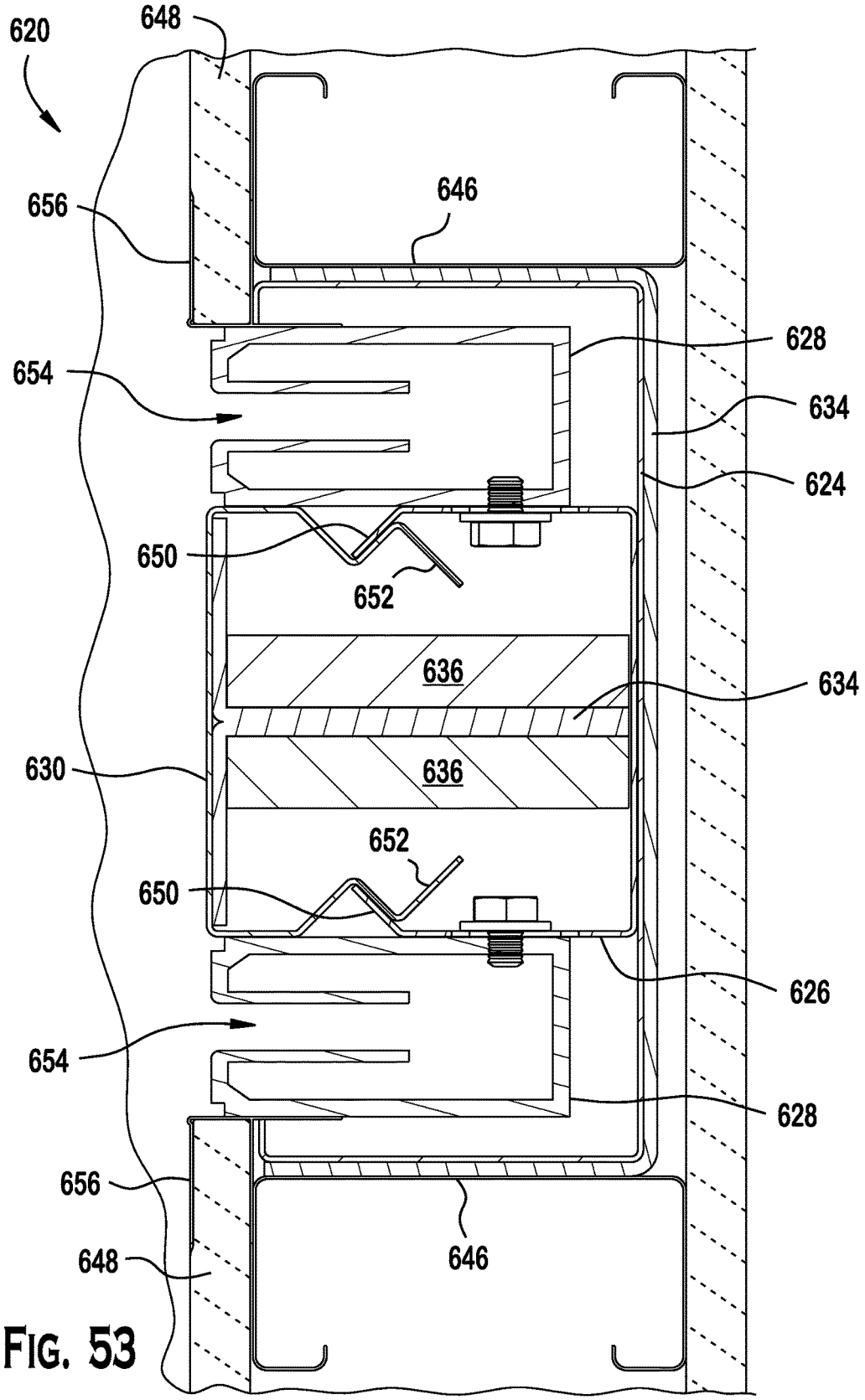
FIG. 53 is a cross-sectional view of the vertical assembly of FIG. 52.

FIG. 53 shows a cross-sectional view of an exemplary vertical assembly 620. The vertical assembly includes a skeleton 624, a center support 626, and two side tracks 628. The skeleton may be formed from sheet metal. The skeleton may form an enclosure for receiving the center support. The skeleton may include a layer of sound blocking material 634 on the outside of the enclosure. The sound blocking material may be mass loaded vinyl. The skeleton may be secured between two structural wall elements (e.g., studs) 646 that are used to frame the conventional wall system. The skeleton may be screwed to the studs. The skeleton may be contained inside the conventional wall. For example, the skeleton may abut drywall sheets 648 at the front opening of the enclosure. The center support may be screwed or otherwise secured to the skeleton. For example screws may be driven from inside the center support through the rear sidewall of the center support. The screws may advance into or through the abutting skeleton frame to fix the center support to the skeleton. The center support may be generally U-Shaped. The edges 650 of the center support may be bent inwardly to form a catch.

The center support 626 further may include an access cover 630 which interlocks with the catch to form a removable cover for the enclosure. The access cover may be constructed from same material and finish as the side tracks. The access cover 630 may include a tapered edge 652 which mates with the bent edges 650 of the center support (or catch) to retain the access cover on the center support. The access cover may include sound blocking 634 or sound absorbing material 636. These materials may be positioned within the enclosure to prevent transmission of sound waves around the flexible barrier members. For example, in FIG. 53 a layer of sound blocking material may be adhered to the front interior wall of the center support access cover. The sound blocking material may be positioned to form a continuous barrier extending across the front interior wall of the access cover. The sound blocking material further may be positioned to extend continuously to the rear wall of the center support.

The sound blocking material 634 may be, without limitation, mass loaded vinyl. For example, a one-half pound per square foot sheet of flexible mass loaded vinyl. In another example, the mass loaded vinyl may be one pound per square foot sheet of flexible mass loaded vinyl (e.g., B-10 R Noise Barrier). For instance, the mass loaded vinyl may be a flexible, reinforced loaded vinyl noise barrier with a nominal thickness of approximately 0.130 inches. The mass loaded vinyl may have a tensile strength of approximately 1470 pounds per square inch per ASTM D638. The mass loaded vinyl may have hardness of approximately 85+/−3, shore "A" per ASTM D2240. Additionally, the mass loaded vinyl may exhibit acoustical performance as provided in Table 1.

TABLE 1

Exemplary Sound Transmission Loss (STL) for Mass Loaded Vinyl Sheet

| | Octave Band Frequencies (Hz) | | | | | | |
|---|---|---|---|---|---|---|---|
| | 125 | 250 | 500 | 1000 | 2000 | 4000 | STC |
| STL | 13 | 17 | 22 | 26 | 32 | 37 | 26 |

Notes:
(a) Per ASTM E90 and ASTM E413

In other examples, without limitation, the mass loaded vinyl may be a one and one-half pound per square foot sheet of flexible mass loaded vinyl, or a two pound per square foot sheet of flexible mass loaded vinyl. Sound absorbing material 636 also may be positioned between the interior front wall of the access cover and the interior rear wall of the center support to further intercept fugitive sound emissions. Sound absorbing material, without limitation, may be sponge, fabric, fiber, fiberglass, sound dampening materials (above), or other suitable materials. Although, the sound blocking and sound absorbing materials may be arranged symmetrically within the enclosure, any configuration of these materials may be used to enhance the performance characteristics of the roll up, acoustic barrier.

The side tracks 628 may be secured to the center support. Each side track may have a rigid receiving channel 654 that opens to the front of the skeleton. A separate plastic or metal trim piece 656 may be clipped to the edge of the finish wall material (e.g., drywall) to provide a structural connection and square generally uniform finish to the track opening. The rigid receiving channel may be configured and dimensioned to receive an edge portion of the flexible barrier material. Although the side tracks may be formed from an aluminum alloy, other suitable materials such as steel, reinforced concrete, or reinforced polymer materials may be used to form the side tracks provided the resulting structural member possesses sufficient strength, smoothness, and chemical resistance for the application.

Figure 95:
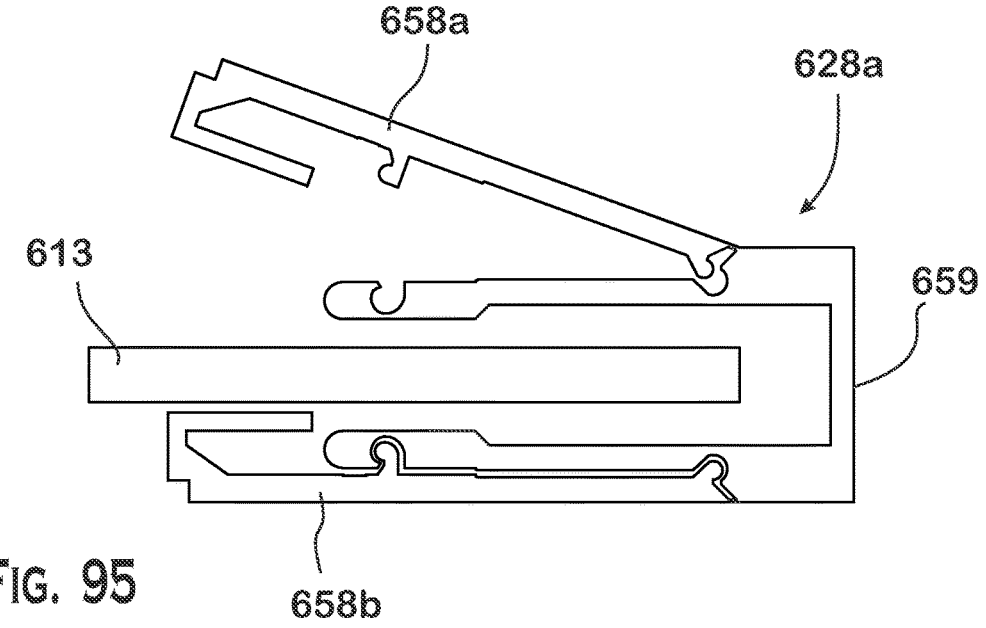
FIG. 95 is a cross-sectional view of another exemplary embodiment of a side track in accordance with the present invention.
Figure 96:
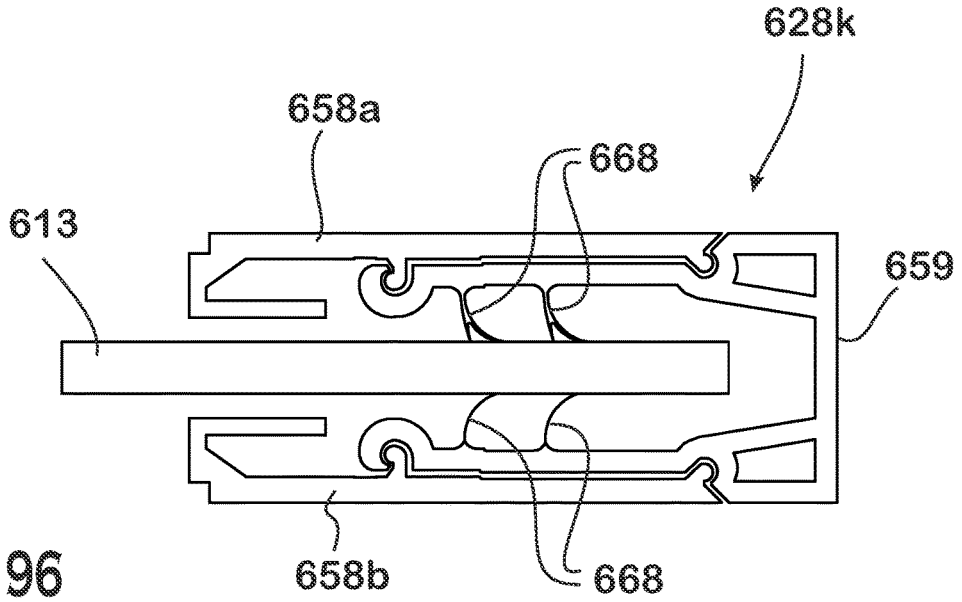
FIG. 96 is a cross-sectional view of another exemplary embodiment of a side track in accordance with the present invention.
Figure 97:
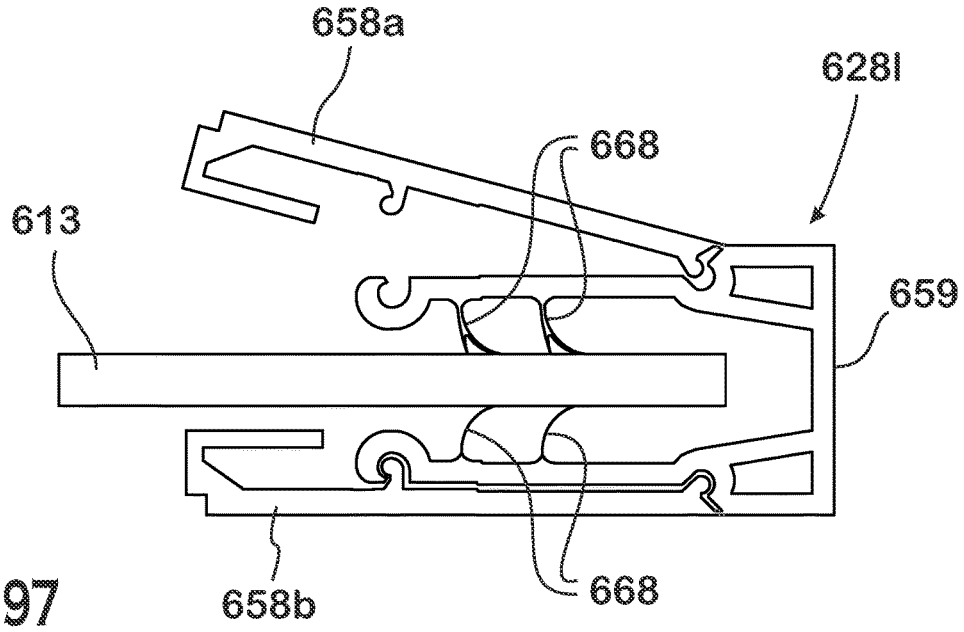
FIG. 97 is a cross-sectional view of another exemplary embodiment of a side track in accordance with the present invention.
Figure 98:
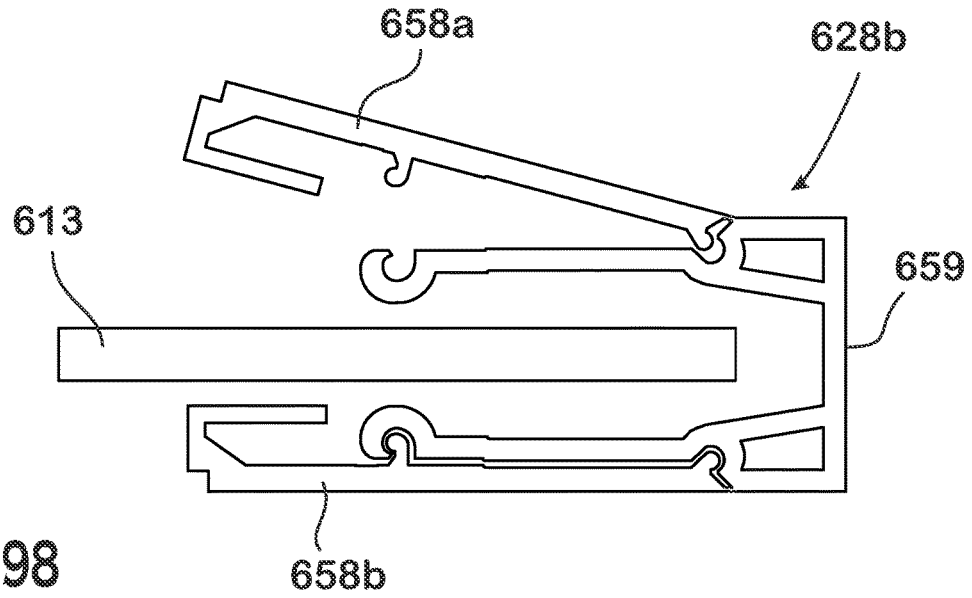
FIG. 98 is a cross-sectional view of another exemplary embodiment of a side track in accordance with the present invention.
Figure 99:
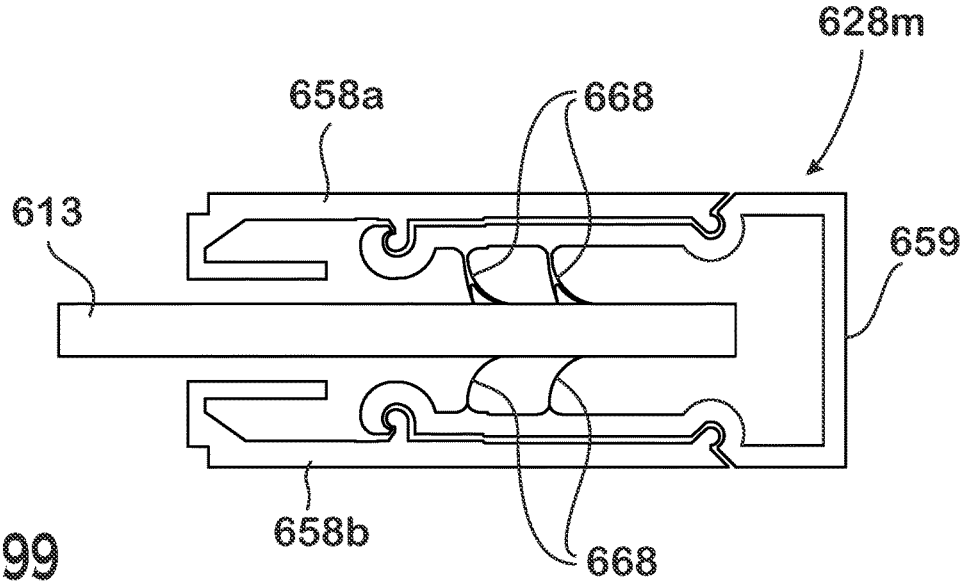
FIG. 99 is a cross-sectional view of another exemplary embodiment of a side track in accordance with the present invention.
Figure 100:
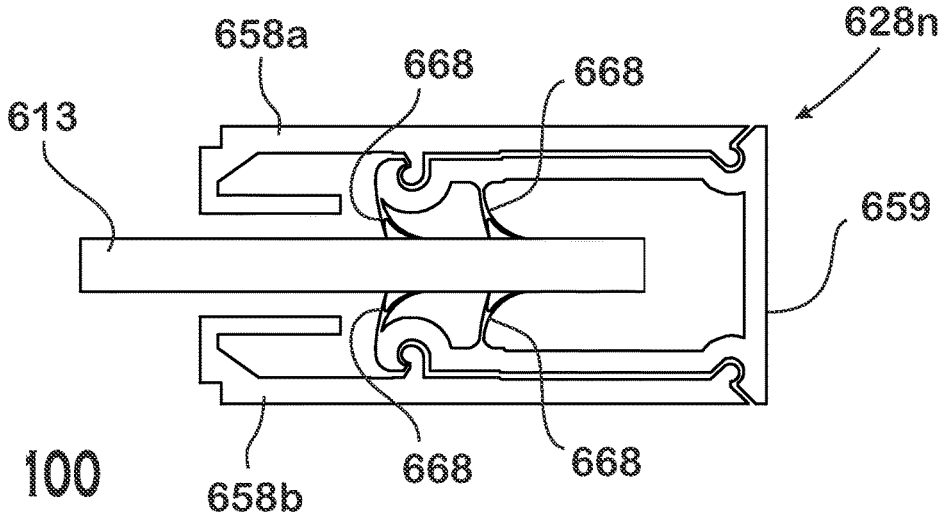
FIG. 100 is a cross-sectional view of another exemplary embodiment of a side track in accordance with the present invention.
Figure 101:
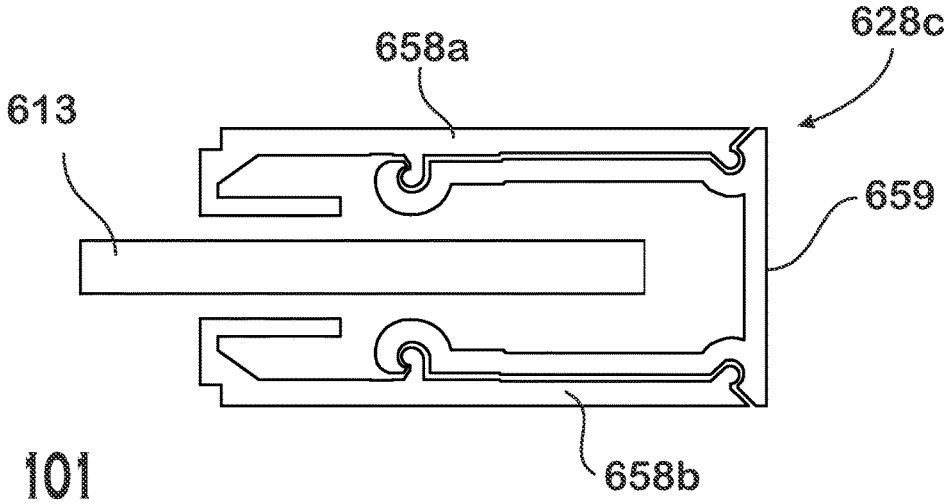
FIG. 101 is a cross-sectional view of another exemplary embodiment of a side track in accordance with the present invention.
Figure 102:
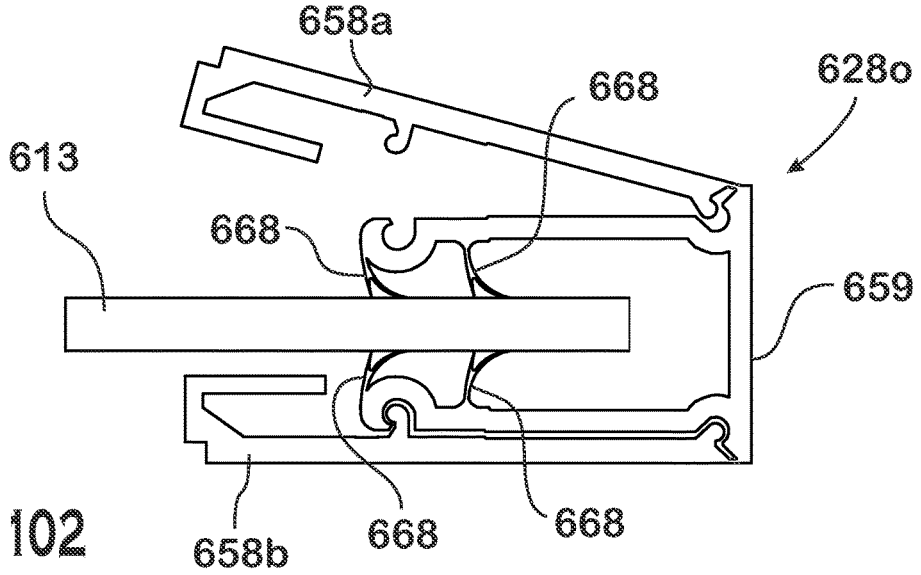
FIG. 102 is a cross-sectional view of another exemplary embodiment of a side track in accordance with the present invention.
Figure 103:
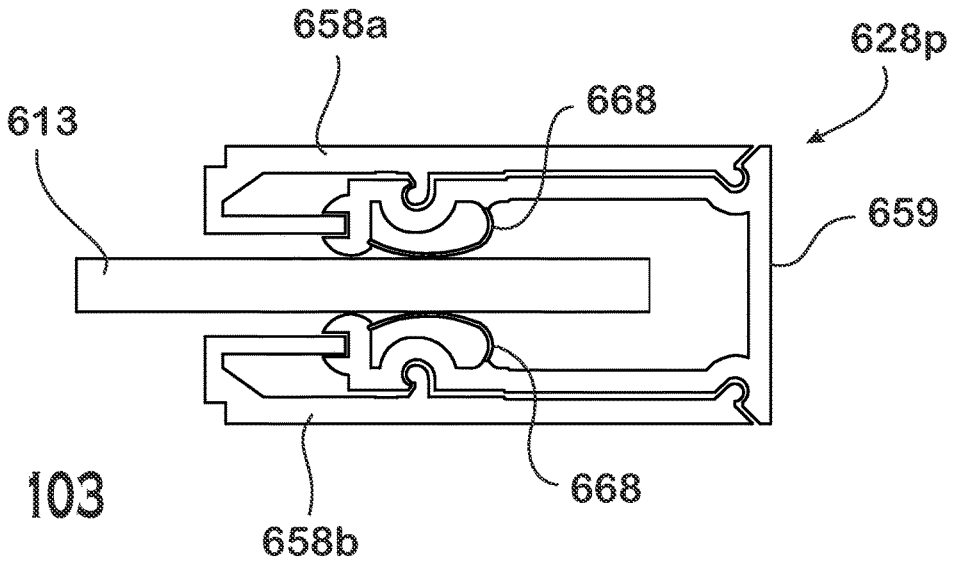
FIG. 103 is a cross-sectional view of another exemplary embodiment of a side track in accordance with the present invention.
Figure 104:
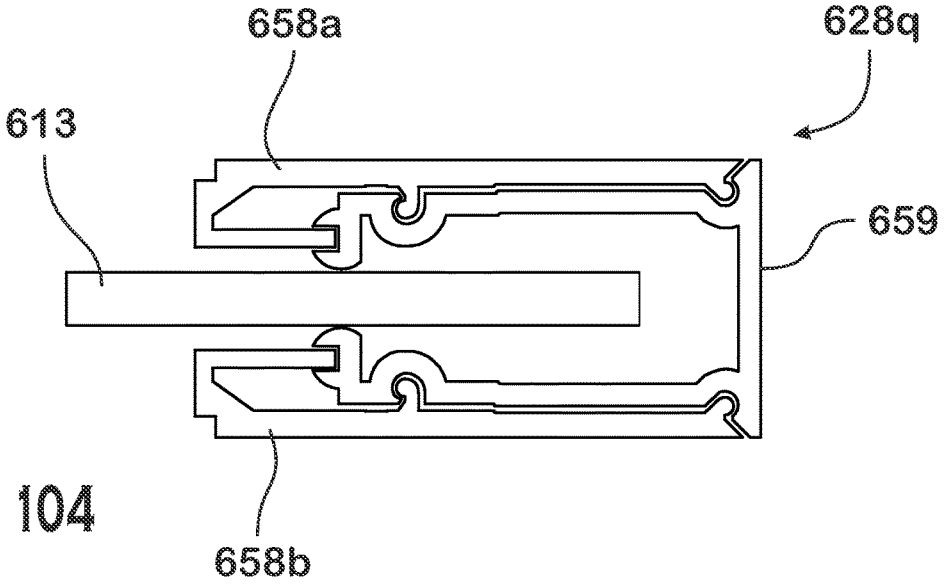
FIG. 104 is a cross-sectional view of another exemplary embodiment of a side track in accordance with the present invention.

As shown in FIG. 53, each side track 628 may be formed from a single member. In other embodiments, each side track may be formed from two or more members. For example, in FIG. 95, FIG. 98, and FIG. 101 each side track 628*a*, 628*b* may be formed from three components. The front portion of each side track may be formed by two opposing members 658*a*, 658*b*. The two opposing members may have the same shape. The rear portion of the side track further may be formed by another member 659 that connects with the two opposing members to form a side track. The three components may be joined by snap fit connections. Moreover, the rigid receiving channel further may include an internal anchoring cavity to help secure the flexible barrier material in the side track. For example, in FIG. 8, FIG. 24, FIG. 89, FIG. 90, FIG. 91 the side tracks 628*e*, 628*f*, 628*g* may include an internal anchoring cavity 660 to help secure the flexible barrier material 613 within the side track.

Figure 89:
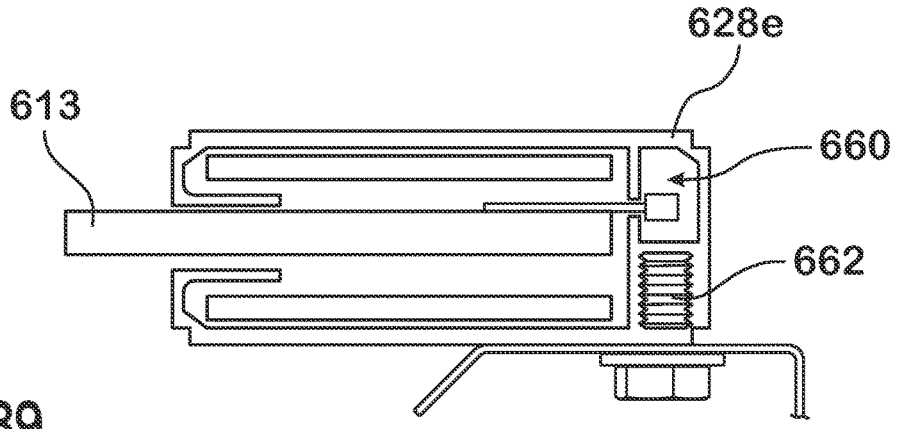
FIG. 89 is a cross-sectional view of another exemplary embodiment of a side track in accordance with the present invention.

In FIG. 89, the location of the internal anchoring cavity 660 may be fixed. In this embodiment, the side track further may include a threaded receptacle 662 and the center support may include an oval slot. The position of the side track may be adjusted in the slot before fixing the relative position of side track and the center support. This feature may assist in adjusting the position and/or tension of the flexible barrier member in the assembly.

Figure 90:
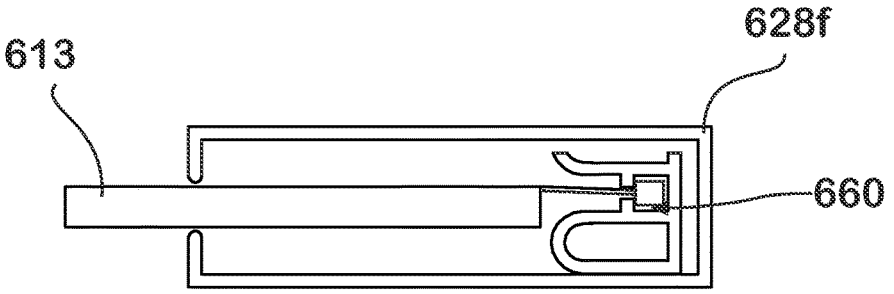
FIG. 90 is a cross-sectional view of another exemplary embodiment of a side track in accordance with the present invention.

In FIG. 90, the location of the internal cavity 660 may be fixed and the side track may be connected directly to the center support with a screw or similar device.

Figure 91:
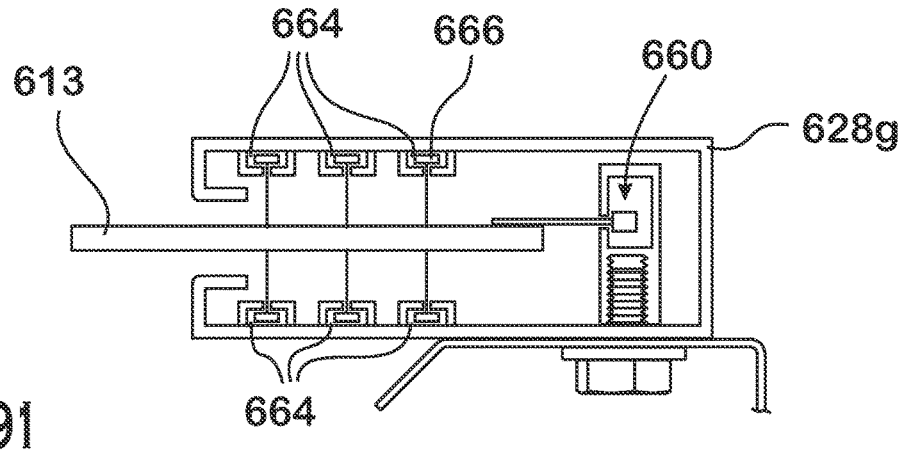
FIG. 91 is a cross-sectional view of another exemplary embodiment of a side track in accordance with the present invention.

In FIG. 91, the location of the internal anchoring cavity 660 with respect to the center support may be fixed in the same fashion as described in connection with FIG. 89. Additionally, the side track may include multiple channels 664 for receiving strips of resilient material. The strips of material 666 may be secured in the channels and may press against the flexible barrier material to help secure the flexible barrier material in within the side track. The strips of material may be made from plastic, polymer, or other suitable material. For example, the strips of material may include fiber brushes.

Figure 92:
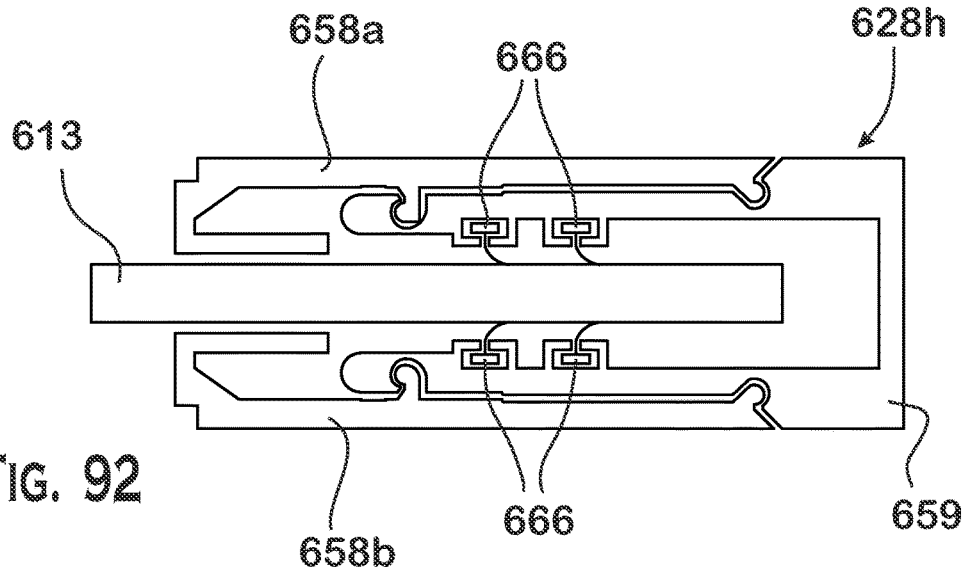
FIG. 92 is a cross-sectional view of another exemplary embodiment of a side track in accordance with the present invention.
Figure 93:
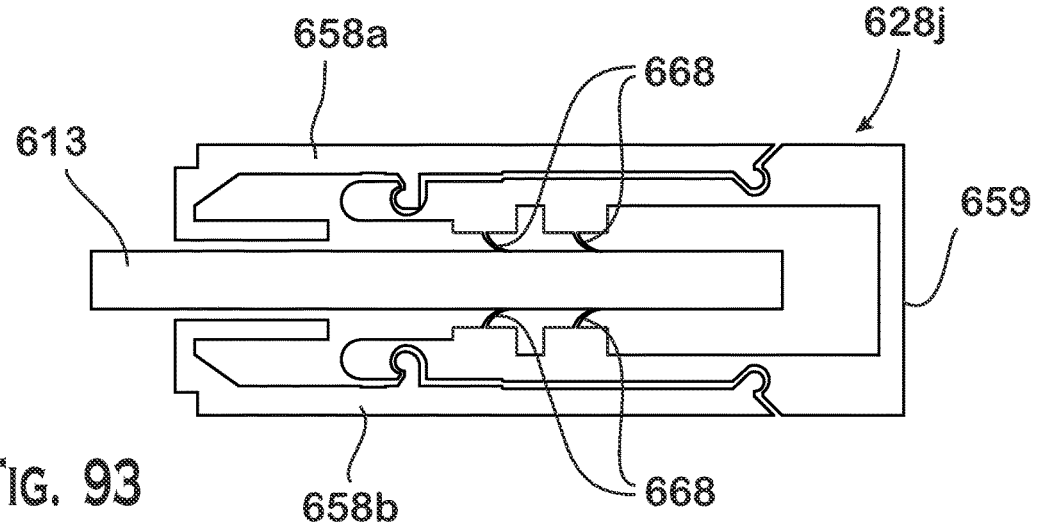
FIG. 93 is a cross-sectional view of another exemplary embodiment of a side track in accordance with the present invention.
Figure 94:
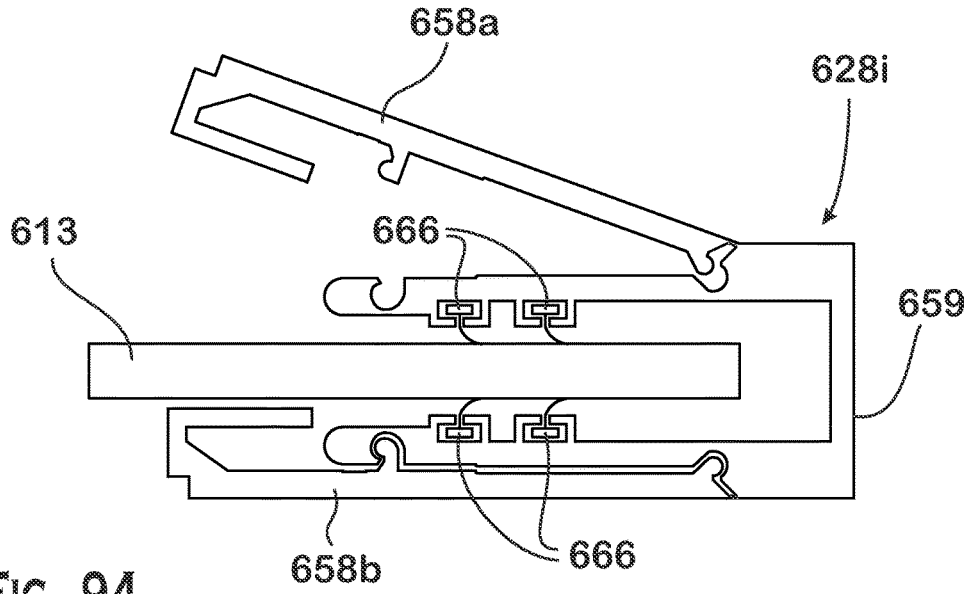
FIG. 94 is a cross-sectional view of another exemplary embodiment of a side track in accordance with the present invention.

In FIG. 92 and FIG. 94 the side tracks 628*h*, 628*i* may include similar channels and retaining elements, which may press against the flexible barrier material to secure the flexible barrier material within the side track.

In FIG. 93, FIG. 96, FIG. 97, FIG. 99, FIG. 100, FIG. 102, FIG. 103 and FIG. 104 the retaining elements 668 may be formed integrally with the side track. For example, the front portion of these side track(s) may be formed from aluminum (as previously described) and the rear portions may be formed from a reinforced polymer material. The retaining elements 668 in these embodiments may be formed from reinforced polymer material during formation or extrusion of the rear portion. Alternatively, the retaining elements may be formed from a rubber or polymer material molded over the rear portion in an over-molding process. The retaining elements may press against the flexible barrier material 613 to secure the flexible barrier material within the side track.

Figure 54:
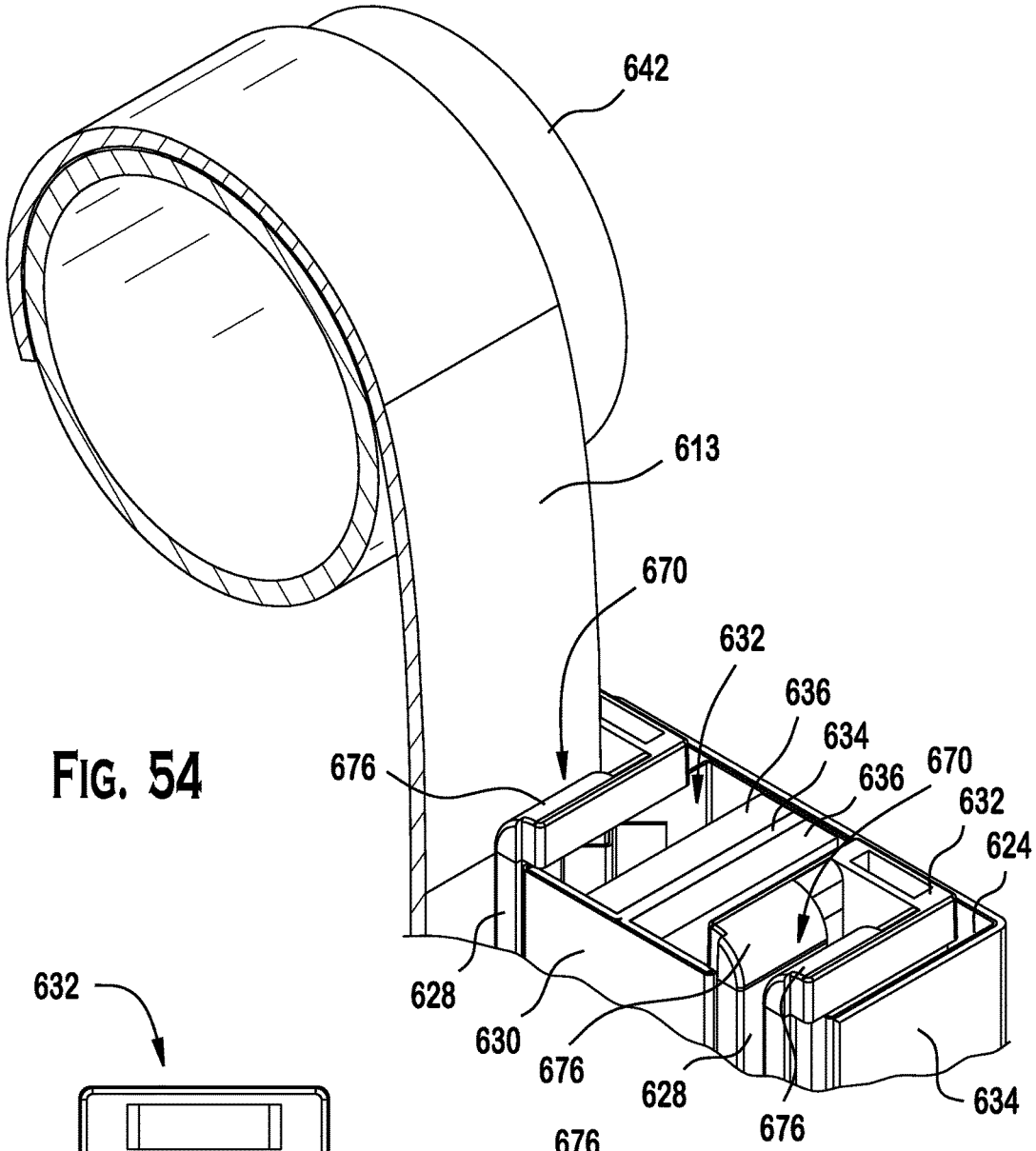
FIG. 54 is a schematic view of an exemplary tube and flexible barrier material in relation to the vertical assembly of FIG. 3.
Figure 55:
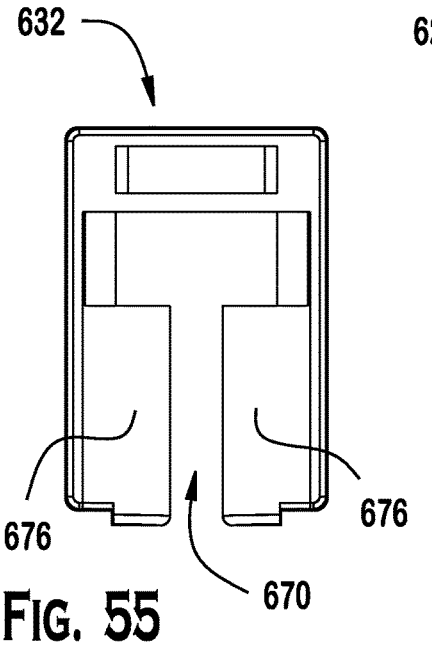
FIG. 55 is a top view of an exemplary embodiment of an entry guide of the vertical assembly of FIG. 51.
Figure 56:
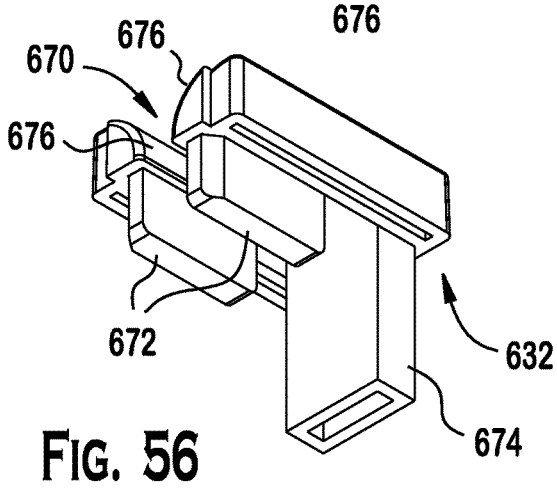
FIG. 56 is a bottom perspective view the entry guide of FIG. 55.

Referring to FIG. 54, as previously described, one end of the flexible barrier material 613 may be secured to the tube 642. The opposite end of the flexible barrier membrane may be threaded through a feeder clip (or entry guide piece) 632. As shown in FIG. 54 and FIG. 55, the entry guide piece may possess a central slot 670 which generally matches the dimensions of the rigid receiving channel. The entry guide piece may be inserted into the end of the side track nearest the tube. Referring to FIG. 56, the entry guide piece may be secured within the side track by projections 672, 674 that wedge into open spaces in the sidetrack. For example, the entry guide piece may include a pair of generally parallel projections 672 which are configured and dimensioned to wedge in between the outer wall of the side track and the inner wall of the sidetrack that forms one side of the rigid receiving channel. Additionally, another projection 674 disposed perpendicular to the longitudinal axis of the parallel projections may wedge between the outer walls of the side track.

The entry guide piece 632 may be formed from plastic or polymer material, however, metal, wood, ceramic or other materials may be used to form the entry guide piece provided the guide surfaces are smooth and free of sharp edges which may cut or damage the flexible barrier material as it is moved through the central slot 670. Although the entry guide piece of FIG. 54, FIG. 55 and FIG. 56 is generally U-shaped the entry guide piece may take any suitable form provided that a guide surface 676 is presented to facilitate travel of the flexible barrier material between the tube and side track. For instance, the entry guide piece may be formed from two separate parallel caps.

Figure 57:
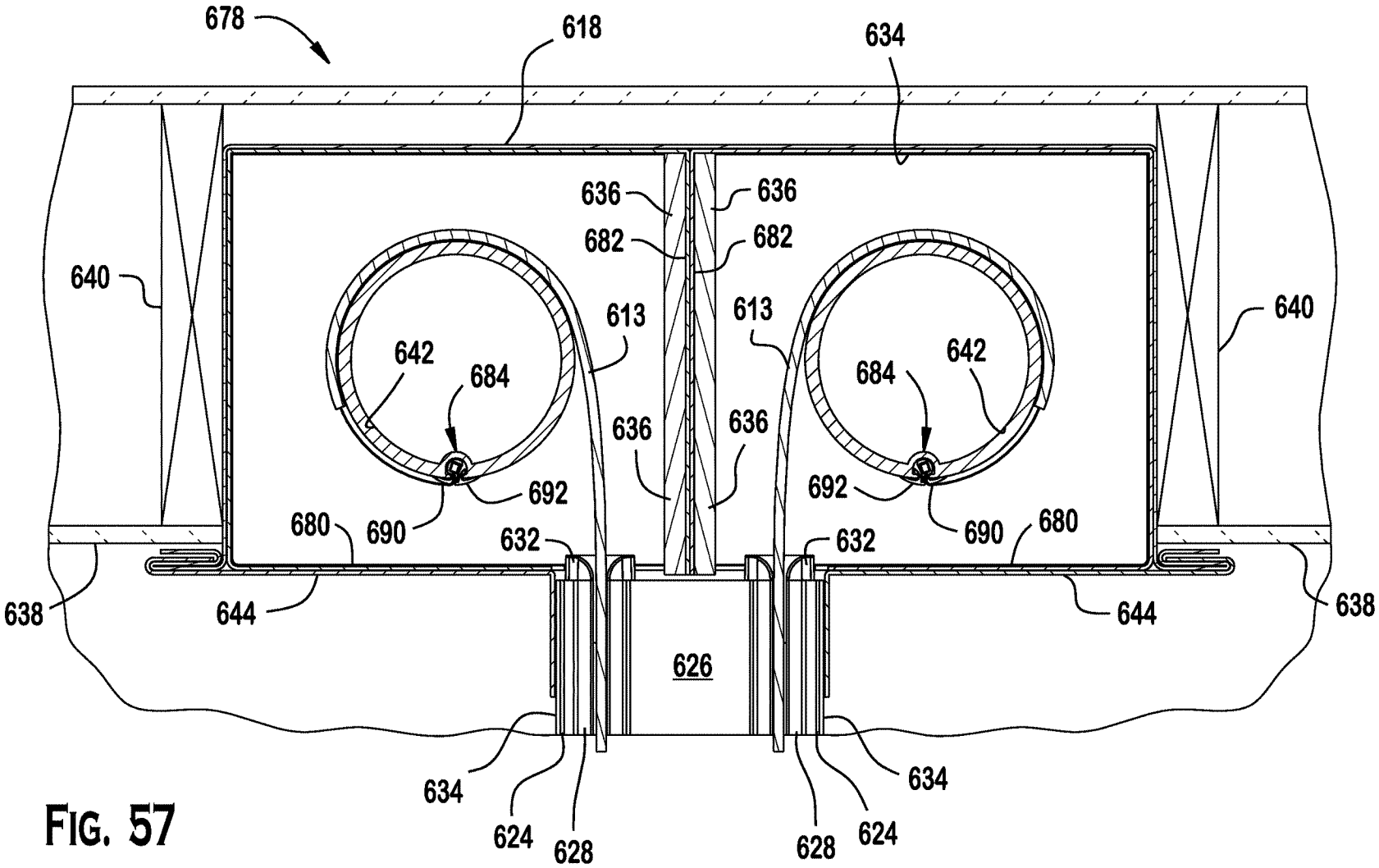
FIG. 57 is schematic view of the top box and the vertical assembly of FIG. 52 in a lowered configuration.

FIG. 57 shows an exemplary top box assembly 678 of an illustrative roll up acoustic barrier system in a lowered configuration. The top box assembly 678 may include a top box (or upper housing) 618 which may contain parallel tubes 642 and associated mounting hardware (e.g., mounting brackets and adaptors) and electrical motors, and springs as previously described (e.g., FIG. 2). The top box 618, which may be formed from sheet metal, may be positioned between adjacent ceiling joists 640 and fastened to these structural elements. Mounting brackets for hanging the tubes 642 may be secured to structural cross braces installed between the ceiling joists.

The top box 618 may be lined with a layer of sound blocking material 634. For example, the sound blocking material 634 may be a mass loaded vinyl sheet that is glued to the inner walls of the top box. The sound blocking material may extend beyond opposing end walls of the top box such that the sound blocking material encloses nearly all of the top box enclosure. Extension flaps 680 of sound blocking material may be held in place by an access panel 644. The access panel may be formed from sheet metal. The sound blocking material 634 further may include two internal panels 682 that divide the top box into two compartments, in which one tube may be located in each compartment. The internal panels may be glued, welded or otherwise connected together. Additionally, sound absorbing material 636 may be positioned about the internal panel 682 to further trap fugitive sounds from passing through acoustic barrier via the top box assembly.

Figure 59:
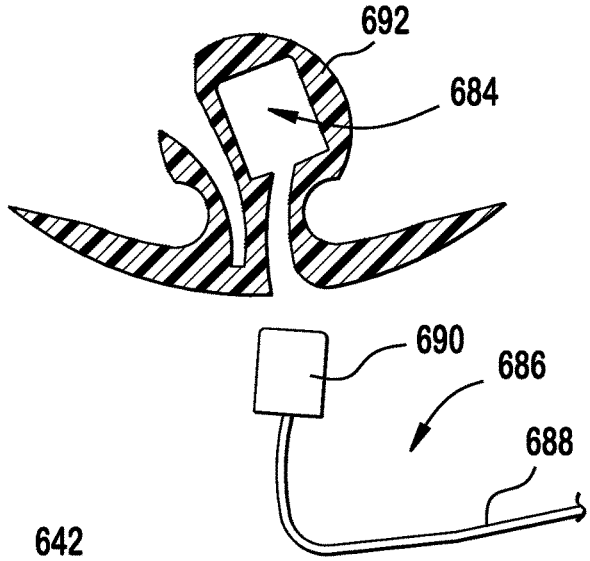
FIG. 59 is an exemplary embodiment of a tube connector insert and zipper in accordance with the present invention.
Figure 60:
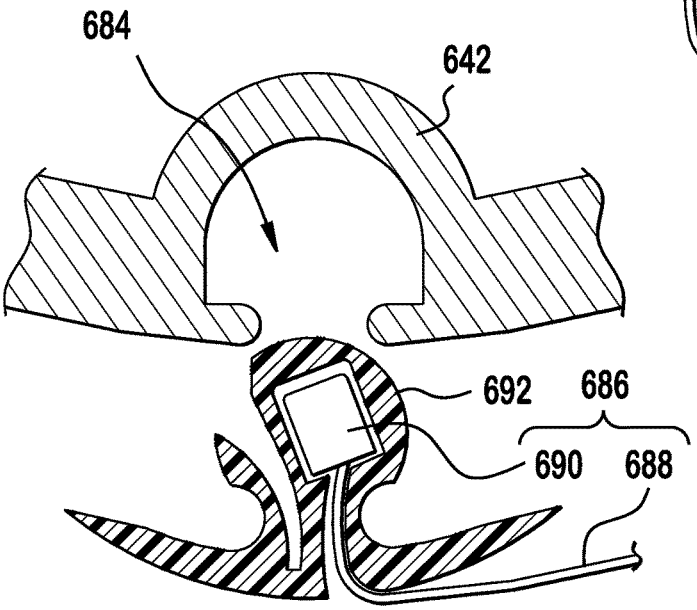
FIG. 60 is a schematic view of an exemplary tube and the tube connector insert and zipper of FIG. 59 in an assembled configuration.
Figure 61:
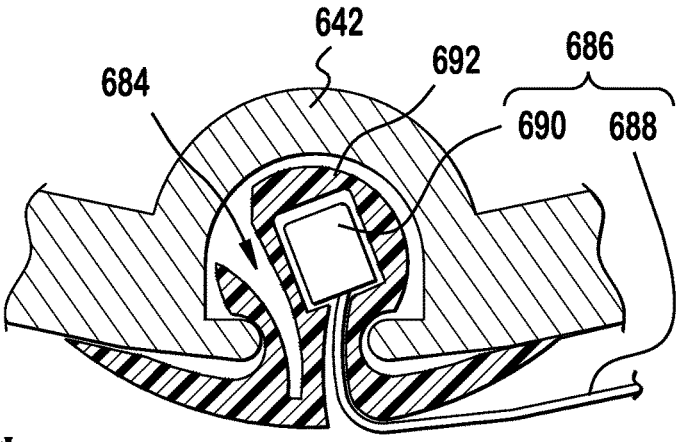
FIG. 61 is a schematic view of the tube, tube connector insert, and zipper of FIG. 60 in an assembled configuration.

Each tube 642 may connect to a roll of flexible barrier material 613 which passes through the entry guide piece 632 and into the side track 628. Each tube may include a recess 684 for securing the tube to the flexible barrier material. In this embodiment, the flexible barrier material includes a zipper 680. The zipper 686 further may include a ribbon portion 688 and a securing element portion 690. The securing element portion 690 may be connected to an insert 692 (e.g., received in a channel within the insert). Referring to FIG. 59, FIG. 60 and FIG. 61, the zipper 686 may be connected to an insert (or intermediate component) 692, which in turn may be secured to the tube 642. As shown in FIG. 61, the insert 692 may form a press fit connection with the recess 684. This press fit system may allow the tube 642 to be installed within the top box 618 before connecting the flexible barrier material 613 to the tube 642 because the flexible barrier material would otherwise need to be slid into the recess 684 from the side of the tube. Other fastening techniques, however, may be used to connect the flexible barrier material 613 to the tube 642. For example, the tube may include threaded holes for receiving screws which may be used to secure the ribbon to the tube.

Figure 58:
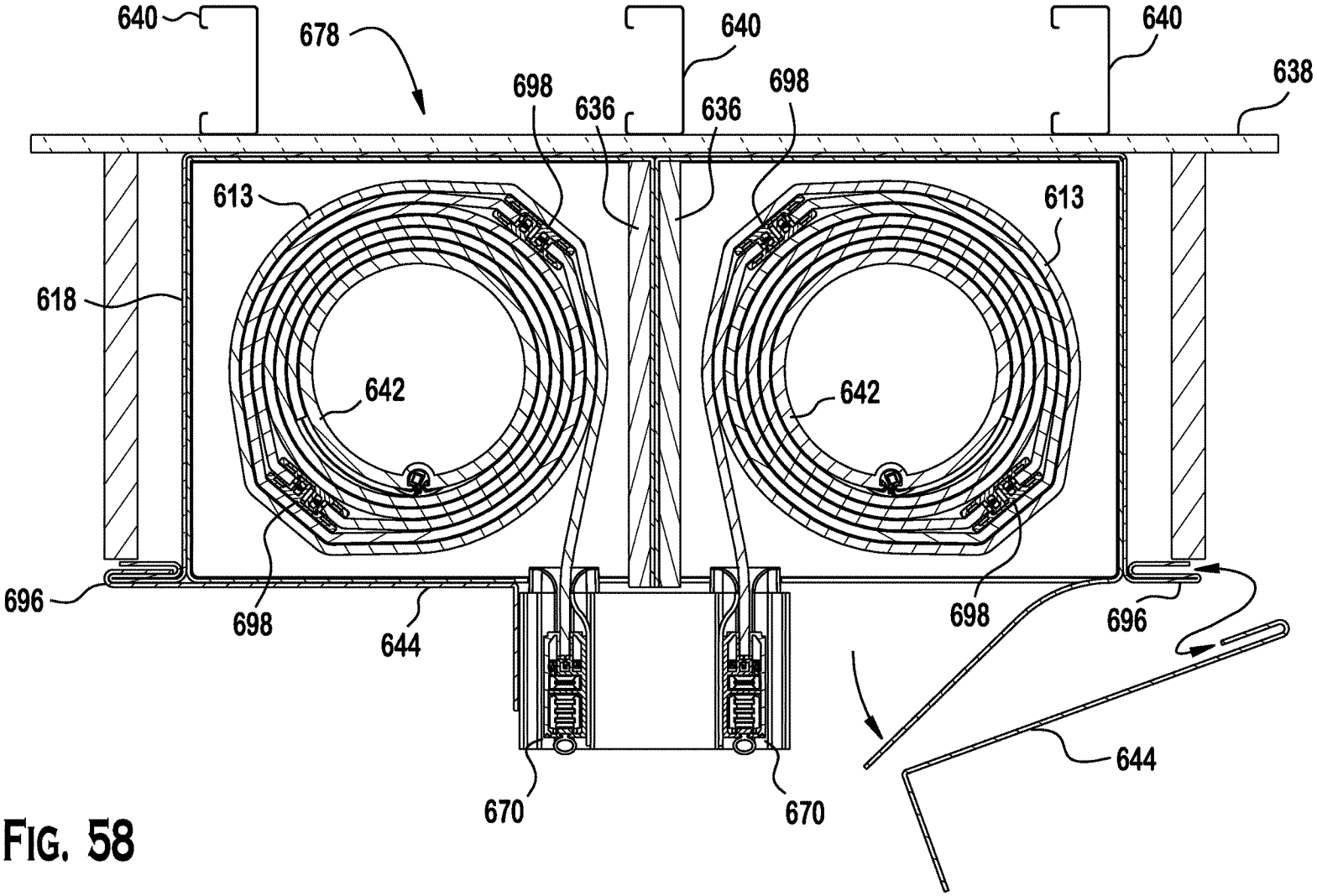
FIG. 58 is schematic view of the top box and the vertical assembly of FIG. 52 in a raised configuration.

FIG. 58 shows an exemplary top box 678 assembly in a raised configuration, in which one of the access panels 644 has been removed from the top box. In this embodiment, the top box 618 has been installed underneath structural members (or joists) of the finished ceiling. A wood or drywall surround 694 may be added to the sides of the top box in order to provide an architectural finish for the enclosure. The access panel 644 may be secured to a lip 696 of the sheet metal frame of the top box. The top box may be accessed by sliding the access panel 644 away from the top box. In the raised configuration, the flexible barrier material 613 may be rolled up on the tube 642 for storage. In this embodiment, the opposing tubes 642 may be rotated away from each other to raise each respective retractable wall system. The flexible barrier material 613 may include multiple sections, which are connected together with a splicing device 698. The splicing device 698 may be a center track assembly, which may be composed of two mating track components.

Figure 62:
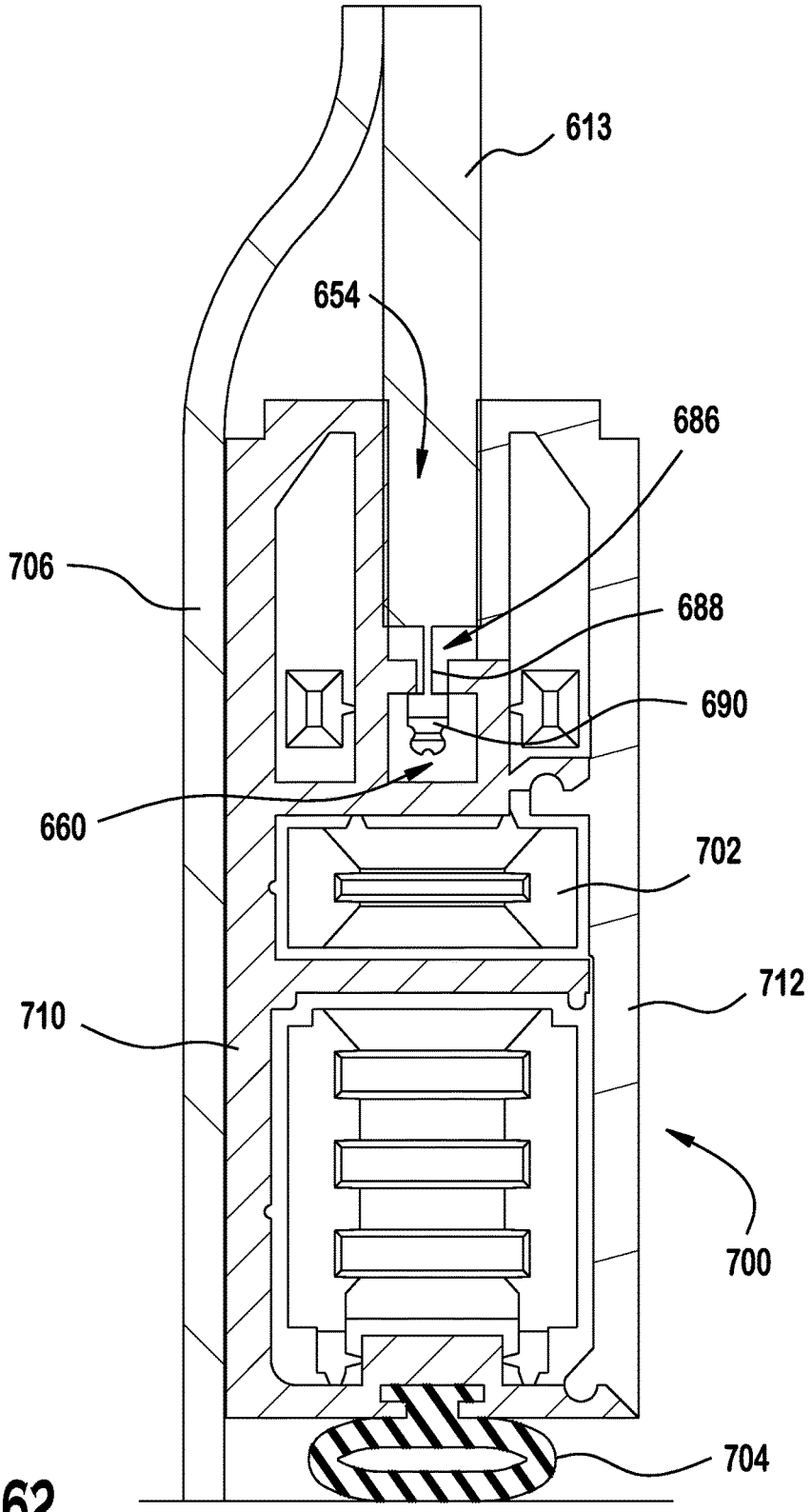
FIG. 62 is a sectional view of an exemplary horizontal track assembly of a roll-up acoustic barrier system in accordance with the present invention.

As shown in FIG. 62, the bottom of the flexible barrier material 613 may be secured to a horizontal track (e.g., FIGS. 24 and 25) 670. The bottom edge of the flexible barrier material 613 may be joined to a zipper 686. The zipper may include a ribbon portion 688 and a securing element portion (or teeth) 690. In an illustrative embodiment, the flexible barrier material 613 may be sewn, welded, or otherwise secured to the ribbon portion 688 of the zipper.

The flexible barrier material 613 may be positioned in the rigid receiving channel 654 and the securing elements 690 may be captured in the internal anchoring cavity 660 of the horizontal track 700. An end cap 702, which may include a traveling guide, may be connected to a portion of the horizontal track and/or flexible barrier material to promote a generally uniform and secure interaction with the side tracks. The bottom of the horizontal track further may include a flexible seal 704. For example, a rubber gasket. The interior side of the flexible barrier material may include a flap 706 of sound blocking material. The flap 706 of sound blocking material may isolate the horizontal track 700 from the interior of the acoustic barrier. In this manner, sound which may be transmitted through the horizontal track 700 may be prevented from crossing the acoustic barrier.

Figure 63:
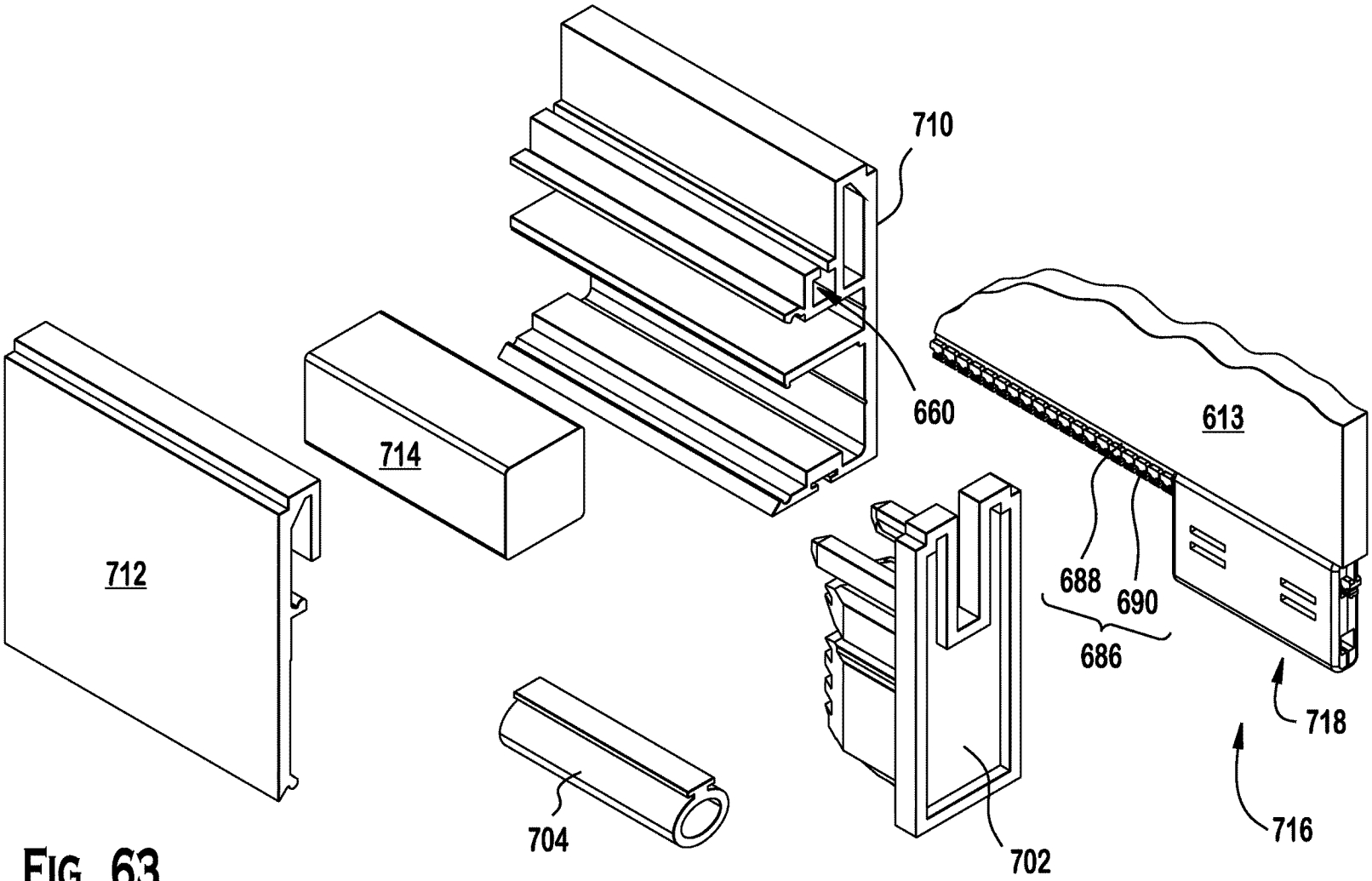
FIG. 63 is a partially exploded view of the horizontal track assembly of FIG. 62.

FIG. 63 shows components of the horizontal track assembly 708. These components may include the horizontal track base 710, the horizontal track cover 712, a weight bar 714, a resilient gasket, an end cap 702, and a corner assembly 716 of the flexible barrier. The corner assembly of the flexible barrier may include a lower corner of the flexible barrier material 613, a zipper 686 connected to the flexible barrier material, and a zipper locking device (or zipper lock) 718.

Figure 64:
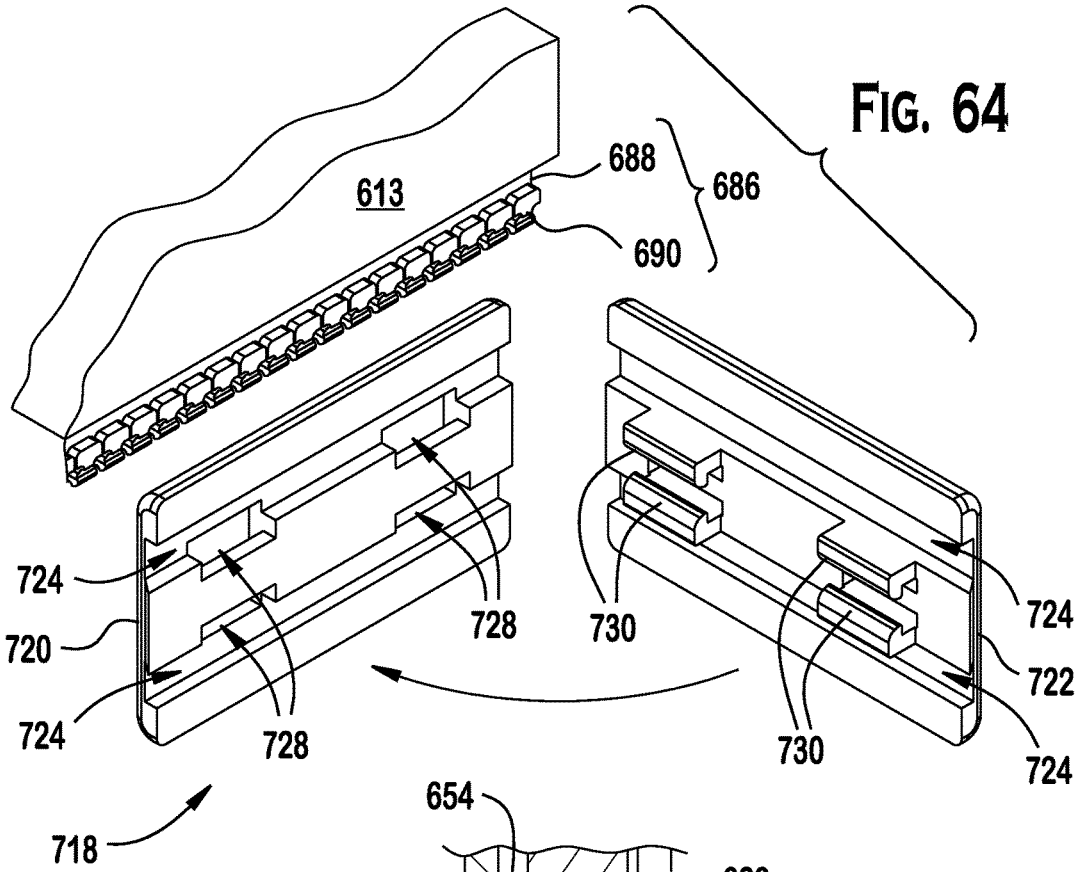
FIG. 64 is schematic view of an exemplary embodiment of a flexible material barrier segment and zipper locking device of FIG. 63 in an unassembled configuration.
Figure 65:
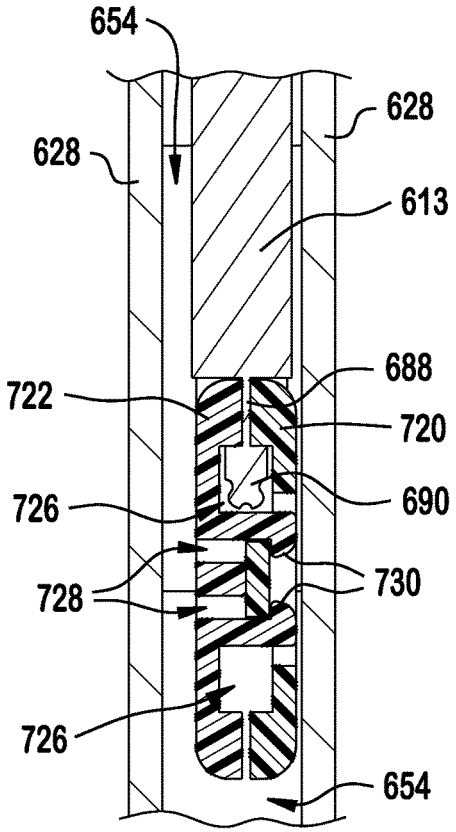
FIG. 65 is cross-sectional view of the flexible material barrier segment and zipper locking device of FIG. 63 in a rigid receiving channel of an exemplary side track.

As shown in FIG. 64 and FIG. 65 the zipper lock 718 may include two plates 720, 722. Each plate may include two parallel grooves 724. When the plates are joined, opposing pairs of parallel groves may cooperate to form a passage 726 through the plates. Additionally, one of the plates 720 may include a number of retention structures (e.g., four) 728 and the other plate 722 may include a similar number of projections (e.g., four) 730. The retention structures 728 and projections 730 may be configured and dimensioned to form one or more press fit connections which lock the plates together. The securing elements 670 of the zipper may be placed between an opposing pair of parallel groves 724 and locked between the two plates 720,722. The zipper lock may be formed from metal, metal alloys, plastic, polymer materials, wood, ceramics or other suitable materials. For example, the entry zipper lock may be formed from ABS plastic. In another example, the zipper lock 718 may be formed from the same materials and finish as the side tracks 628.

Figure 66:
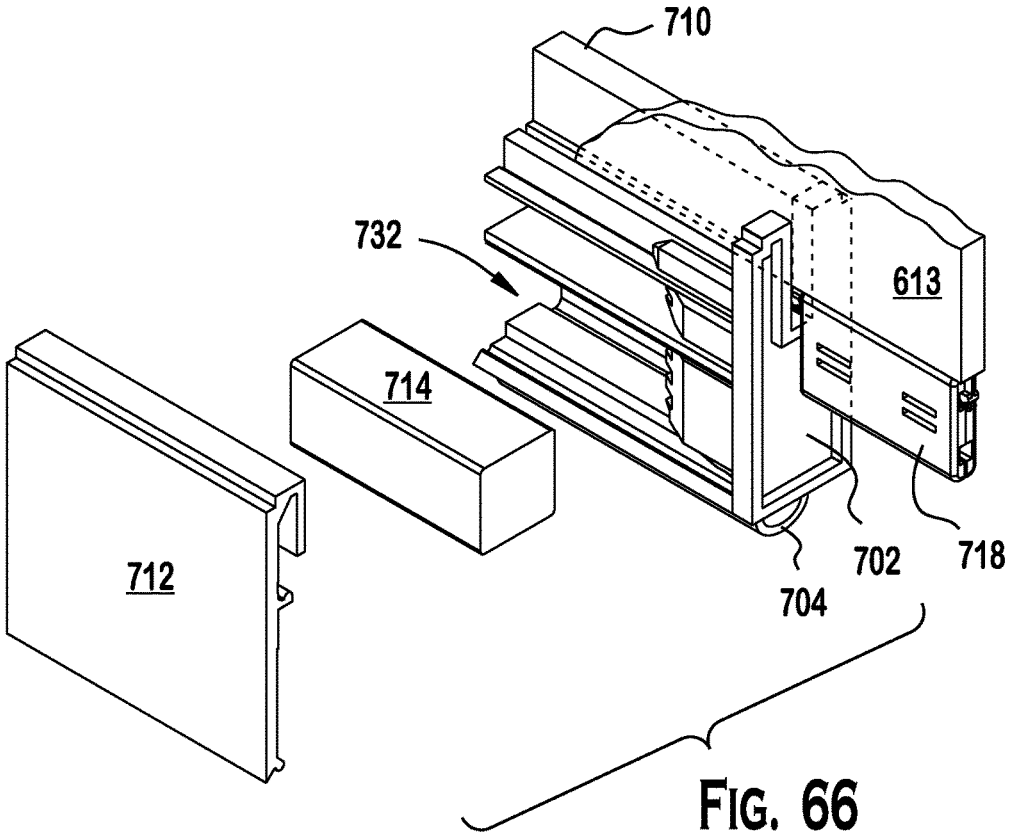
FIG. 66 is a partially assembled view of the horizontal track assembly of FIG. 63.

Referring to FIG. 66, the end cap 702 may be positioned in the horizontal track base 710 and the securing elements 690 of the zipper may be slid into the internal anchoring cavity 660. The weight bar 714 may be placed in the primary receiving channel 732 of the horizontal track base 710.

Figure 67:
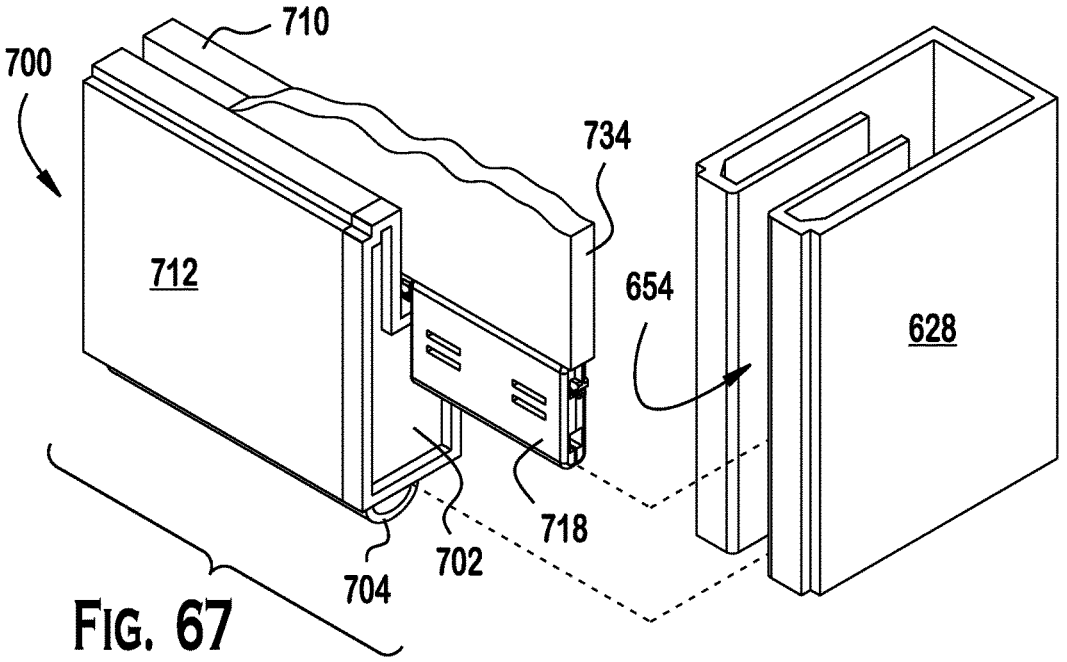
FIG. 67 is a schematic view of the horizontal track assembly of FIG. 63 positioned in an exemplary side track.

Referring to FIG. 67, the horizontal track cover 712 may then be connected to the horizontal track base 710 and the assembly positioned with respect to the side track 628 such that the edge 734 of the flexible barrier material and zipper lock 718 are disposed in the rigid receiving channel 654.

Figure 68:
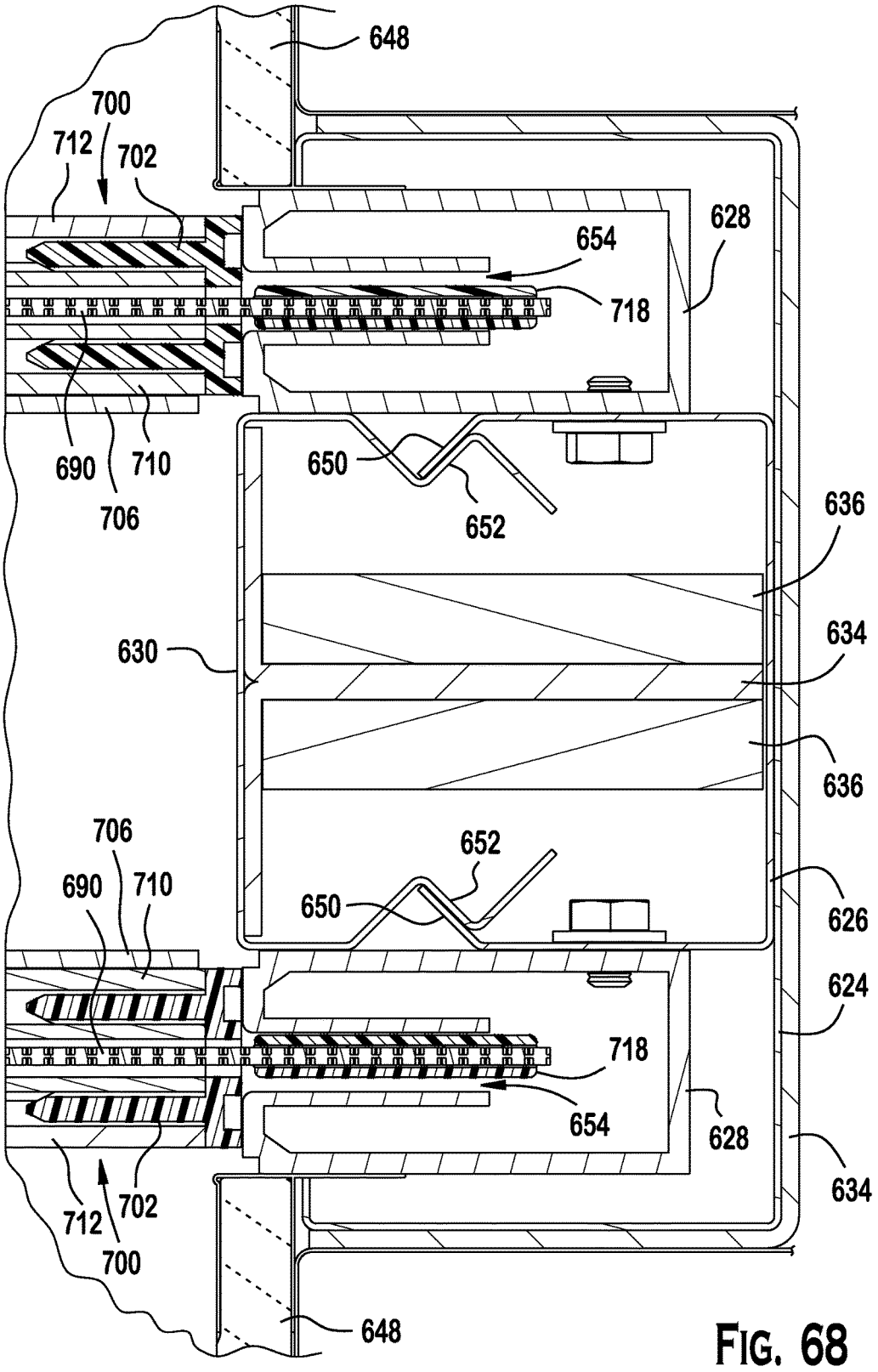
FIG. 68 is a cross-sectional view of exemplary embodiments of a skeleton, vertical assembly, and double side track in accordance with the present invention.

FIG. 68 shows a sectional view of a vertical assembly 620 and two horizontal tracks of an exemplary embodiment of a roll up acoustic barrier. Each horizontal track 700 abuts a side track 628 and each zipper lock 718 is disposed within the respective rigid receiving channel 654.

Figure 69:
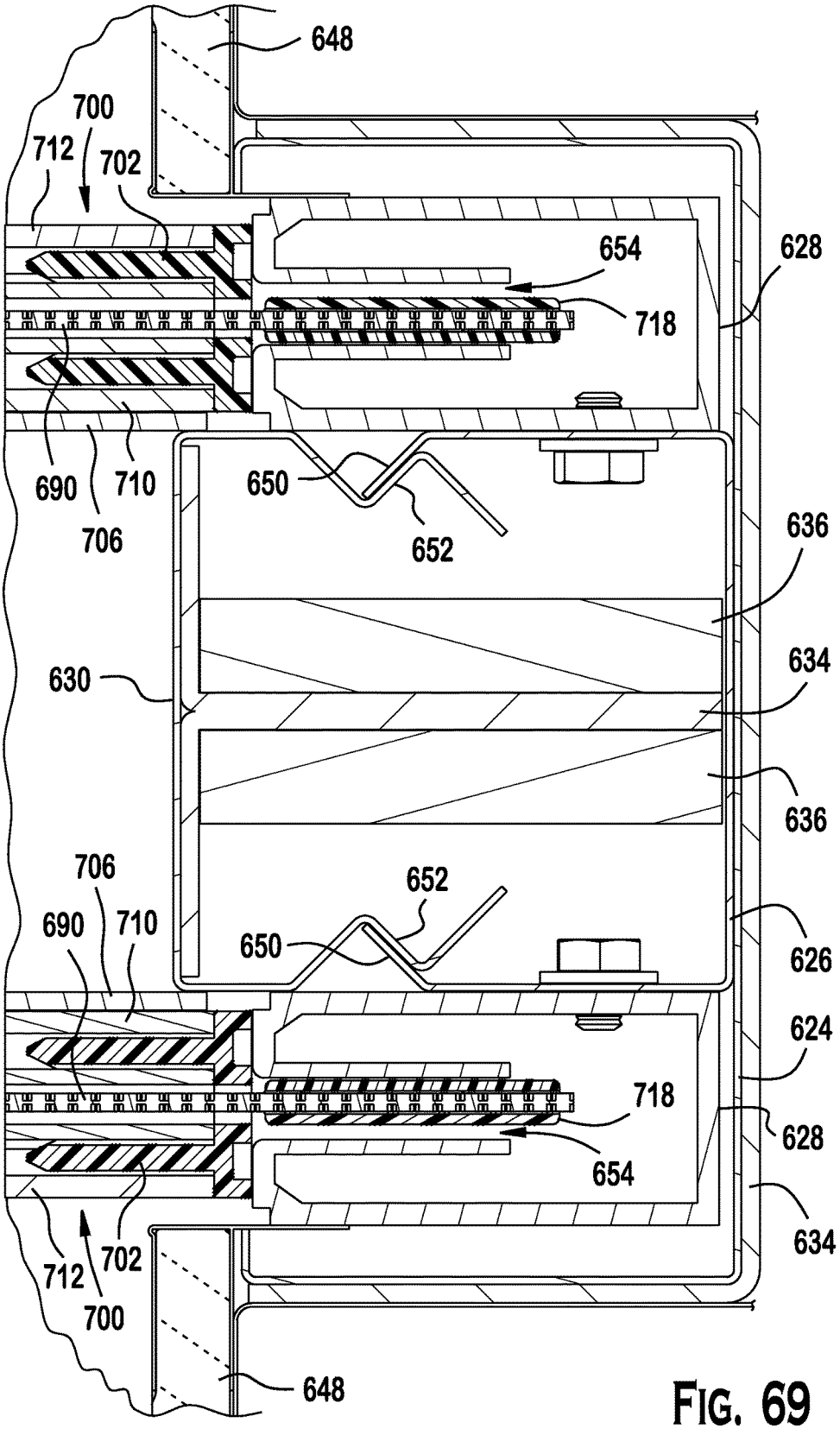
FIG. 69 is a cross-sectional view of another configuration of the skeleton, vertical assembly, and double side track of FIG. 68.

FIG. 69 shows another embodiment of a roll up acoustic barrier with the side tracks 628 set back deeper in the skeleton enclosure. In this configuration, the horizontal tracks 628 may extend into the conventional wall.

Figure 70:
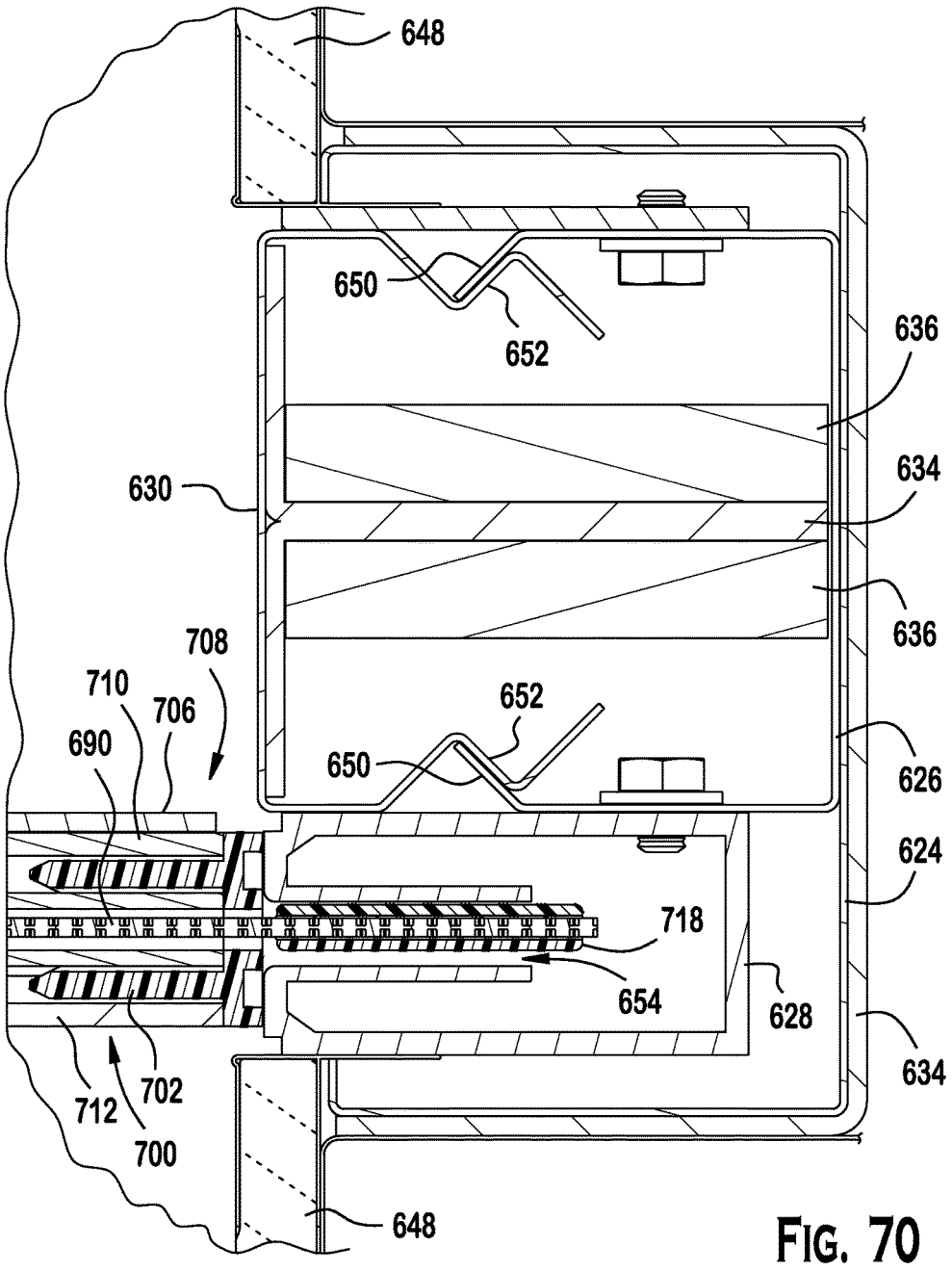
FIG. 70 is a cross-sectional view of another configuration of the skeleton, vertical assembly, and side track of FIG. 68

FIG. 70 shows another embodiment of a roll up acoustic barrier. In this embodiment, the roll up acoustic barrier is formed from a single side track 628 and horizontal track assembly 708.

Figure 71:
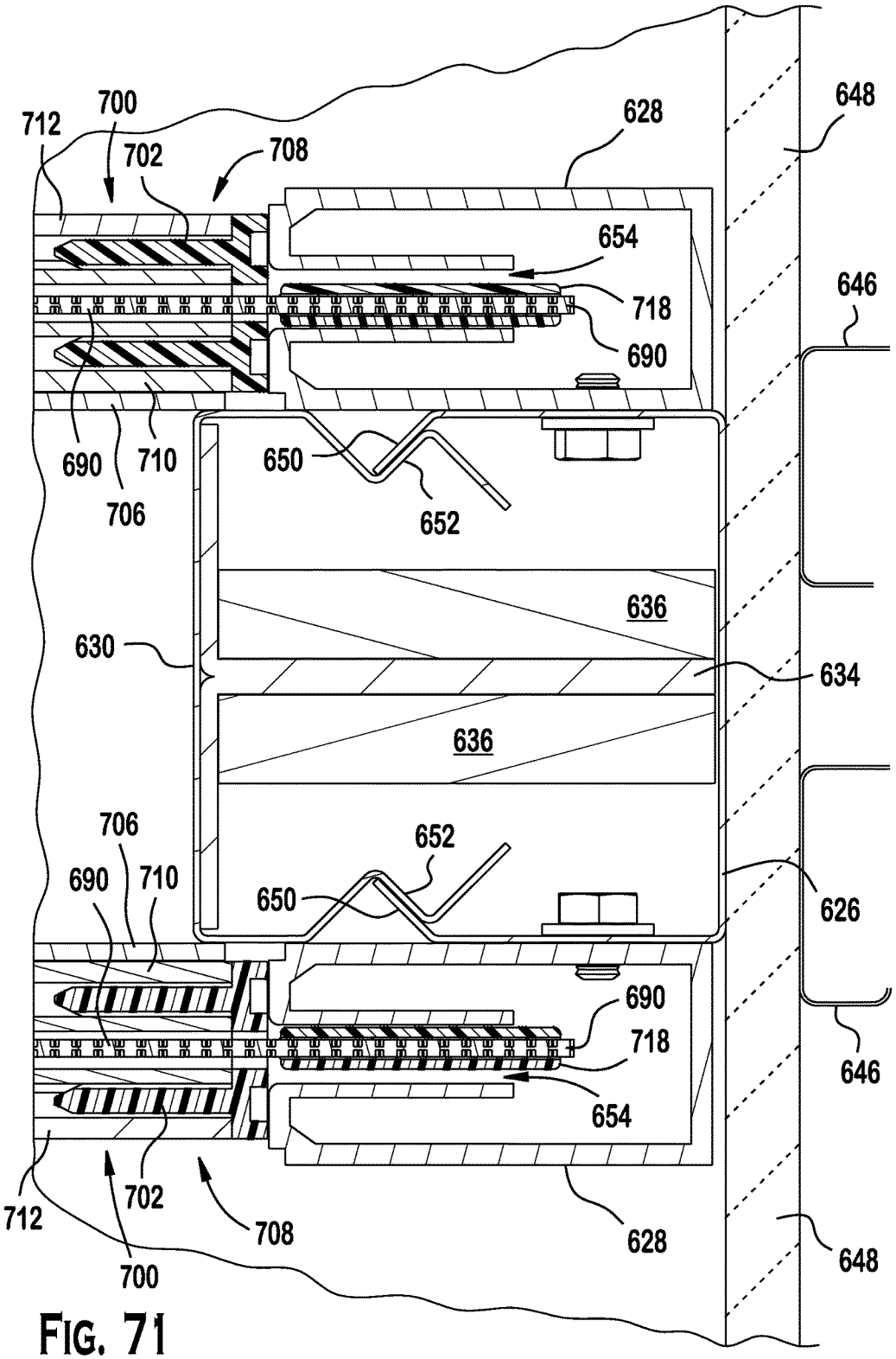
FIG. 71 is a cross-sectional view of another configuration of the skeleton, vertical assembly, and double side track of FIG. 68.

FIG. 71 shows yet another embodiment of a roll up acoustic barrier. In this embodiment, the roll up acoustic barrier is placed against a finished wall.

Figure 72:
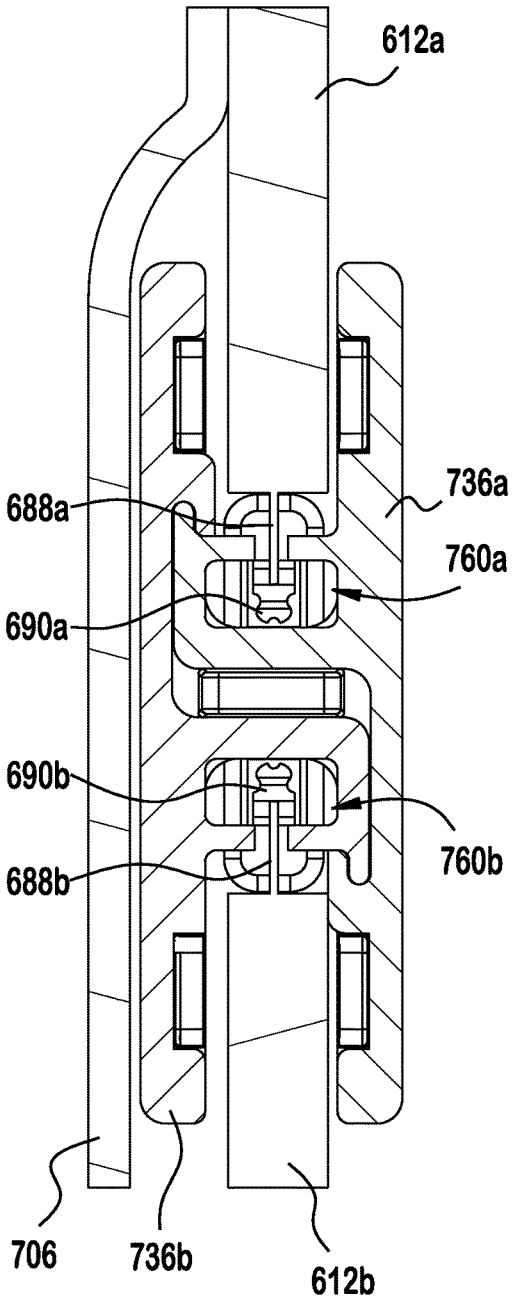
FIG. 72 is cross-sectional view of an exemplary embodiment of a center track assembly in accordance with the present invention.

FIG. 72 shows a cross sectional view of an exemplary center track assembly 614. The center track assembly may be used to securely connect segments 612*a*, 612*b* of flexible barrier material 613. The center track assembly may include two track components 736*a*, 736*b*. One track component 736*a* may be secured to an upper segment 612*a* of flexible barrier material which may be connected to a tube, and another track component 736*b* may be secured to a lower segment 612*b* of flexible barrier material 613. The two track components may share a common profile. The track components 736*a*, 736*b* may be formed from the same materials and finishes as the side tracks 628.

Figure 74:
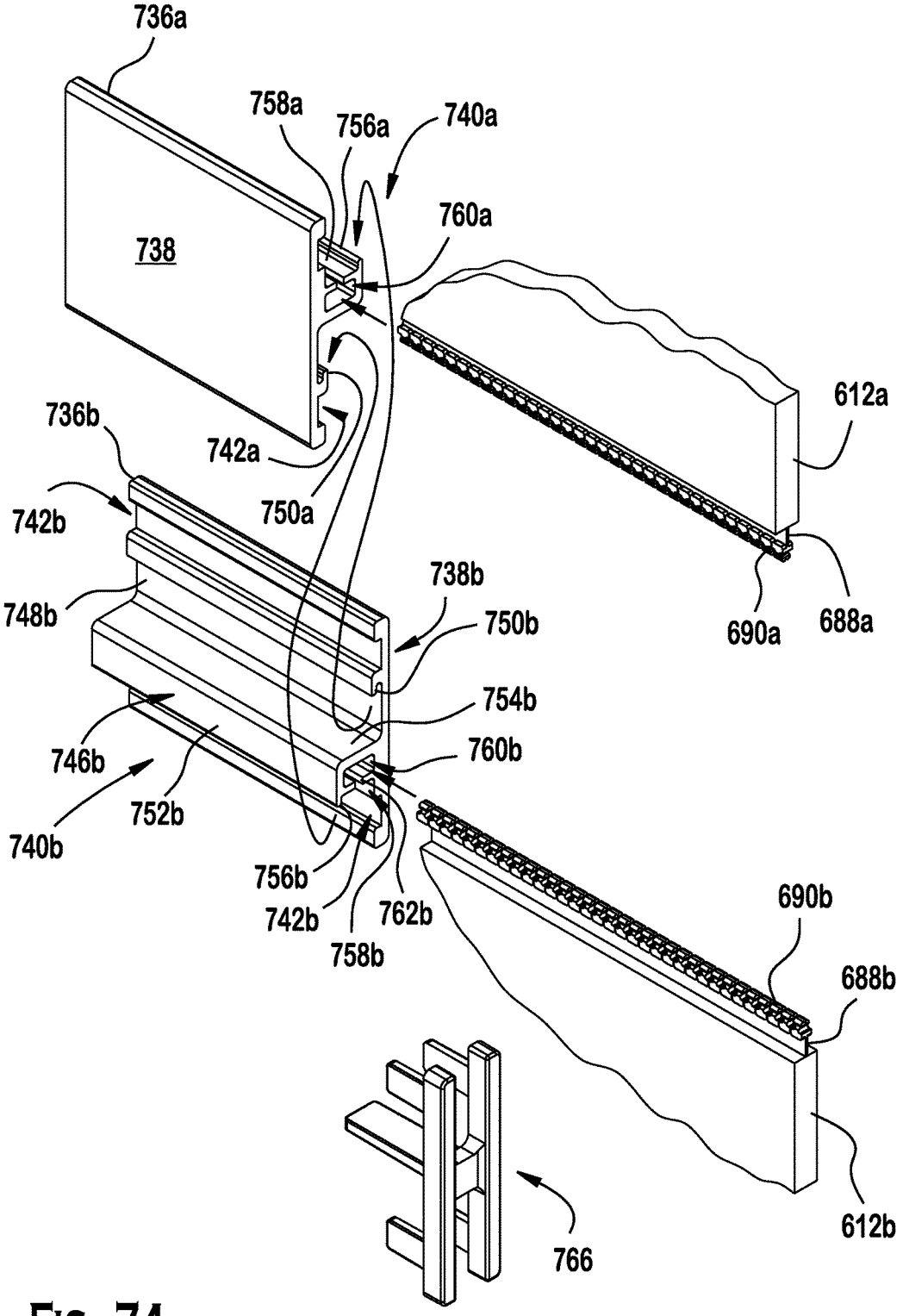
FIG. 74 is a partially exploded view of the center track assembly of FIG. 72.

As shown in FIG. 74, one track component 736*a* may have a generally flat outer surface 738*a*. Additionally, the inner surface 740*a* may include two grooves 742*a*, a hooking element 744*a*, and a projecting element 746*a*. The hooking element may include a guide surface 748*a* and a curved projection 750*a*, which may curve toward the projecting element. The projecting element 746*a* may include a generally flat side surface 752*a* which is generally parallel to the outer surface 738*a*. The projecting element may further include another generally flat side surface 754*a* which is disposed generally perpendicular with the outer surface 738*a*. Also, the projecting element 746*a* may include a rail 750*a*, a seat 758*a*, and a rectangular passage 760*a* disposed within the projecting element. The projecting element further may include a slot 762*a* which connects the seat and the rectangular passage.

The securing elements 690*a* of the zipper located at the bottom of the upper flexible barrier material segment 612*a* may be slid into the passage 760*a* of the upper track component 736*a* with the ribbon portion 688*a* extending through the slot 762*a* of the upper track component's projecting element 746*a*. Similarly, the securing elements 690*b* of the zipper at the top of the lower flexible barrier material segment 612*b* may be slid into the passage 760*b* of the lower track component 736*b* with the ribbon portion 688*b* of the zipper extending through the slot 762*b* of the lower track component's projecting element.

Figure 75:
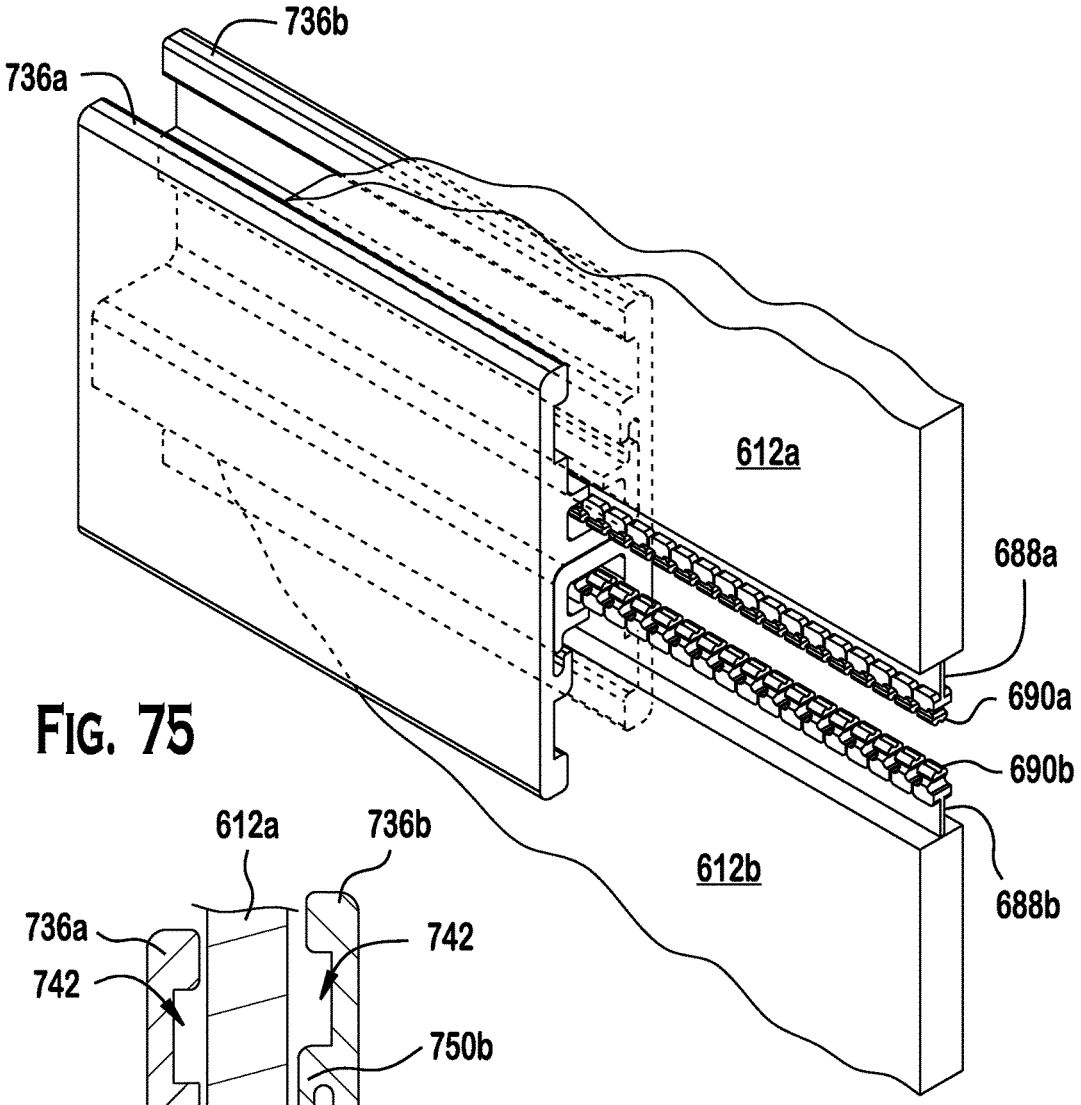
FIG. 75 is a perspective view of two center tack components and two segments of flexible barrier material in an engaged and unlocked configuration.
Figure 76:
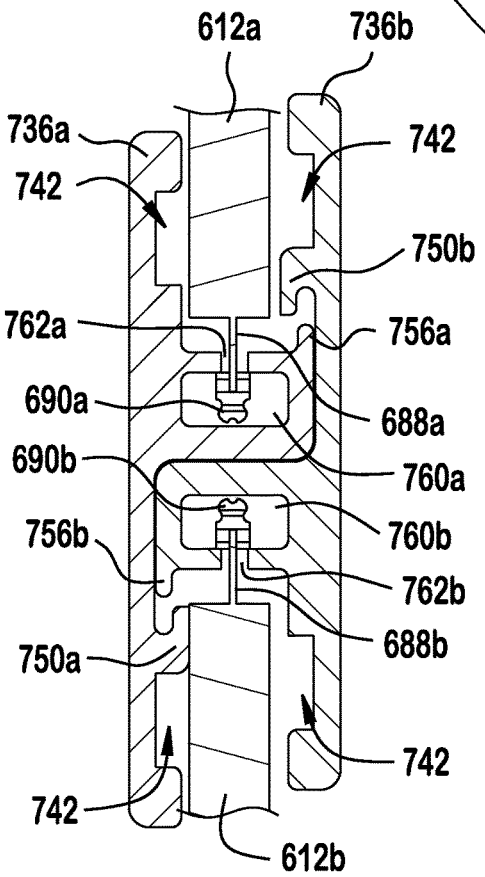
FIG. 76 is a cross-sectional view of the center tack components and two segments of flexible barrier material of FIG. 75.

As shown in FIG. 75 and FIG. 76, the inner surfaces of the top and bottom track components 740*a*, 740*b* may be pressed toward each other such that one side of each projecting element contacts the other projecting element. In this configuration, the respective rails 756*a*, 756*b* of the two track components are positioned in the guide surface 748*a*, 748*b* of the other track component but remain separated from the curved projection 750*a*,750*b*.

Figure 77:
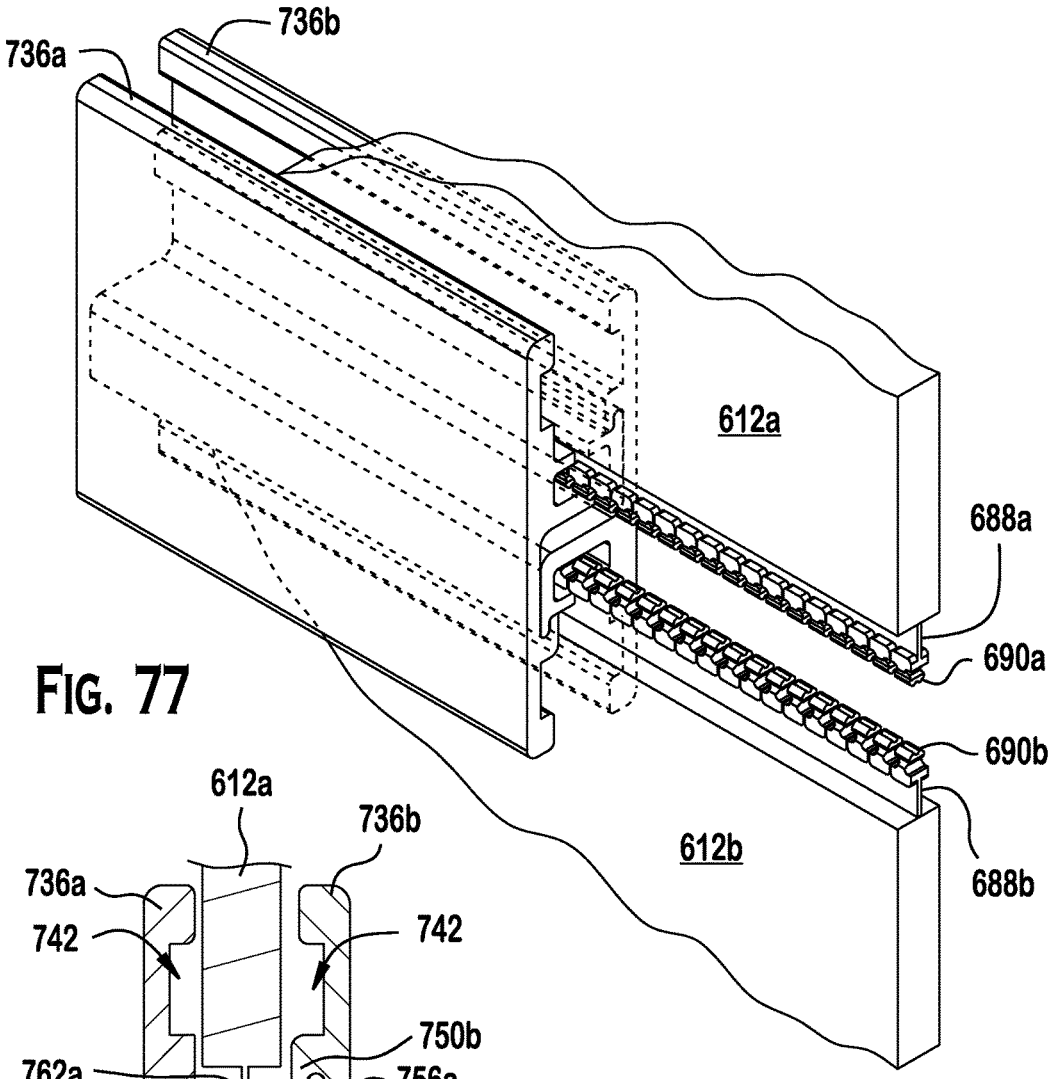
FIG. 77 is a perspective view of two center tack components and two segments of flexible barrier material in a locked configuration.
Figure 78:
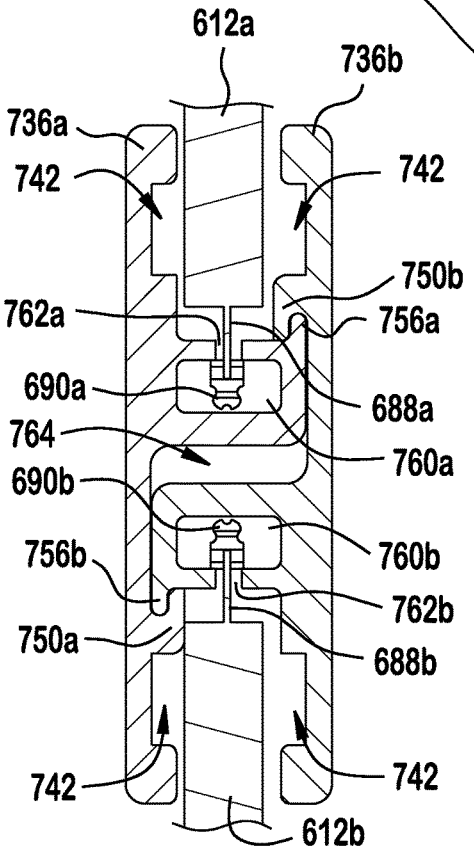
FIG. 78 is a cross-sectional view of the center tack components and two segments of flexible barrier material of FIG. 77.

Referring to FIG. 77 and FIG. 78, the top track component 736*a* and the bottom track component 736*b* may move apart such that the rail 756*a* of the top track component may interlock with the curved projection 750*b* of the bottom track component 736*b*, and the rail 756*b* of the bottom track component may interlock with the curved projection 750*a* of the top track component. In this locked configuration, a gap 764 may exist between the top projecting element 746*a* and the bottom projecting element 746*b*.

Figure 79:
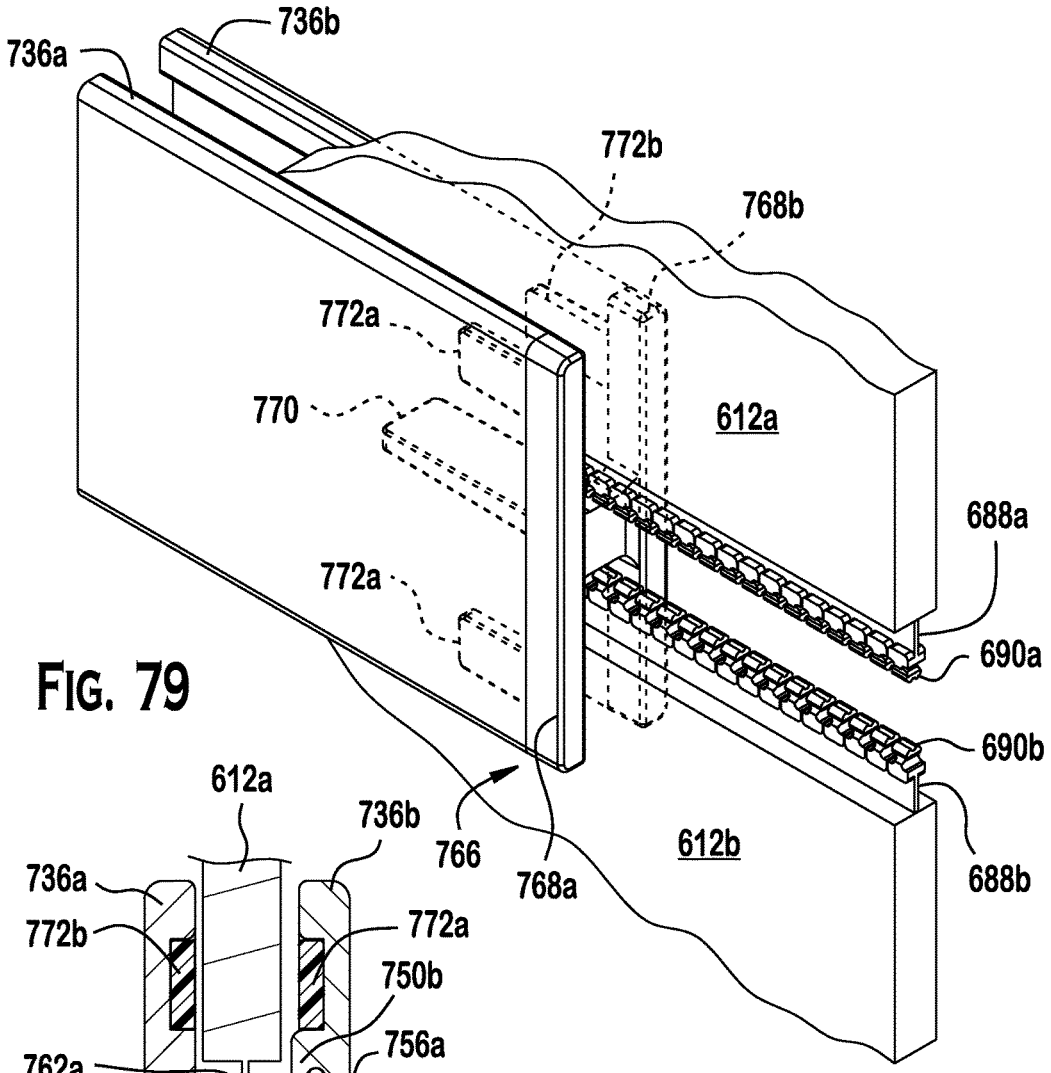
FIG. 79 is a perspective view of two center tack components and two segments of flexible barrier material in a locked and secured configuration.
Figure 80:
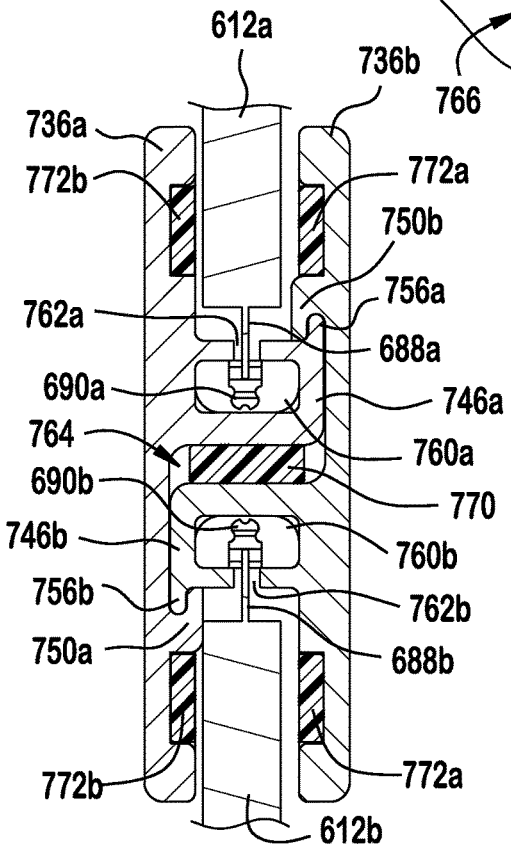
FIG. 80 is a cross-sectional view of the center tack components and segments of flexible barrier material of FIG. 79.

Referring to FIG. 79 and FIG. 80, a locking end cap 766 may be connected to both ends of the interlocked track components 736*a*, 736*b* to secure the central track assembly 614 in the locked configuration.

Referring to FIG. 82, FIG. 83, FIG. 84, FIG. 85, FIG. 86 and FIG. 87, the locking cap 766 may include two elongated members 768*a*, 768*b*. The two elongated members may be spaced from each other. The elongated members may be connected by a cross member 770. The cross member 770 may connect the two elongated members near the middle of each elongated member. Each elongated member 768*a*, 768*b* further may include two projections 772*a*, 772*b*. The projections may extend in the same general direction. The cross member 770 may be situated between two projections on the same elongated member. The projections may be of the same size, orientation, and shape. The locking end cap 766 further may include a central stem 778. The central stem 778 may extend from the cross member 770. The stem may be larger than the projections 772*a*, 772*b*.

Referring to FIG. 79 and FIG. 80, the four projections 772*a*, 772*b* and central stem 778 may be configured and dimensioned to be received between the two track components 736*a*, 736*b*. One projection 772*a*, 772*b* may be received in each of the grooves 742 that are located on the inner surfaces of the track components 736*a*, 736*b*. The central stem 778 may be configured and dimensioned to be received in the gap 764 between the top projecting element 746*a* and the bottom projecting element 746*b*. Although the projections may be pressed inwardly slightly when inserted into the track assembly so as to provide a tight fit, the projections preferably are sufficiently rigid and strong so as to securely block lateral, relative movement of the two track components. Moreover, the stem 778 may securely block relative, vertical movement of the two track components. Thus, the locking end cap 766 may splice two segments 612*a*, 612*b* of flexible barrier material 613 together, as well as securely lock the upper track component 736*a* and the lower track component 736*b* together.

Figure 73:
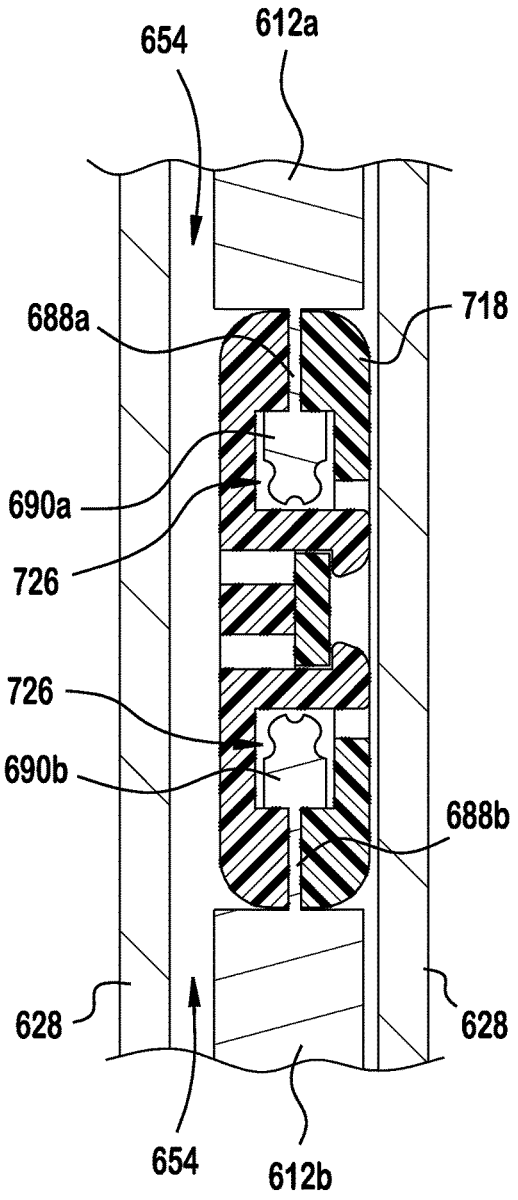
FIG. 73 is cross-sectional view of an exemplary zipper locking device joining two illustrative segments of flexible barrier material in accordance with the present invention.
Figure 81:
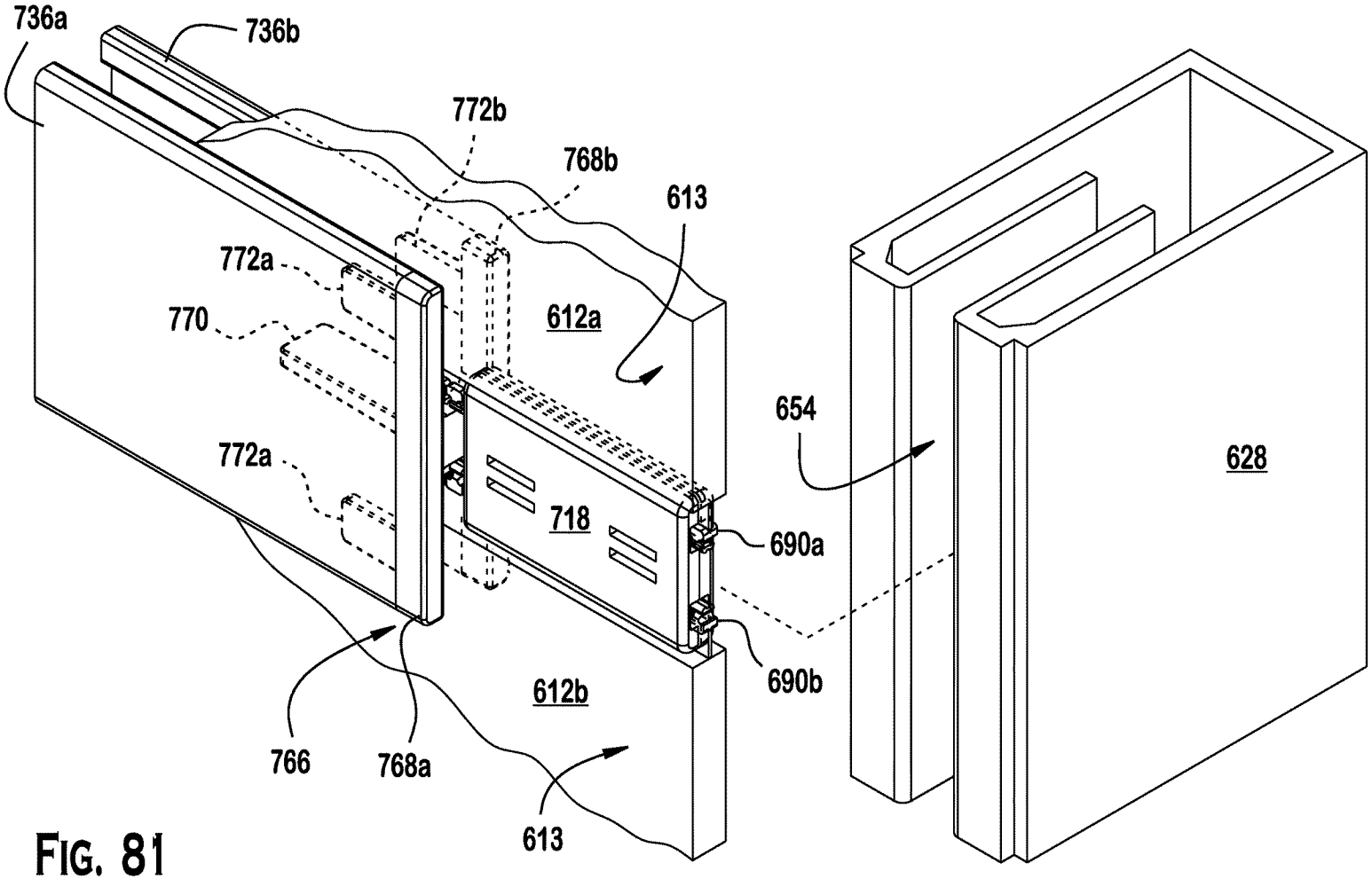
FIG. 81 is a partial perspective view of the center track assembly of FIG. 72, the zipper locking device of FIG. 73, and a side track of FIG. 53.
Figure 82:
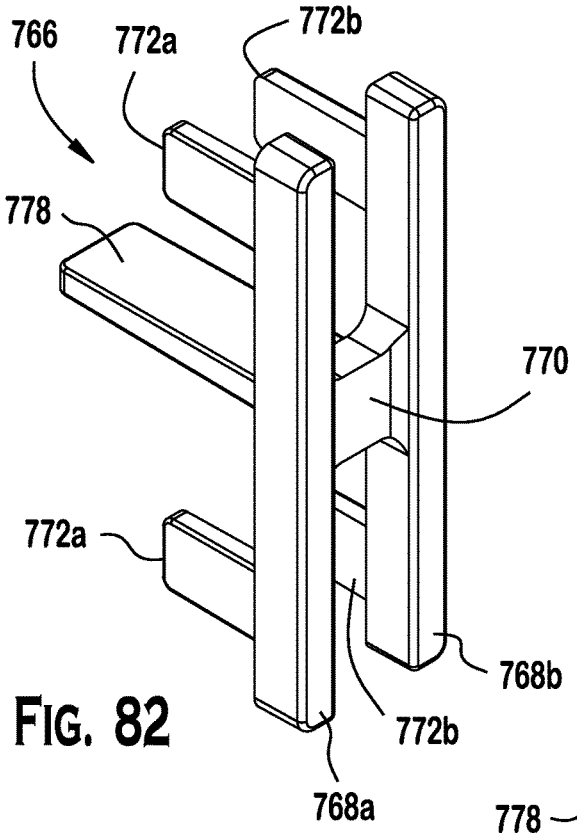
FIG. 82 is a perspective view of an exemplary embodiment of a locking end cap in accordance with the present invention.
Figure 83:
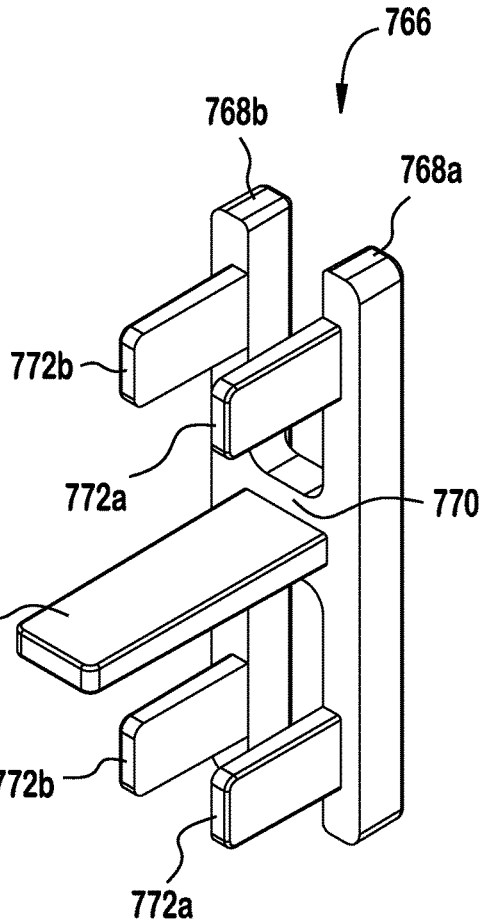
FIG. 83 is another perspective view of the locking cap of FIG. 82.
Figure 84:
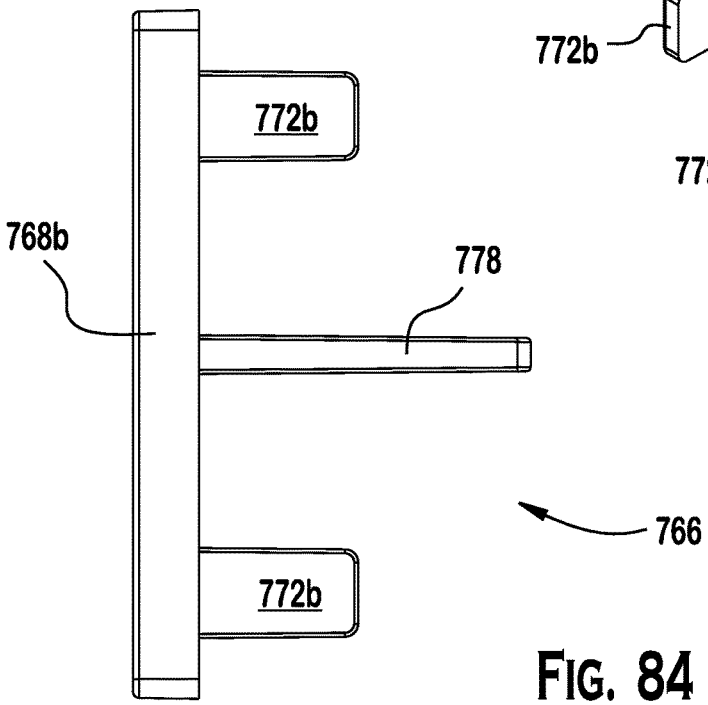
FIG. 84 is a side view of the locking cap of FIG. 82.
Figure 85:
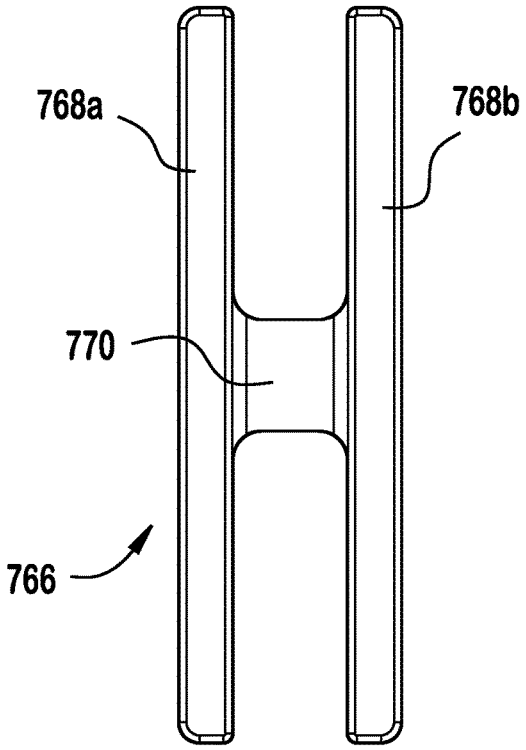
FIG. 85 is a rear view of the locking cap of FIG. 82.
Figure 86:
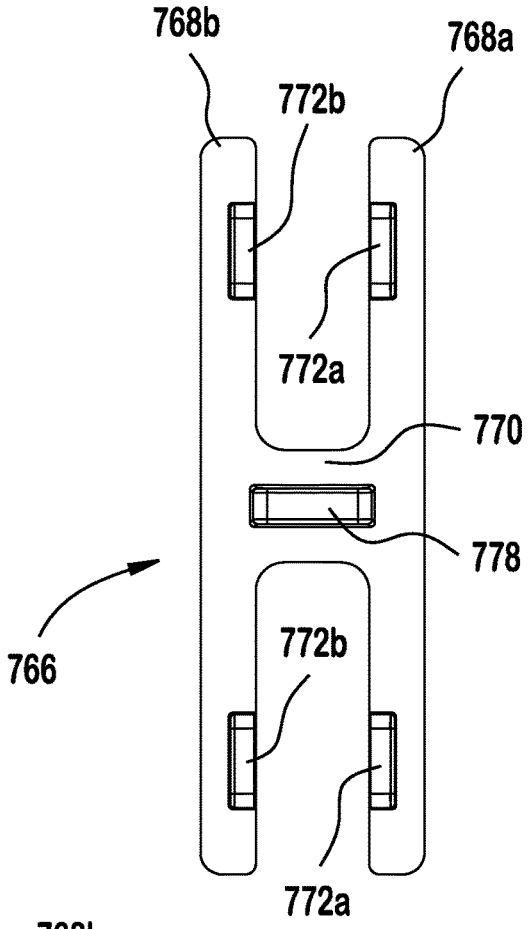
FIG. 86 is a front view of the locking cap of FIG. 82.
Figure 87:
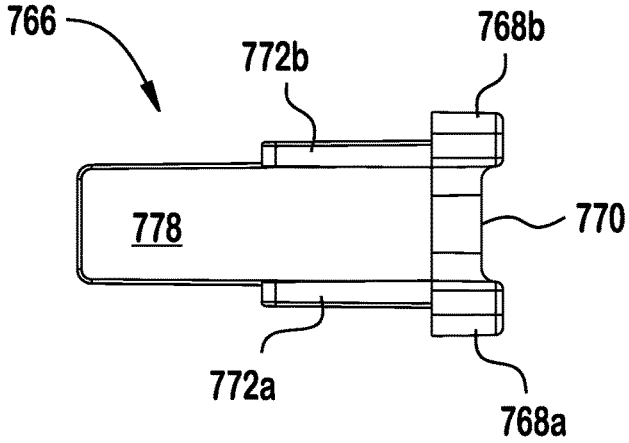
FIG. 87 is a top view of the locking cap of FIG. 82.

Referring to FIG. 81, the flexible barrier material 613 may be wider than the center track components 736*a*, 736*b* so as to allow the locking end cap 766 to abut the side track 628 and to position the flexible barrier material 613 in the rigid receiving channel 654. As shown in FIG. 73, the zipper lock 718 may be used to connect adjacent segments 612*a*, 612*b* of the flexible barrier material 613 within the rigid receiving channel 654. Also, the zipper lock 718 may help guide the flexible barrier material segments travel through the side tracks.

Figure 105:
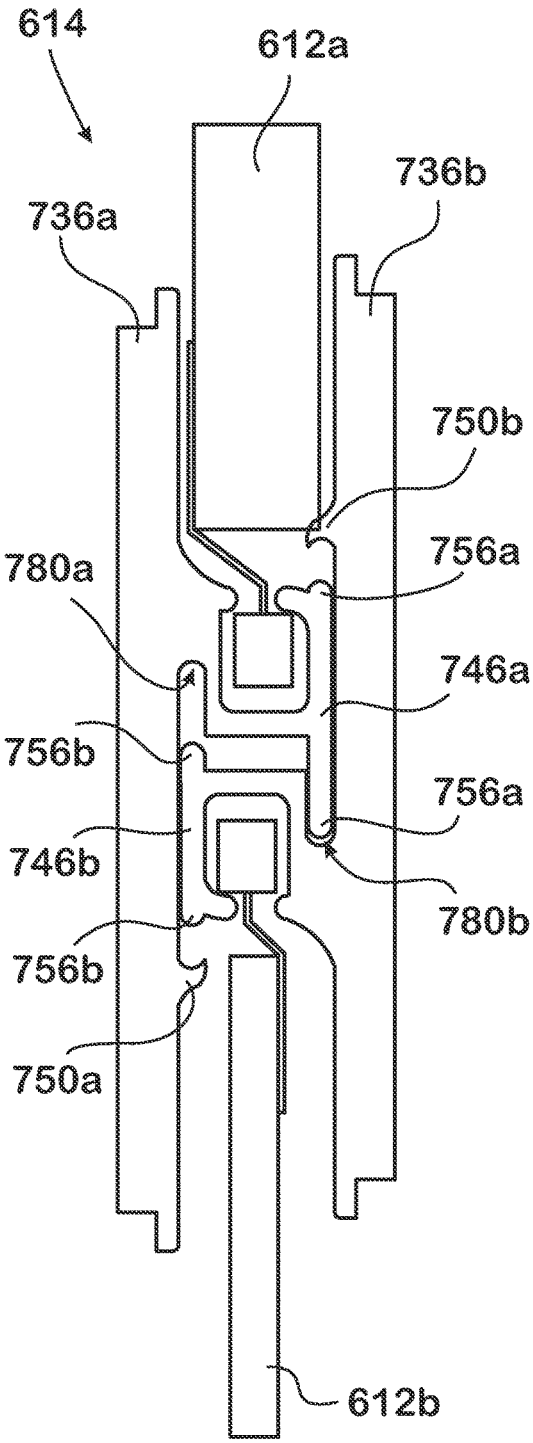
FIG. 105 is a cross-sectional view of another exemplary embodiment of a center track assembly in accordance with the present invention.
Figure 106:
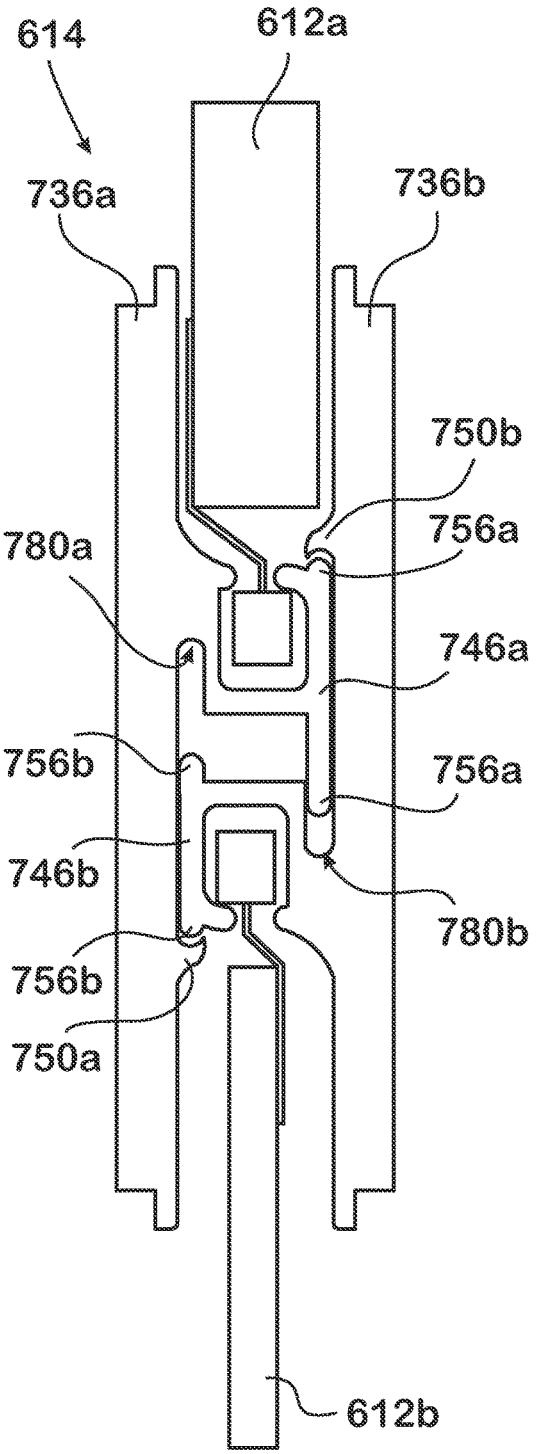
FIG. 106 is a cross-sectional view of another exemplary embodiment of a center track assembly in accordance with the present invention.
Figure 107:
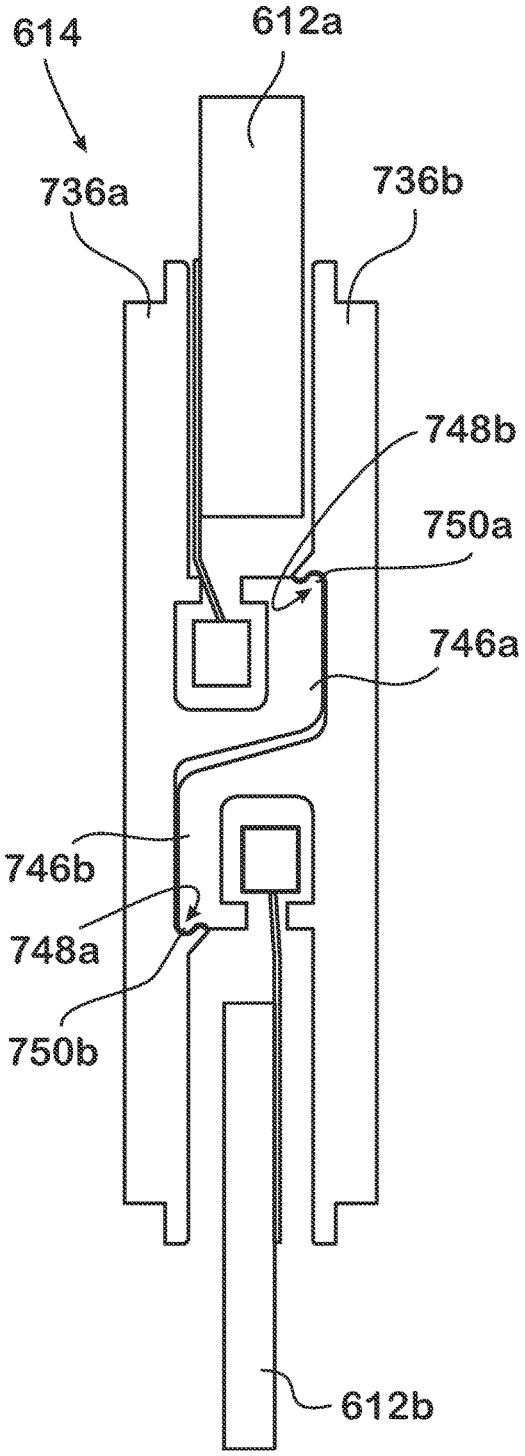
FIG. 107 is a cross-sectional view of another exemplary embodiment of a center track assembly in accordance with the present invention.
Figure 108:
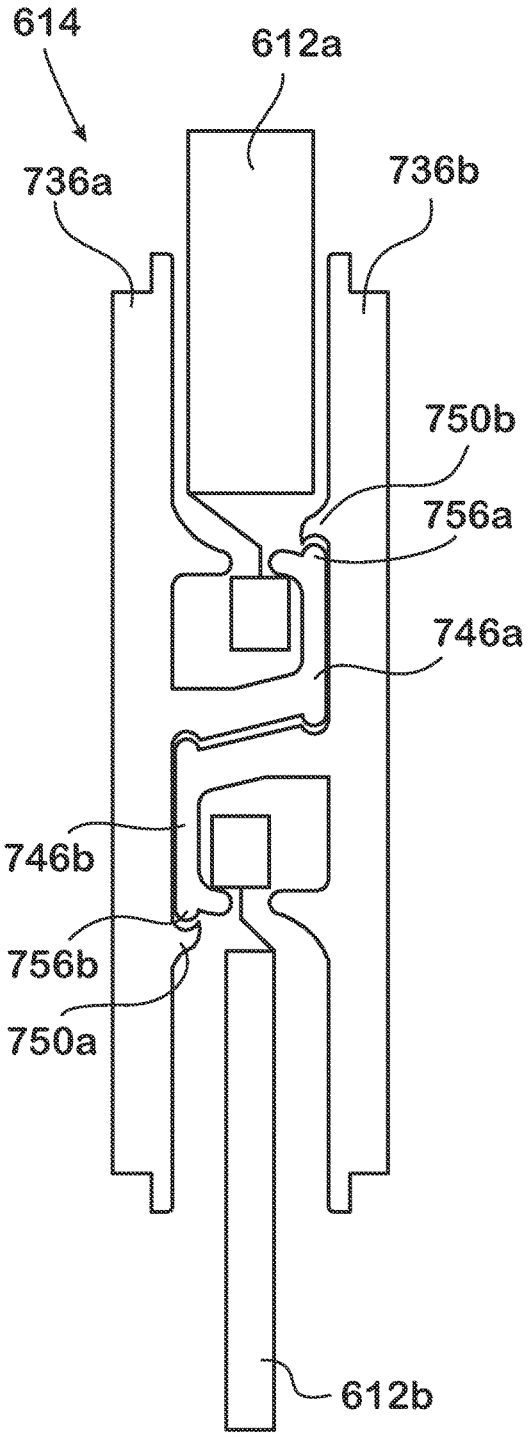
FIG. 108 is a cross-sectional view of another exemplary embodiment of a center track assembly in accordance with the present invention.
Figure 109:
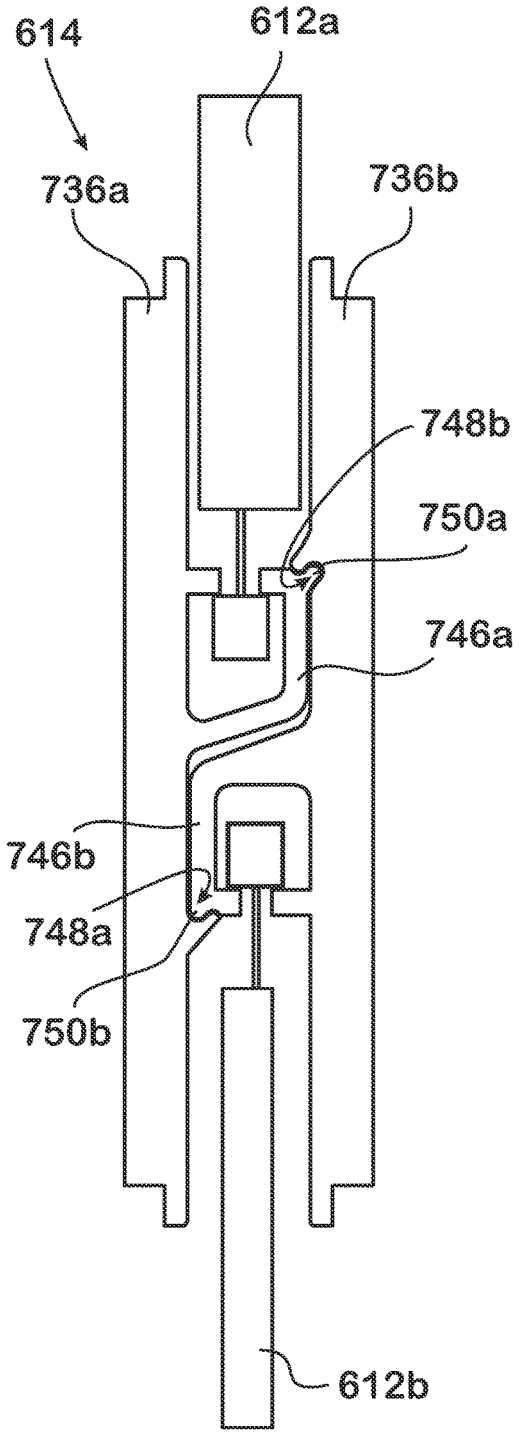
FIG. 109 is a cross-sectional view of another exemplary embodiment of a center track assembly in accordance with the present invention.
Figure 110:
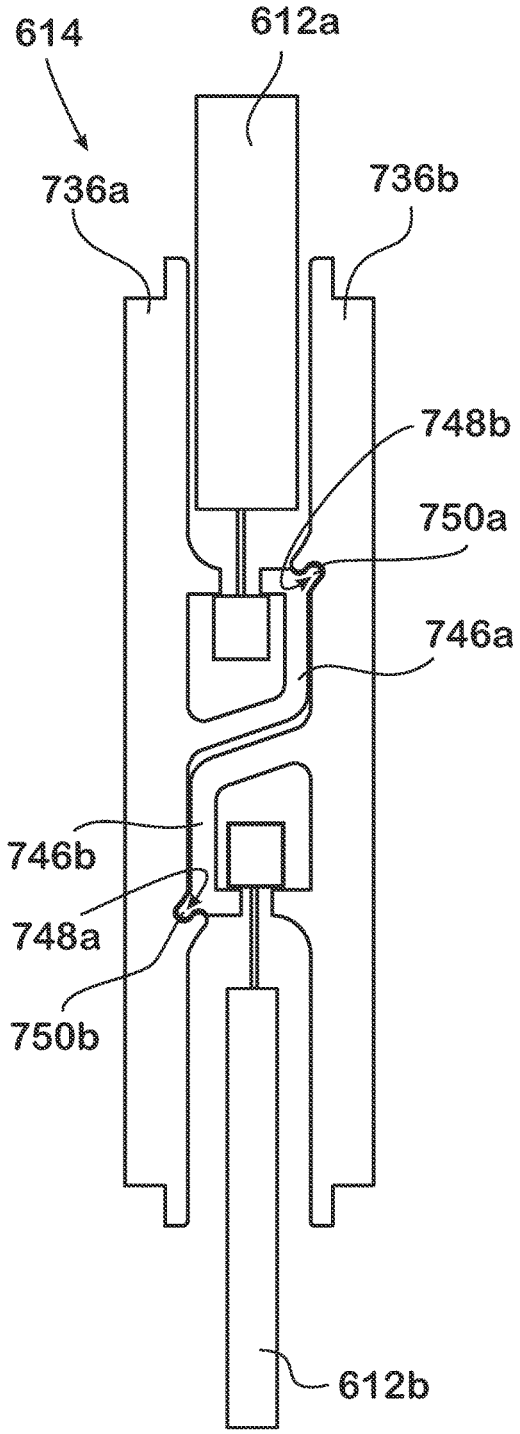
FIG. 110 is a cross-sectional view of another exemplary embodiment of a center track assembly in accordance with the present invention.

FIG. 105 shows another embodiment of a center track assembly 614. In this embodiment, the projecting element 746*a*, 746*b* includes two rails 756 and the hooking element 748 includes a curved projection 750*a*, 750*b* and deep recess 780*a*, 780*b*. As shown in FIG. 106 and FIG. 108, the two track components may be secured together when the rails

756 slide into the curved projections 750. This type of locking mechanism may be referred to as a "slide and lock" attachment structure.

FIG. 107, FIG. 109, FIG. 110, and FIG. 112 show further embodiments of a center track assembly 614. In these embodiments, the projecting element 746*a*, 746*b* may include one rail and the hooking element 744*a*, 744*b* may include a curved projection 750*a*, 750*b*. These complementary features may form a press fit connection. This type of locking mechanism may be referred to as a "snap and lock" attachment structure.

Figure 111:
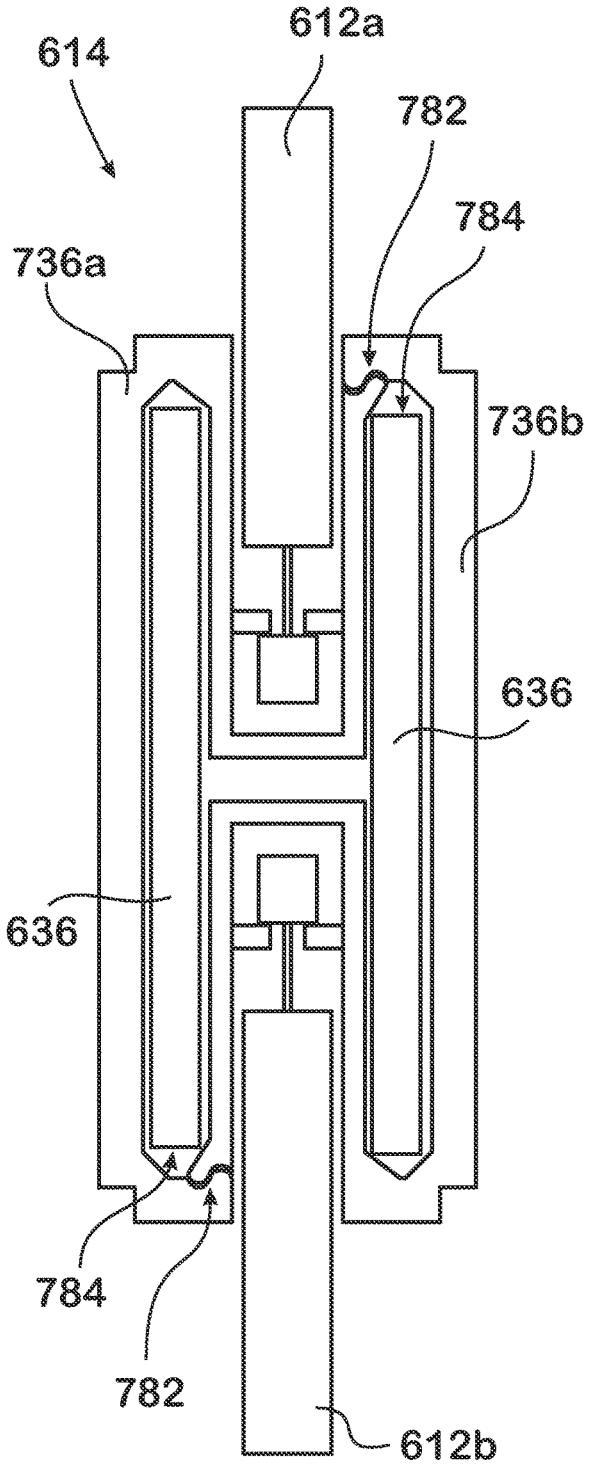
FIG. 111 is a cross-sectional view of another exemplary embodiment of a center track assembly in accordance with the present invention.
Figure 112:
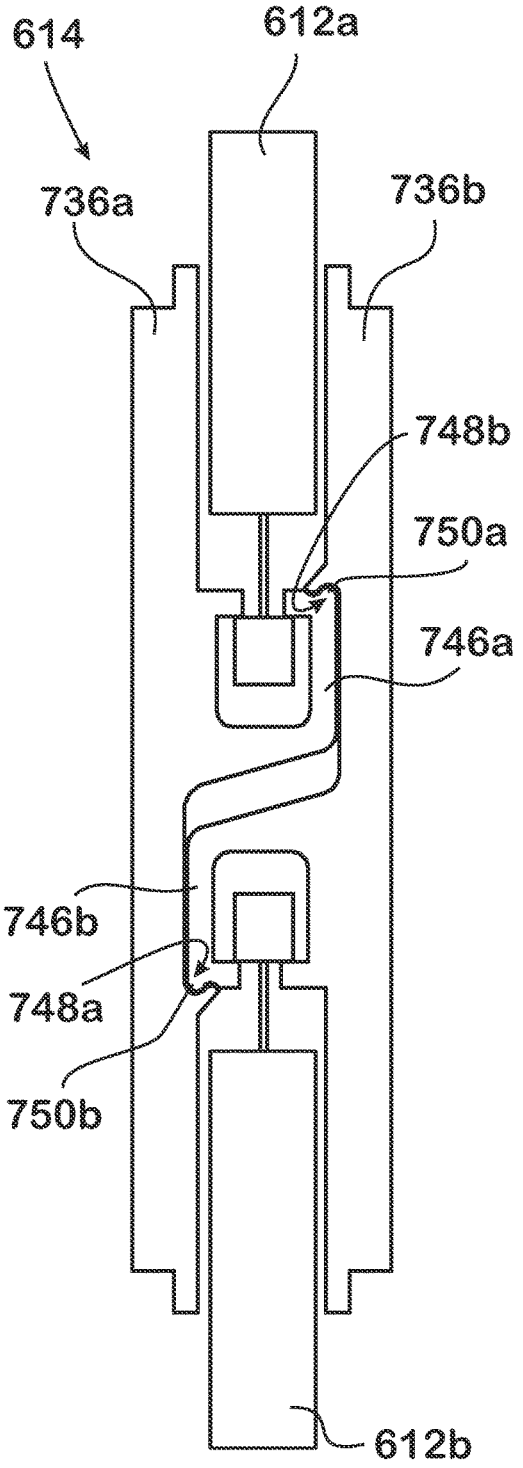
FIG. 112 is a cross-sectional view of another exemplary embodiment of a center track assembly in accordance with the present invention.

FIG. 111 shows yet another embodiment of a center track assembly 614. In this embodiment, the two track components may be locked together via two press fit connections 782. This type of locking mechanism also may be referred to as a "snap and lock" attachment structure. These track components further may form a pair of interior chambers 784. The interior chambers may be filled with sound blocking or sound absorbing material. In this embodiment, the center track assembly holds the two flexible barrier material segments between an array of sound proofing and/or sound absorbing materials.

Figure 88:
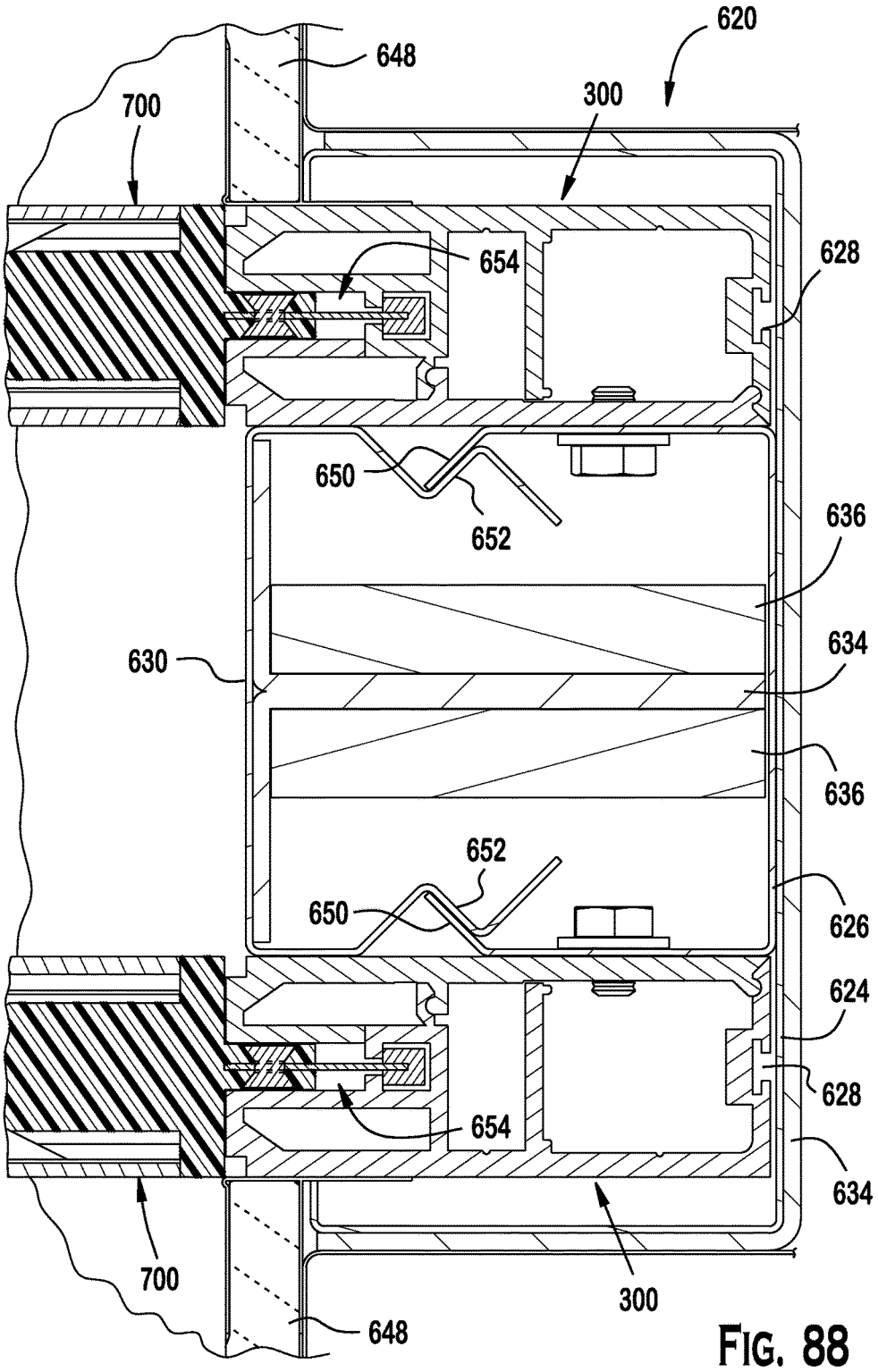
FIG. 88 is a cross-sectional view of exemplary embodiments of a skeleton, vertical assembly, and double side track in accordance with the present invention.

FIG. 88 shows a sectional view of a vertical assembly 620 and two horizontal tracks 700 of yet another embodiment of a roll up acoustic barrier. In this embodiment, the flexible barrier material 613 may be sufficiently thin so as to be used with the traveling guide pin 72 and track 300, as shown and described in connection with FIG. 24 and FIG. 25. Arcuate track 152 also may be used as a side track 628 in certain situations.

Figure 113:
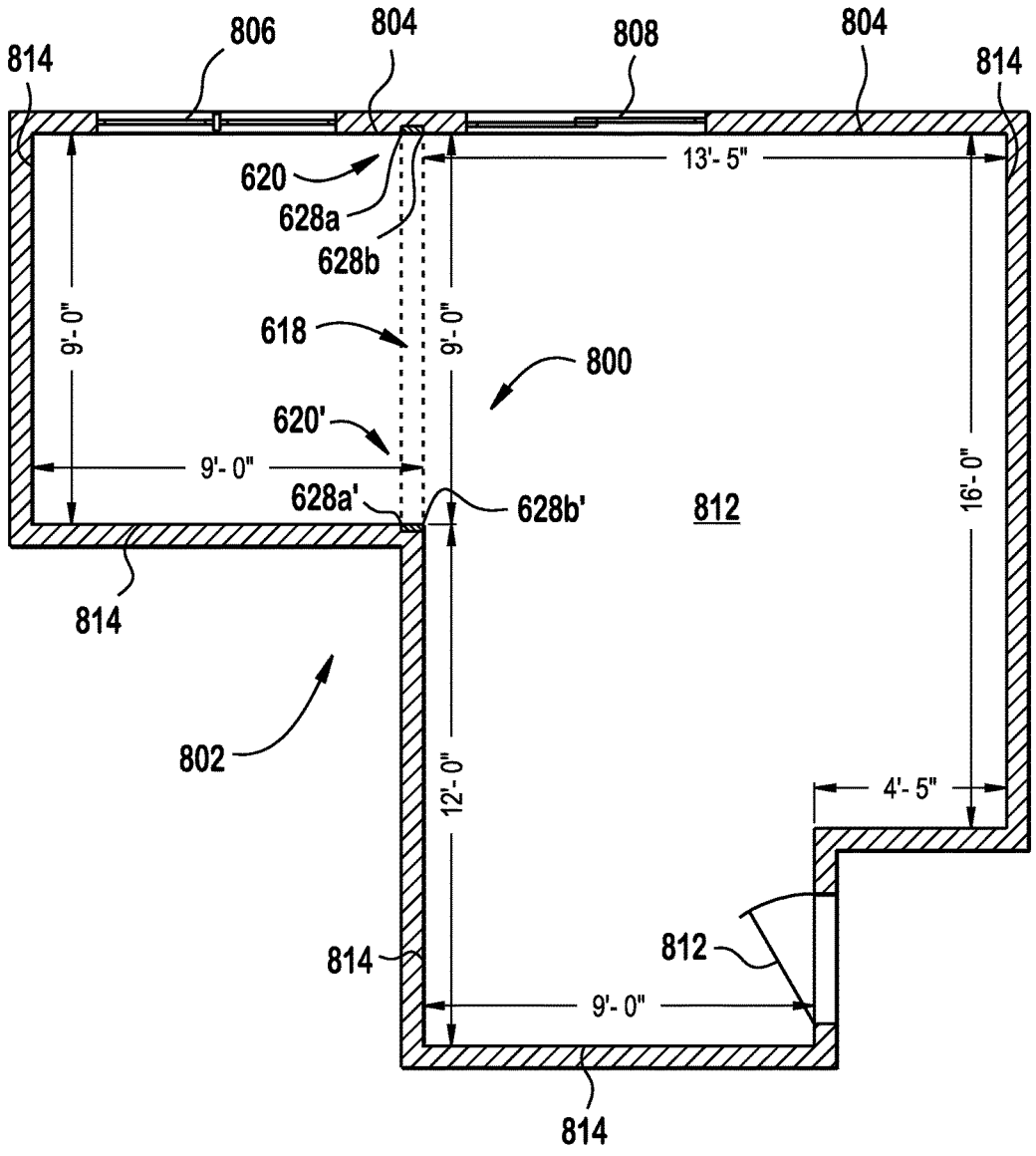
FIG. 113 is a plan view of an exemplary embodiment of a roll-up acoustic barrier 608' in a commercial office setting.
Figure 114:
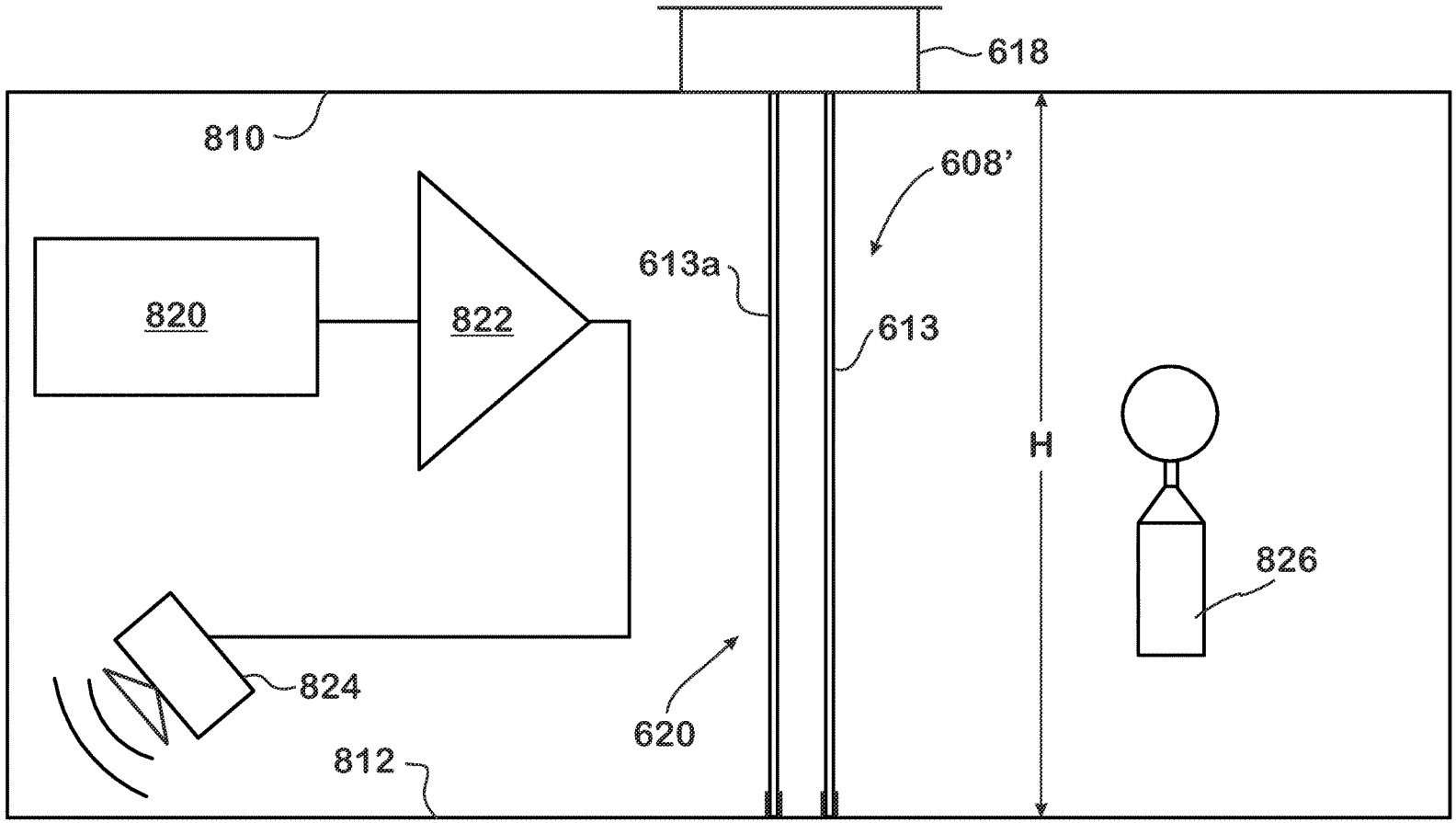

Referring to FIG. 113, an exemplary roll up acoustic barrier 800 was positioned in a commercial office space 802. The office space 802 was located at 101 Broadway, Suite 502, Brooklyn N.Y. 11249-6034. The office space 802 was partitioned with a roll up acoustic barrier 800. The exterior wall 804 of the office space included a brick veneer and interior sheet rock finish. A glass window 806 and a sliding glass door 808 were disposed in the exterior wall 804. The window 806 had a width of approximately 5'-6" and a height of approximately 7'. The sliding glass door 808 had a width of approximately 6' and a height of approximately 8'. The finished ceiling height in the office 800 was approximately 8'-6" (dimension H on FIG. 114). The finished ceiling 808 (see FIG. 114) was a drop down ceiling, and the floor 812 was a vinyl plank on concrete floor. The interior walls 814 of the office 802 were formed from sheet rock partitions. The entry door 816 was wooden.

The exemplary roll up acoustic barrier 800 included one vertical assembly 620 on the exterior wall 804 between the window 806 and the sliding glass door 808, as well as another vertical assembly 620' on the opposing interior wall 814. The vertical assembly 620 on the exterior wall 804 included a side track 628*a* for an inner screen of flexible barrier material 613, as well as a side track 628*b* for an outer screen of flexible barrier material 613. Similarly, the vertical assembly 620' on the interior wall 814 included a side track 628*a'* for the inner screen of flexible barrier material 613, as well as a side track 628*b'* for the outer screen of flexible barrier material 613. A top box 818 was installed in the ceiling 810 (not shown in FIG. 113, but depicted in FIG. 114) above the vertical assemblies 620, 620'.

In the roll up acoustic barrier 800 of FIG. 113, the vertical assemblies 620, 620' were constructed in accordance with the vertical assembly 620 depicted in FIGS. 51-53, except that the side tracks 628*a*, 628*b*, 628*a'*, 628*b'* were positioned deeper within each respective skeleton 648 as shown in FIG. 69. The top box 818 of the roll up acoustic barrier 800 of FIG. 113 was constructed in accordance with the top box 618 of FIGS. 52, 57 and 58. Flexible barrier material 613 was fed from a 5" diameter tube 642 into the associated pair of opposing side tracks 628 as shown in FIGS. 54-58. Each roll of flexible barrier material 613 was connected to the respective horizontal track 700 as shown in FIG. 62. In the roll up acoustic barrier of FIG. 113, however, no flap 706 of sound blocking material was present on the interior side of the horizontal track 700. Also, each horizontal track assembly 708 (not shown) was constructed in accordance with the horizontal track assembly of FIGS. 63, 66, and 67, except that no zipper lock 718 was used.

Moreover, in the roll up acoustic barrier of FIG. 113, each of the flexible membrane barriers was formed from three sheets of flexible mass loaded vinyl. Each sheet of flexible mass loaded vinyl was a two pound per square foot sheet of flexible B-10 R Noise Barrier material as previously described. Each sheet of flexible mass loaded vinyl 634 was of sufficient length to span the opening between the opposing vertical assemblies 620, 620'. Thus, each sheet of flexible mass loaded vinyl was approximately 7'-6" long. The height of the three sheets of flexible mass loaded vinyl varied. The center sheet of flexible mass loaded vinyl was approximately 54" in height. The lower sheet of mass loaded vinyl was approximately 34" in height. The upper sheet of mass loaded vinyl was less than 34" but sufficient to allow the flexible barrier membrane to full deploy to the ground, as well as provide a residual amount in the top box that was connected (directly or indirectly) to the tube. The adjacent sheets of the flexible mass loaded vinyl were connected together in accordance with the center tack assembly of FIGS. 72 and 74-80, except that no flap of sound blocking material was present on the interior side of the center track. Additionally, each side of the center track assembly 614 was secured within the vertical track 628 as depicted in FIG. 81.

Acoustic testing was performed to measure soundproofing effectiveness of the roll up acoustic barrier 800. More particularly, the testing was designed to measure the soundproofing effectiveness for human audible sound frequencies including frequencies ranging from approximately 63 Hz to approximately 16 kHz. Additionally, the test was designed to measure a frequency weighting that relates to the response of the human ear known as A-weighting. The A-weighted sound pressure level is reported in units of dBA.

The testing was conducted to measure the insertion loss across the roll up acoustic barrier. Insertion loss (IL) is the reduction of noise level at a given location due to placement of a noise control device in the sound path between the sound source and that location. Referring to FIG. 14, a pink noise generator 820, connected to an amplifier 824, and a loudspeaker 824 were set up in the office between the entry door 816 and the roll up acoustic barrier 800.

A spectrum analyzer/sound level meter was positioned on the opposite side of the roll up acoustic barrier. The spectrum analyzer/sound level meter used in the testing was a Bruel & Kjaer 2270 Analyzer that was referenced to 0.0002 microbar and calibrated with a Quest CA-15A. The Bruel & Kjaer 2270 Analyzer qualifies as an ANSI Type 1 Sound Level Meter. The spectrum analyzer/sound level meter was positioned three feet from the inner screen of the roll up acoustic barrier and four feet above the floor. The testing was performed using a loudspeaker source of pink noise, which contains all audio frequencies. The measured sound levels were corrected for background noise. Sound measurements were made with the roll up acoustic barrier in different operable configurations: (1) the open barrier configuration (i.e., both screens up); (2) the outer screen configuration (i.e., the inner screen is up and the outer screen is down); (3) the inner screen configuration (i.e., the inner screen is down and the outer screen is up); and (4) the double screen configuration (i.e., the inner screen is down and the outer screen is down).

Measurements from the acoustic testing investigation are presented in Table 2 (below) and the results are depicted graphically in FIG. 115. Based on a review of the data in Table 2, the inner screen configuration and the outer screen configuration had measured insertion loss values of approximately 20.5 dBA. By contrast, the double screen configuration had a measured insertion loss value of approximately 25.5 dBA. In this context, a measured insertion loss value of 20 dBA is a 75% reduction in noise level; whereas a measured insertion loss of 20.5 dBA is a 83% reduction in noise level. Thus, the single screen configurations of the roll up acoustic barrier of FIG. 113 may reduce typical home and office noise to approximately 25% of the original noise level, while the double screen configuration may reduce typical home and office noise to approximately 17% of the original noise level.

TABLE 2

Sound Measurements and Measured Insertion Loss (IL)

| Acoustic Barrier Configuration | 31.5 Hz (dB) | 63 Hz (dB) | 125 Hz (dB) | 250 Hz (dB) | 500 Hz (dB) | 1 kHz (dB) | 2 kHz (dB) | 4 kHz (dB) | 8 kHz (dB) | 16 kHz (dB) | IL (dBA) |
|---|---|---|---|---|---|---|---|---|---|---|---|
| Double Screen | 7.58 | 14.24 | 15.17 | 20.41 | 29.41 | 38.68 | 42.72 | 45.88 | 49.46 | 40.54 | 25.48 |
| Outer Screen | 5.27 | 12.57 | 11.96 | 18.03 | 19.4 | 25.85 | 27.71 | 31.28 | 31.47 | 32.68 | 20.5 |
| Inner Screen | 2.21 | 12.49 | 12.83 | 17.97 | 19.1 | 24.59 | 26.29 | 27.36 | 27.12 | 27.31 | 20.37 |

Figure 115:
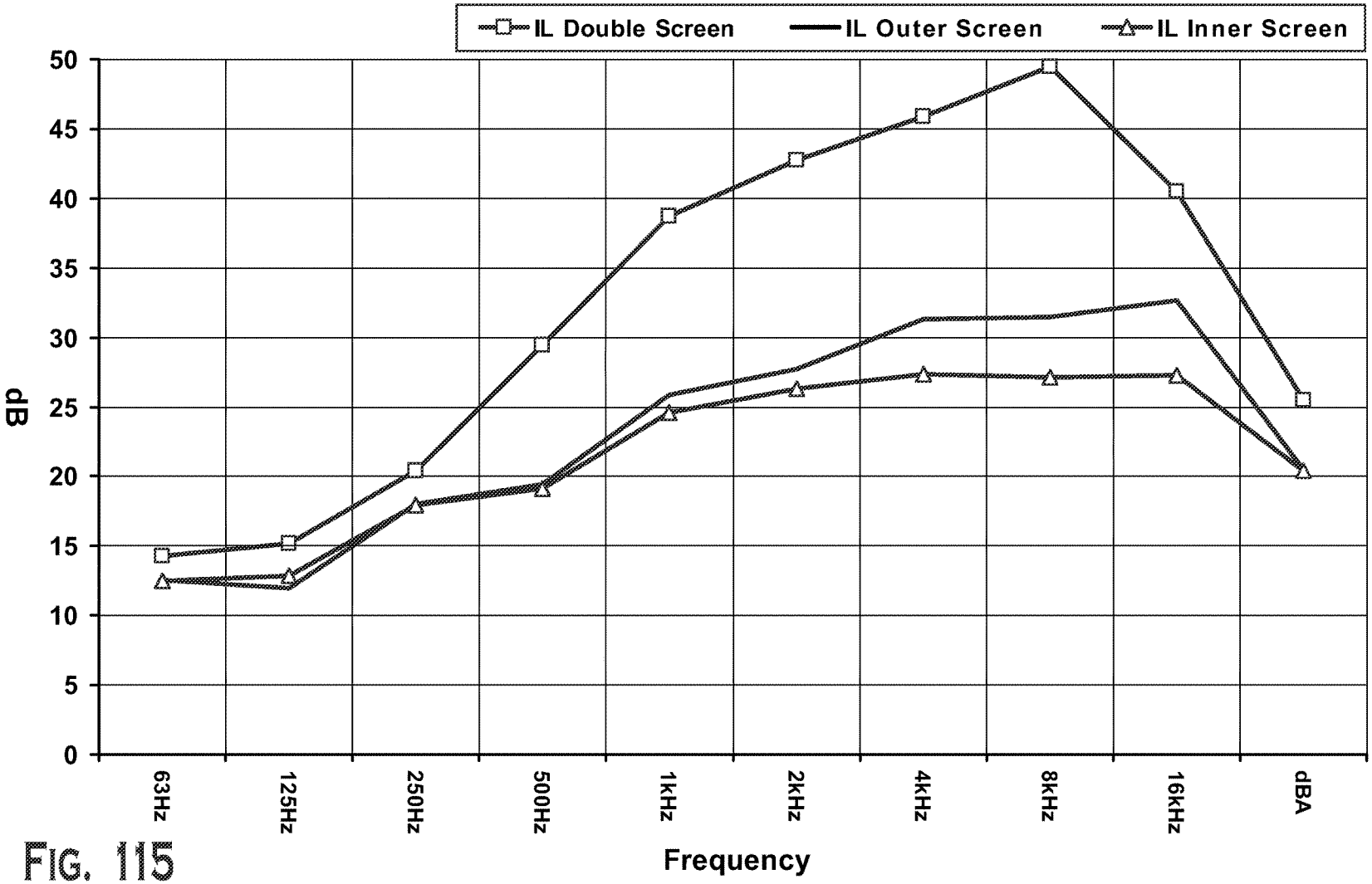

Referring to FIG. 115, the graph presents the data reported in Table 2 for sound measurements and measured insertion loss (IL) of pink noise across the roll up acoustic barrier of FIG. 113. The graph shows the soundproofing effectiveness of the roll up acoustic barrier. In general, the greater the measured value, the more effective the soundproofing afforded by the roll up acoustic barrier. Accordingly, the roll up acoustic barrier is most effective at the middle frequency and high frequency sounds. Middle frequency and high frequency sounds are believed to be the most common sounds in a typical office or home environment.

While it the present invention, it will be understood by those skilled in the art that various changes and modifications may be made, and equivalents may be substituted for elements thereof without departing from the true scope of the invention. Additionally, features and/or elements from any embodiment may be used singly or in combination with other embodiments. Therefore, it is intended that this invention not be limited to the particular embodiments disclosed herein, but that the invention include all embodiments falling within the scope and the spirit of the present invention.

What is claimed is:

1. A roll-up wall and acoustic barrier system comprising:
- a tube which comprises a longitudinal axis;
- a first vertical track comprising
  - a first elongated member comprising a first cross-sectional profile which comprises
    - a first channel;
- a second vertical track comprising
  - a second elongated member comprising a second cross-sectional profile which comprises
    - a second channel;
- a horizontal track disposed between the first vertical track and the second vertical track, the horizontal track comprising
  - a third elongated member comprising a third cross-sectional profile which comprises
    - a front wall,
    - a rear wall spaced from the front wall,
    - a bottom wall connecting the front wall and the rear wall,
    - a top wall adjacent the front wall,
    - another top wall adjacent the rear wall, and
    - an open channel disposed between the top wall and the other top wall which comprises
      - a first side wall connected to the top wall,
      - a second side wall connected to the other top wall,
      - a first ledge extending from the first side wall toward the second side wall, and
      - a second ledge extending from the second side wall toward the first side wall, the first and second ledges defining a slot between the first side wall and the second side wall, and
    - a conduit disposed between the front wall and the rear wall, the conduit being connected to the open channel via the slot; and
- a flexible membrane barrier connected to the tube which comprises a first barrier side, a second barrier side, and a third barrier side, the third barrier side including a zipper, the first barrier side being disposed in the first channel, the second barrier side being disposed in the second channel, and the zipper being disposed in the conduit of the horizontal track.

2. The roll-up wall and acoustic barrier system of claim 1, wherein the first cross-sectional profile further comprises:
- a first front wall,
- a first rear wall spaced from the first front wall,
- a first bottom wall which connects the first front wall and the first rear wall,
- a first top wall adjacent the first front wall,
- a second top wall adjacent the first rear wall,
- a first interior wall connected to the first top wall, the first interior wall being disposed parallel to the first front wall,
- a second interior wall connected to the second top wall, the second interior wall being disposed parallel to the first rear wall,
- wherein the first channel is situated between the first and second top walls and the first and second interior walls, and the first channel extends toward the first rear wall.

3. The roll-up wall and acoustic barrier system of claim 2, wherein the first front wall comprises a first front wall length, and the first channel comprises a first channel length, the first channel length being substantially equal to or greater than one half the first front wall length.

4. The roll-up wall and acoustic barrier system of claim 3, wherein the first bottom wall comprises a first bottom wall length, the first channel comprises a first channel width, and the first channel width is substantially equal to or less than one third the first bottom wall length.

5. The roll-up wall and acoustic barrier system of claim 1, wherein the first side wall is separable from the first ledge and the front wall is separable from the bottom wall.

6. The roll-up wall and acoustic barrier system of claim 1, wherein the flexible membrane barrier comprises a sound dampening material.

7. The roll-up wall and acoustic barrier system of claim 6, wherein the sound dampening material is mass loaded vinyl.

8. The roll-up wall and acoustic barrier system of claim 7, wherein the flexible membrane barrier comprises a two pound per square foot sheet of flexible mass loaded vinyl.

9. The roll-up wall and acoustic barrier system of claim 7, wherein the mass loaded vinyl has a tensile strength of approximately 1470 pounds per square inch.

10. The roll-up wall and acoustic barrier system of claim 7, wherein the sound dampening material comprises an engineered sound abatement material.

11. The roll-up wall and acoustic barrier system of claim 10, wherein the engineered sound abatement material transforms sound energy into inaudible friction energy.

12. The roll-up wall and acoustic barrier system of claim 11, wherein the engineered sound abatement material is formed from a viscoelastic polymer material.

13. The roll-up wall and acoustic barrier system of claim 6, wherein the flexible membrane barrier has a Sound Transmission Class rating of at least 26 in accordance with ASTM E413.

14. The roll-up wall and acoustic barrier system of claim 1, wherein the roll-up wall and acoustic barrier system comprises first and second operable configurations such that in the first operable configuration a first amount of the flexible membrane barrier is wound around the tube and the horizontal track is in a raised position, and such that in the second operable configuration the horizontal track is in a lowered position.

15. The roll-up wall and acoustic barrier system of claim 14, wherein measured insertion loss of pink noise across the roll-up wall and acoustic barrier system in the second operable configuration is approximately 20 dBA.

16. The roll-up wall and acoustic barrier system of claim 15, further comprising another flexible membrane barrier which is spaced from the flexible membrane barrier, and wherein the roll-up wall and acoustic barrier system further comprises a third operable configuration such that in the third operable configuration measured insertion loss of pink noise across the roll-up wall and acoustic barrier system is approximately 25 dBA.

17. The roll-up wall and acoustic barrier system of claim 1, further comprising a center track assembly, wherein the flexible membrane barrier comprises an upper segment and a lower segment and the center track assembly securely connects the upper segment to the lower segment.

18. The roll-up wall and acoustic barrier system of claim 1, further comprising an entry guide piece disposed between the tube and the first elongated member such that the entry guide piece comprises a guide surface which facilitates travel of the flexible membrane barrier between the tube and the first channel.

19. The roll-up wall and acoustic barrier system of claim 18, further comprising a skeleton which comprises a U-shape, and a center support positioned inside the U-shape, wherein the first vertical track is secured to the center support.

20. The roll-up wall and acoustic barrier system of claim 19, further comprising an access cover connected to the center support.

21. The roll-up wall and acoustic barrier system of claim 20, wherein the skeleton further comprises sound blocking material, and the access cover comprises sound blocking material and sound absorbing material.

22. The roll-up wall and acoustic barrier system of claim 21, wherein the tube is a thin wall hollow member.

23. The roll-up wall and acoustic barrier system of claim 22, wherein the tube comprises a cross-sectional profile that comprises a substantially circular outer wall.

* * * * *